United States Patent [19]

Shinada et al.

[11] Patent Number: 5,008,709

[45] Date of Patent: Apr. 16, 1991

[54] DOCUMENT RECYCLING COPIER FOR COPYING DOCUMENTS OF VARYING SIZES

[75] Inventors: Masayuki Shinada, Yokohama; Masumi Ikesue; Mitsutoyo Kikuno, both of Tokyo; Tatsuya Murai, Yokohama, all of Japan

[73] Assignee: Ricoh Company, Ltd., Tokyo, Japan

[21] Appl. No.: 362,686

[22] Filed: Jun. 7, 1989

[30] Foreign Application Priority Data

| | | | |
|---|---|---|---|
| Jun. 7, 1988 | [JP] | Japan | 63-138542 |
| Jun. 30, 1988 | [JP] | Japan | 63-162948 |
| Jul. 11, 1988 | [JP] | Japan | 63-173609 |
| Jul. 11, 1988 | [JP] | Japan | 63-173610 |
| Jul. 11, 1988 | [JP] | Japan | 63-173611 |
| Jul. 11, 1988 | [JP] | Japan | 63-173612 |
| Jul. 11, 1988 | [JP] | Japan | 63-173613 |

[51] Int. Cl.[5] ..... G03G 15/00

[52] U.S. Cl. ..... 355/309; 355/311; 355/324; 355/243

[58] Field of Search ..... 355/243, 309, 311, 324, 355/313, 314; 270/53, 58, 37

[56] References Cited

U.S. PATENT DOCUMENTS

| | | | |
|---|---|---|---|
| 3,992,093 | 11/1976 | Jakobson | 355/51 |
| 4,620,781 | 11/1986 | Miyamoto | 355/317 |
| 4,636,063 | 1/1987 | Takai et al. | 355/68 |
| 4,653,904 | 3/1987 | Imamura | 355/68 |
| 4,739,369 | 4/1988 | Yoshiura et al. | 355/311 X |
| 4,864,350 | 9/1989 | Ishiguro et al. | 355/324 X |

FOREIGN PATENT DOCUMENTS

| | | | |
|---|---|---|---|
| 62-79437 | 4/1987 | Japan | 355/311 |

*Primary Examiner*—Joan H. Pendegrass

*Attorney, Agent, or Firm*—Oblon, Spivak, McClelland, Maier & Neustadt

[57] ABSTRACT

A document recycling copier having, in a system configuration, a copier body, a recycling document handler which may be loaded with a stack of documents of different sizes, and a finisher for automatically arranging and binding a series of copied paper sheets. The copier is capable of copying the individual documents of different sizes on paper sheets the sizes of which are individually associated with the documents, or copying all of the documents of different sizes on paper sheets of the same size, as desired.

16 Claims, 47 Drawing Sheets

| Fig. 13A | Fig. 13B |
|---|---|

| Fig. 15A | Fig. 15B |
|---|---|

Fig. 20C

| ADDRESS | DOCUMENT NO. | ORIGINAL SIZE DATA |
|---|---|---|
| $ADD_N$ | 1 | Size DATA3 (A3) |
| $ADD_{N+1}$ | 2 | Size DATA3 (A3) |
| $ADD_{N+2}$ | 3 | Size DATA4 (A4) |
| $ADD_{N+3}$ | 4 | Size DATA4 (A4) |
| | | |
| $ADD_{N+n}$ (LAST-1) | LAST | Size DATA5 (B4) |

Fig. 35

| ADDRESS | DOCUMENT NO. | ORIGINAL SIZE DATA |
|---|---|---|
| $Add_N$ | 1 | Size DATA3 (A3) |
| $Add_{N+1}$ | 2 | Size DATA3 (A3) |
| $Add_{N+2}$ | 3 | Size DATA3 (A3) |
| $Add_{N+3}$ | 4 | Size DATA4 (A4) |
| $Add_{N+4}$ | 5 | Size DATA4 (A4) |
| $Add_{N+5}$ | 6 | Size DATA (A4) |
| | | |
| $Add_{N+(LAST-1)}$ | (LAST) | Size DATA (A4) |

Fig. 36

| ORIGINAL DOCUMENT / PAPER | A 3 | B 4 | A 4 |
|---|---|---|---|
| A 3 | $Add_{(n)}$ 100 (%) | $Add_{(n+3)}$ 115 (%) | $Add_{(n+8)}$ 141 (%) |
| B 4 | $Add_{(n+1)}$ 87 (%) | $Add_{(n+4)}$ 100 (%) | $Add_{(n+8)}$ 122(%) |
| A 4 | $Add_{(n+2)}$ 71 (%) | $Add_{(n+5)}$ 82 (%) | $Add_{(n+8)}$ 100 (%) |

Fig. 37

| ADDRESS | DOCUMENT NO. | MAGNIFICATION DATA |
|---|---|---|
| $Add_N$ | 1 | MAX·R |
| $Add_{N+1}$ | 2 | MAX·R |
| $Add_{N+2}$ | 3 | MAX·R |
| $Add_{N+3}$ | 4 | MIN·R |
| $Add_{N+4}$ | 5 | MIN·R |
| $Add_{N+5}$ | 6 | MIN·R |
| | | |
| $Add_{N+(LAST-1)}$ | (LAST) | MIN·R |

DOCUMENT RECYCLING COPIER FOR COPYING DOCUMENTS OF VARYING SIZES

BACKGROUND OF THE INVENTION

The present invention relates to a document recycling copier and, more particularly, to a document recycling copier of the type having, in a system configuration, a copier body, a recycling document handler which may be loaded with a stack of documents of different sizes, and a finisher for automatically arranging and binding a sequence of copied paper sheets. The copier with which the present invention is concerned is capable of copying documents of different sizes on paper sheets which individually match the documents in size, or copying all of them on paper sheets of a single size, as desired.

A current trend in the copiers art is toward a multifunction and systematic configuration which includes an automatic document feeder (ADF). An advanced type of ADF available today is a recycling document handler (RDH) having a document tray which may be loaded with a stack of documents of different sizes randomly. The RDH sequentially transports such documents one by one from the tray to an exposing station defined on a copier body while returning them to their predetermined position on the tray. Further, a copier with an RDH is operable with a finisher which automatically arranges and binds copied paper sheets which sequentially come out of the copier. With the combination of a copier, RDH and finisher, therefore, it is possible to automatically produce a desired number of bound sets of copies each consisting of reproductions of a sequence of documents simply by stacking the documents on the tray of RDH and then pressing a print key of the copier.

A problem with the prior art copier is that a stack of documents of different sizes cannot be reproduced without lowering the copying efficiency to a critical extent. Specifically, the sizes of the individual documents have to be sensed at each time of copying so as to select paper sheets of a size which match a particular document size each time. Further, when paper sheets of a particular size are selected beforehand, optics of the copier have to be moved to select an adequate magnification each time. A copier may be provided with an RDH constructed such that a stack of documents of different sizes laid on the tray are sequentially transported toward a glass platen of a copier body, the lowermost document being first, while being squentially returned to the tray after imagewise exposure, as disclosed in Japanese Laid-Open Patent Publication (Kokai) No. 61-263534 by way of example. The copier disclosed in this Laid-Open Patent Publication has a capability for steering a copied paper sheet which carries an image on one side thereof, i.e., one-sided copy to return it toward a copy processing section of the copier body for thereby automatically producing a two-sided copy. This kind of copier has document size sensing means for sensing the sizes of individual documents while the documents are sequentially fed from the tray, document size sensing means for sequentially memorizing the sensed document sizes while the documents are circulated once prior to the start of actual copying operations, and means for sequentially reading the document sizes out of the storing means to group the documents on a size basis. While such a copier is capable of reproducing documents belonging to a particular size group on paper sheets which have the same size as the documents, it cannot reproduce all the documents of different sizes on paper sheets of a single size with high efficiency.

Another problem with a prior art copier having an RDH and a finisher is that when documents of different sizes are to be stacked on the tray of the RDH to be copied size by size and then automatically bound by the finisher, one has to rearrange the documents on a size basis before actually operating the copier. In addition, when bound sets of copies which are different in size from each other are driven out of the finisher onto a discharge tray randomly, it may occur that a larger set of copies is laid on a smaller set of copies. This not only prevents the bindings from being stacked neatly on the discharge tray but also makes it difficult for one to see the underlying bindings.

SUMMARY OF THE INVENTION

It is therefore an object of the present invention to provide a document recycling copier which, even when a stack of documents of different sizes are laid randomly, produces bound sets of copies of the documents in conformity to the sizes of the documents.

It is another object of the present invention to provide a document recycling copier which, even when documents of two different sizes are stacked randomly, produces bound sets of copies of the documents on a document size basis by circulating the documents only once.

It is another object of the present invention to provide a document recycling copier which, even when documents of three or more different sizes are stacked randomly, produces bound sets of copies of the documents on a document size basis and, yet, minimizes the number of circulations of the documents.

It is another object of the present invention to provide a document recycling copier which enhances neat stacking of bound sets of copies and, therefore, easy confirmation thereof.

It is another object of the present invention to provide a document recycling copier capable of reproducing documents of different sizes efficiently on paper sheets of the same size.

It is another object of the present invention to provide a document recycling copier capable of automatically selecting a paper size optimum for particular document sizes so that documents of different sizes may be reproduced on paper sheets of a single size efficiently.

It is another object of the present invention to provide a document recycling copier capable of automatically reproducing documents by using two different magnifications depending upon the document size, so that documents of different sizes may be reproduced on paper sheets of a single size efficiently.

In accordance with the present invention, a copier in which documents are recycled comprises a plurality of paper feeding means each for feeding paper sheets of a different size, copying means for copying documents on paper sheets which individually match the documents in size, a recycling automatic document feeding device loaded with a stack of documents having a plurality of sizes for sequentially transporting the documents one by one to an imagewise exposing station of the copying means, a finisher for automatically binding copied paper sheets discharged from the copying means while regulating a stacking condition of the copied paper sheets, document size sensing means for sensing the sizes of the documents being transported to the exposing station by the automatic document feeding device, main control means for controlling the copying means and automatic document feeding device such that a plurality of control operations are selectively performed, and finisher control means for controlling the finisher such that the copied paper sheets produced by the control operations of the main control means are bound and discharged.

Also, in accordance with the present invention, a copier in which documents are recycled comprises a plurality of feeding means each for feeding paper sheets of a different size, copying means supplied with paper sheets which individually match documents in size for copying documents on the paper sheets, a recycling automatic document feeding device loaded with a stack of documents of a plurality of sizes for sequentially transporting the documents one by one to an imagewise exposing station of the copying means while returning the documents to a predetermined position of the automatic document feeding device, document size sensing means for sensing sizes of the documents, document size storing means for storing the sensed sizes of the documents, magnification changing means for changing a size in which the documents are to be copied on the paper sheets, and means for causing the automatic document feeding device to circulate the individual documents once while causing the document size sensing means to sense the sizes of the documents, storing the sensed sizes of all of the documents in the document size storing means, and automatically selecting, on the basis of the stored document sizes, paper sheets associated with the documents of a medium size or paper sheets associated with the documents of a major size which a majority of the documents shares.

Further, in accordance with the present invention, a copier in which documents are recycled comprises a plurality of feeding means each for feeding paper sheets of a different size, copying means for copying documents on paper sheets which individually match the documents in size, a recycling automatic document feeding device loaded with a stack of documents of a plurality of sizes for sequentially transporting the documents one by one to an imagewise exposing station of the copying means while returning the documents to a predetermined position of the automatic document feeding device, document size sensing means for sensing sizes of the documents, document size storing means for storing the sensed sizes of the documents, magnification changing means for changing a size in which the documents are to be copied on the paper sheets, and control means for causing the automatic document feeding device to circulate the individual documents once while causing the document size sensing means to sense the sizes of the documents, storing all of the sensed sizes of the documents in the storing means, and setting, by dividing the documents of a plurality of sizes into two size groups on the basis of the stored document sizes, a copy mode in which the documents are copied on the paper sheets of a single size by two kinds of magnifications which include the same magnification as the documents.

BRIEF DESCRIPTION OF THE DRAWINGS

The above and other objects, features and advantages of the present invention will become more apparent from the following detailed description taken with the accompanying drawings in which:

FIGS. 16, 17A, 17B, 18A, 18B, 19, 20A, 20B, 20C, 21A, 21B and 22 are flowcharts demonstrating a first embodiment of control operations as performed by the copier body control unit;

FIG. 35 indicates a relationship between addresses of a RAM and original size data stored in those addresses;

FIG. 36 shows magnifications with respect to document sizes and paper sizes stored in a ROM beforehand;

FIG. 37 shows a relationship between addresses of a RAM and magnification data stored in those addresses;

DESCRIPTION OF THE PREFERRED EMBODIMENTS

Figure 1:
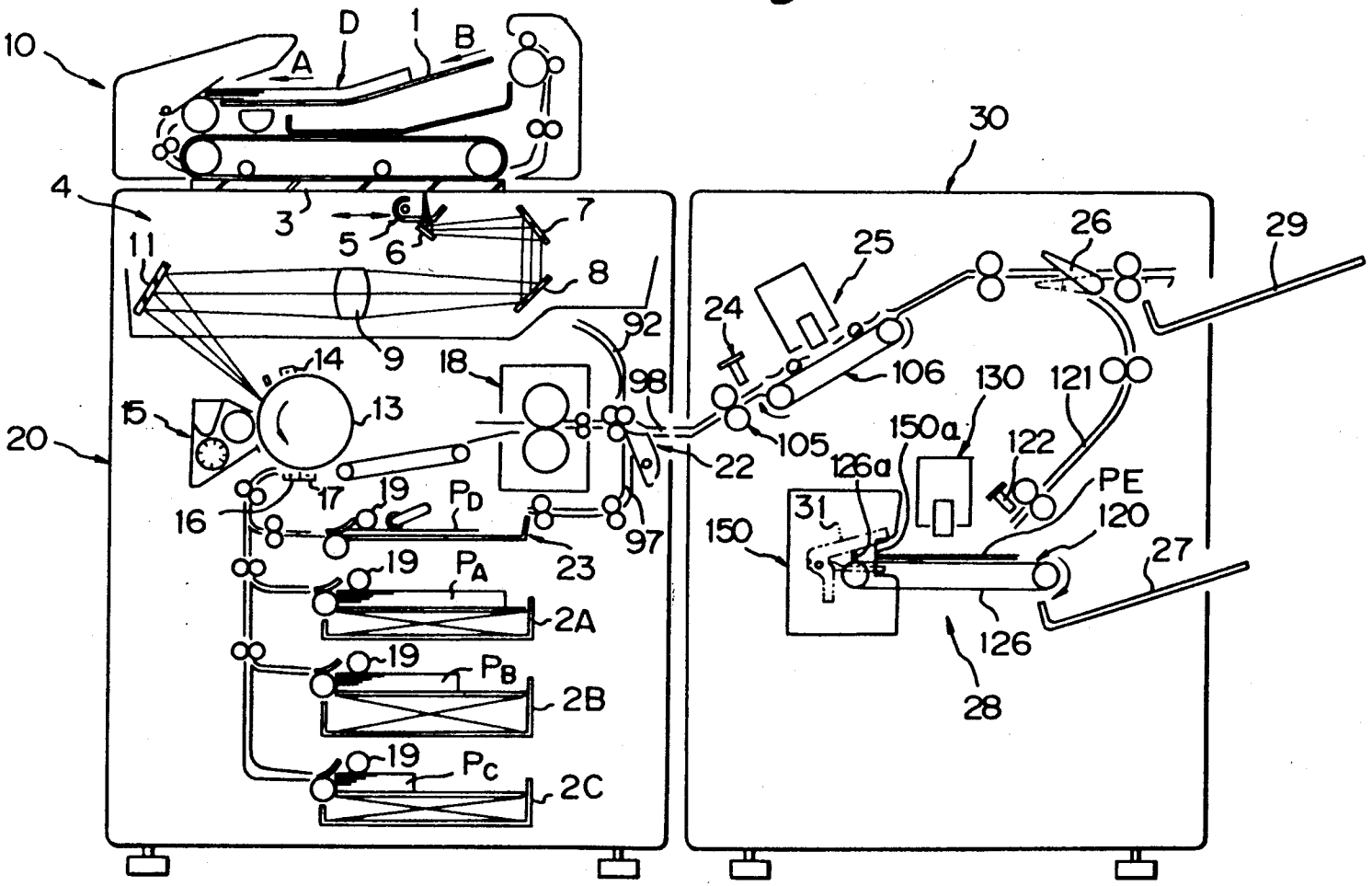
FIG. 1 is a view of a document recycling copier embodying the present invention.

Referring to FIG. 1 of the drawings, a document recycling copier embodying the present invention is shown. As shown, the copier has a recycling document handler (RDH) 10 which allows documents D of different sizes to be stacked on its document tray 1. The RDH 10 sequentially feeds the documents D toward an imagewise exposing station in the order of page, the lowermost one being first, while returning them onto the tray 1 for recycling. The copier also has a copier body 20 which is provided with sheet cassettes 2A to 2C that are arranged one above another and are individually loaded with paper sheets PA to PC of different sizes. An image is transferred to any of the paper sheets PA to PC fed out of their associated sheet cassettes 2A to 2C so as to produce a copy. The copier further has a finisher 30 which neatly arranges the paper sheets, or copies, coming out of the copier body 20 and binds them together by a stapler automatically.

Specifically, the documents D laid on the document tray 1 are fed one by one, the lowermost document being first, in a direction indicated by an arrow A in the figure. The copier body 20 has a glass platen 3 on which each document D fed from the tray 1 is brought to a halt. The glass platen 3 is dimensioned large enough to accommodate a document of format A3 which is to be fed in a laterally long orientation, i.e. sideways. Optics 4 include a lamp 5 which illuminates the document D being laid on the glass platen 3. A reflection from the document D is routed through a first mirror 6, a second mirror 7, a third mirror 8, a lens 9 and a fourth mirror 11 to be focused on a photoconductive drum 13. As a result, a latent image representative of the document D is electrostatically formed on the surface of the drum 13 which has been charged by a main charger 14 beforehand. The latent image is developed by a toner which is fed from a developing unit 15. One of the sheet cassettes 2A to 2C each being loaded with paper sheets of a different size is selected in conformity to the size of the documents. When a feed clutch associated with the selected sheet cassette 2A, 2B or 2C is coupled, a pick-up roller 19 associated with the feed clutch is rotated to drive the paper sheets one by one out of the sheet cassette. As soon as the paper sheet reaches the drum 13, a transfer charger 16 is energized to transfer the toner image from the drum 13 to the paper sheet. The paper sheet carrying the toner image thereon is separated from the drum 13 by a separation charger 17 and then driven toward a fixing unit 18 for fixing the toner image.

A switching unit 22 selects a particular sheet transport path in response to a command entered beforehand, i.e., a "common discharge" command, "face-down discharge" command, "two-side unit transport" command or "face-down two-side unit transport" command, as described in detail later. The paper sheet coming out of the fixing unit 18 is guided by the switching unit 22 to such a particular sheet transport path. The document D undergone the imagewise exposure on the glass platen 3 is driven out of the glass platen 3 onto the document tray 1 while being turned over, as indicated by an arrow B. Paper sheets PD each carrying a toner image on one side thereof, i.e., one-sided copies may be steered by the switching unit 22 to a two-side unit 23 which is also provided with a pick-up roller 19. When a two-side feed clutch (not shown) is coupled, the one-sided copies stacked on the two-side unit 23 are sequentially refed by the pick-up roller 19 toward the image transferring station.

The finisher 30 has an inlet sensor 24 constituted by two sensors for sensing the entry of a copied paper sheet, or copy, in the finisher 30 while identifying the size of the incoming paper sheet. A reference position changing unit 25 changes a reference position for arranging the side edges of the paper sheets, depending upon the desired binding position. A selector in the form of a pawl 26 switches over the sheet transport path depending upon whether or not stapling is desired, i.e., it selects a path leading to an upper tray 29 when stapling is not desired. A staple processing section 28 has a stapler 31 for binding the paper sheets on a stacker, the bound paper sheets being driven out to a lower tray 27.

Figure 2:
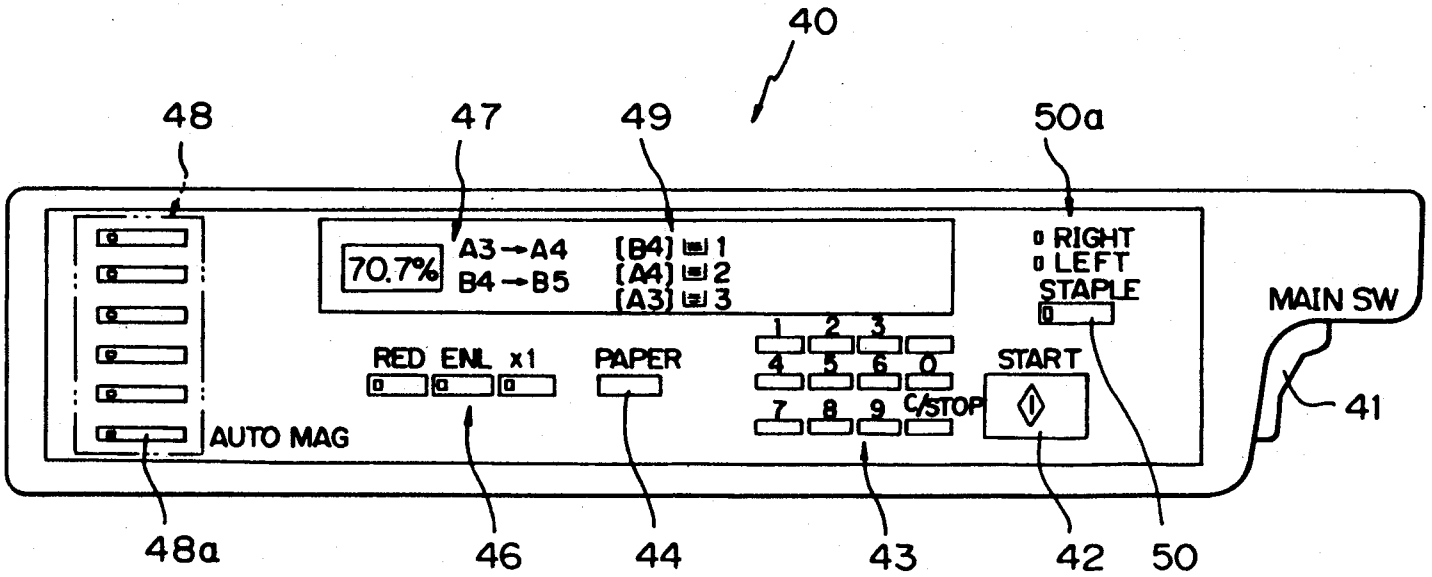
FIG. 2 is a plan view of an operation board provided on the copier of FIG. 1.

Referring to FIG. 2, the copier body 20 has an operation board 40 on which are arranged a main switch 41, a print key 42 for entering a copy start command, and numeral keys 43 accessible for entering a desired number of copies, dimensions, etc. Also arranged on the operation board 40 are a paper size key 44 for selecting the size of paper sheets to be used, a paper selection display block 49 for displaying the paper size being selected and the associated paper cassette, magnification keys 46 individually assigned to 1:1 magnification, enlargement and reduction, a magnification display block 47 for displaying a selected magnification in terms of the magnification (%) of a length while displaying the combination of document size and paper size, an automatic magnification key 48*a* included in a special function key group 48 for determining, when pressed, a magnification automatically in matching relation to the document size and paper size, a staple key 50 for commanding a particular binding position of the stapler 31, and a display section 50*a* for indicating the selected binding position.

When the main switch 41 on the operation board 40 is pressed, lamps individually associated with the various keys are turned on while a guidance or a mode being selected are indicated on the display section 40*a*. A paper size entered on the paper size key 44 appears on the paper size display block 49. A desired paper size may be entered on the key 44 by an operator. Alternatively, an arrangement may be such that, when an automatic selection mode is selected, any of the paper cassettes 2A, 2B and 2C is selected automatically according to an automatic selection mode, which will be described. In FIG. 2, the paper cassettes 2A, 2B and 2C are loaded with paper sheets PA of format B4, paper sheets PB of format A4, and paper sheets PC of format A3 respectively by way of example. Every time the key 44 is pressed, the parenthesized alphanumeric characters being illuminated in the paper size display block 49 are shifted so that four different modes including the automatic selection mode may be displayed one at a time. In the condition shown in FIG. 2, a magnification change ratio of 70.7% is appearing on the magnification display block 47 as selected by the reduction key 46*a*. One can see the mode being selection with the help of a small window 46*b* which is illuminated.

Figure 3:
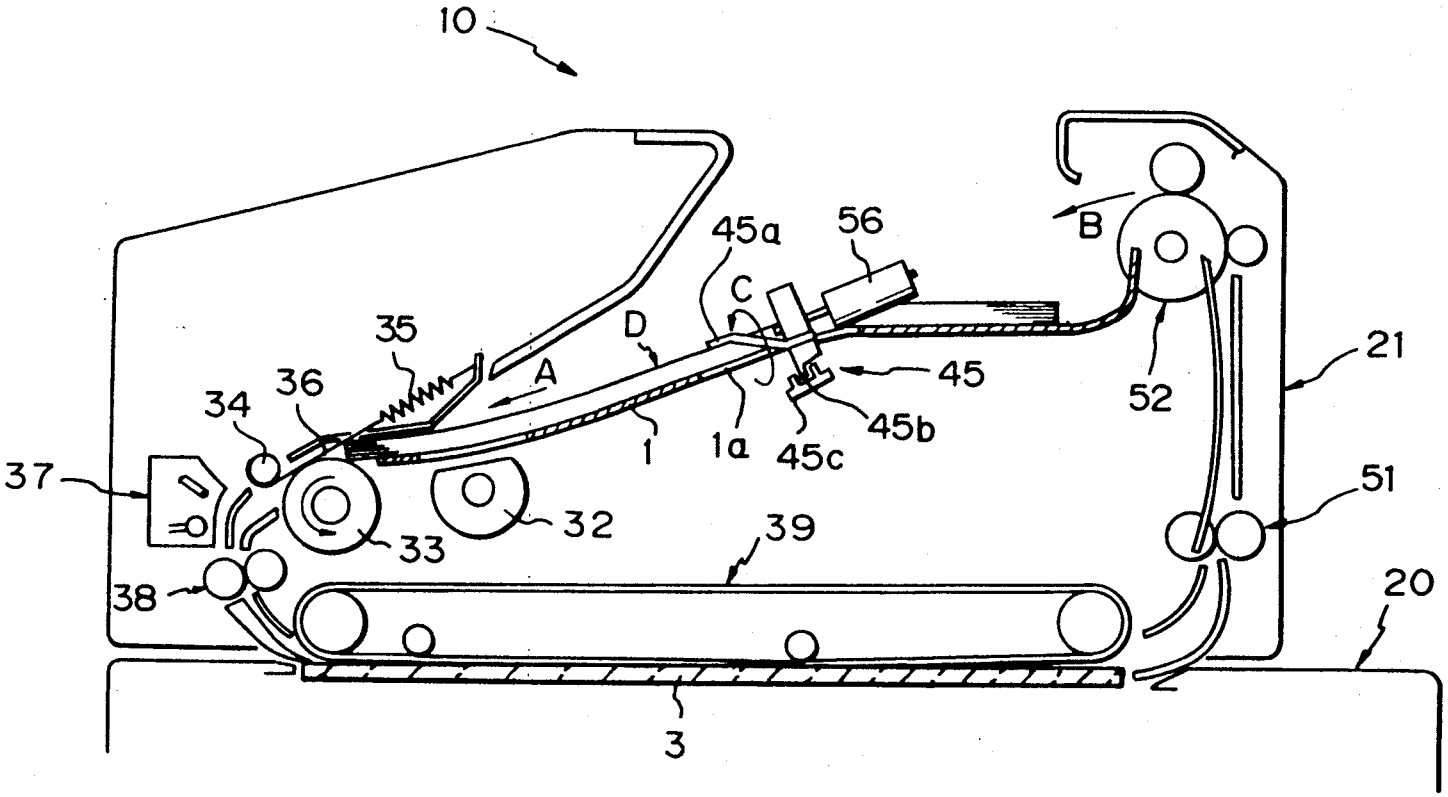
FIG. 3 shows in detail a recycling document handler associated with the copier of FIG. 1.

Referring to FIG. 3, the RDH 10 has a body 21 which is openably hinged such that it is positioned above the glass platen 3 of the copier body 20. An oscillating roller 32 has a substantially semicircular cross-section and is held in contact with the leading edge portion (left end as seen in the figure) of the lowermost document D which is laid on the document tray 1. The roller 32 oscillates to apply vibration to the document D. A feed roller 33 is located downstream of the oscillating roller 32 with respect to the intended direction of document feed, while a belt 36 is securely connected to a stationary shaft 34 at its lower end and retained by a spring 35 at its upper end. As the feed roller 33 is rotated, the lowermost document on the tray 1 is separated from the others by the belt 36 and transported in the direction A. A document sensor 37 is responsive to the size and the number of documents D which have been fed from the tray 1. The document D is transported by a transport roller 38 and a transport belt 39 onto the glass platen 3. After the imagewise exposure on the glass platen 3, the document D is returned to the document tray 1 by way of rollers 51 and 52.

The document sensor 37 may be implemented by a plurality of equally spaced reflection type photosensors. With this kind of document sensor 37, it is possible to determine the widthwise dimension of the document D on the basis of the combination of ON/OFF states of the respective sensors, to determine the lengthwise dimension of the document D by measuring the interval between the time when the sensor 37 senses the leading edge of the document D and the time when it senses the trailing edge of the same, and to determine the number of documents D moved away from the sensor 37. A last document sensor 45 is situated in a substantially intermediate portion of the document tray 1 and has a feeler **45*a* which rests on an upper side edge portion of the uppermost document D on the tray 1 by gravity. When the uppermost document D stacked on the tray 1, i.e., the last page is fed out from the tray 1, the feeler 45*a* drops in a feeler rotation hole 1*a* which is formed through the tray 1 by gravity. Then, the feeler 45*a* opens a sensing portion of a photointerrupter 45*b* of the last document sensor 45 with its screening portion 45*b*, whereby the feed of the last page is detected. After the lapse of a predetermined period of time, the feeler 45*a* is rotated upward by a cam (not shown) as indicated by an arrow C and then released from the cam to drop by gravity. At this time, all the documents D sequentially undergone imagewise exposure have already been returned to and stacked on the tray 1. Hence, the feeler 45*a* released from the cam as mentioned above rests again on the uppermost document, i.e. last page. It is to be noted that the separating and feeding section which includes the feed roller 33 and a belt 39** of the imagewise exposing section are driven by independent motors (not shown).

Figure 4:
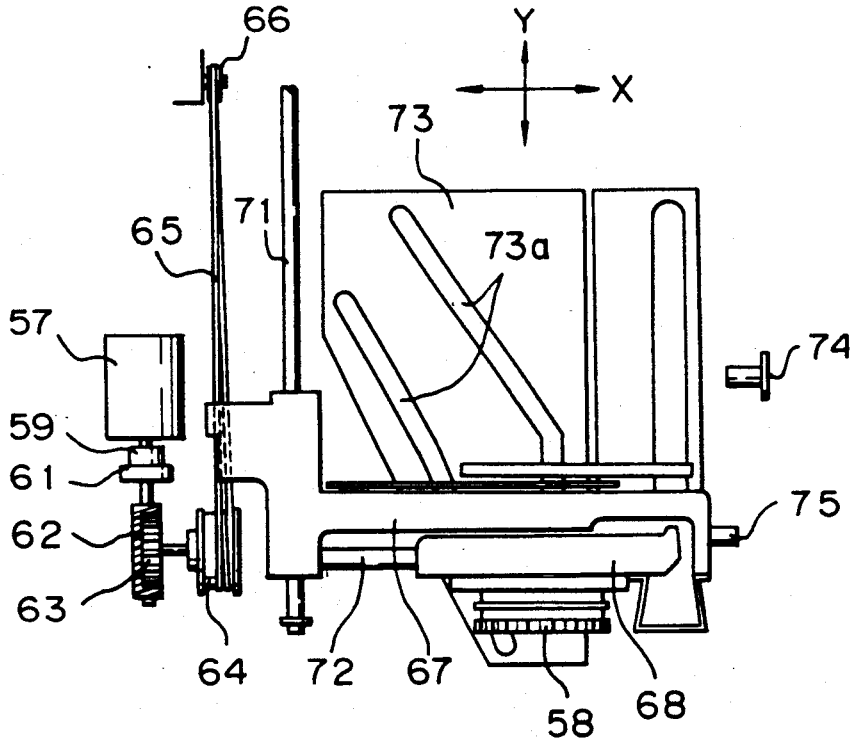
FIG. 4 is a plan view of a magnification changing mechanism of optics which is included in the copier of FIG. 1.

Referring to FIG. 4, a magnification changing mechanism associated with the optics 4 is shown. The mechanism has a lens drive motor 57 which is rotatable to move a lens 58 in either one of directions X and Y. As the lens drive motor 57 is rotated on the basis of a magnification change ratio which is entered on the magnification key 46 (FIG. 2), the rotation of the motor 57 is transmitted to a worm gear 62 by a timing pulley 59 and a timing belt 61. The timing pulley 59 is securely mounted on the output shaft of the motor 57. Then, the worm gear 62 rotates a worm wheel 63 which is held in mesh with the worm gear 62, so that a magnification changing cam pulley 64 is driven in a rotary motion. A lens drive wire 65 is passed over the cam pulley 64 and a pulley 66 which is rotatably mounted on a stationary part of the copier body 20. A bracket 67 is connected at one end to the wire 65 and is movable in the direction Y on and along a guide rod 71 which extends throughout the bracket 67. Another guide rod 72 is securely mounted on the bracket 67 to extend in the direction X as shown in FIG. 4. The guide rod 72 extends throughout a bracket 68 on which the lens 58 is mounted. The bracket 68 is engaged at its lower end with guide channels **73*a* which are formed obliquely in a cam plate 73. In this configuration, as the bracket 67 moves in the direction Y, the bracket 68 is moved in the direction X by being cammed by the guide channels 73*a*. Hence, when the lens drive motor 57 is rotated, the lens 58 is shifted in the directions X and Y to a particular position which is associated with a magnification change ratio. A lens home sensor 74 is responsive to the home position (e.g. 1:1 magnification position) of the lens 58 and cooperates with a feeler 75 which is fixedly mounted on one end of the bracket 67**.

Figure 5:
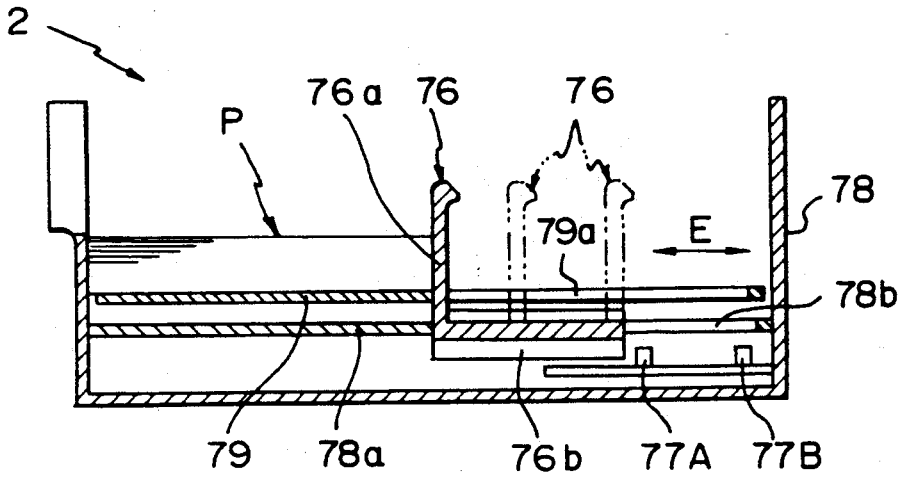
FIG. 5 is a section showing a specific construction of paper size sensing means associated with each paper cassette as shown in FIG. 1.

FIG. 5 indicates a specific construction of a size sensing means for sensing the size of paper sheets which are loaded in a paper cassette 2 (corresponding to any of the cassettes 2A to 2C shown in FIG. 1). As shown, the paper cassette 2 has a paper guide 76 for restricting the trailing end of paper sheets P in position. The paper guide 76 has its lower end received in a slot **78*b* which is formed through a support plate 78*a*, so that it may be selectively shifted to and fixed at a plurality of different positions (three positions in the example shown in FIG. 5) in a direction indicated by an arrow E. The upper end of the paper guide 78*a* terminates at a restricting portion 76*a* which protrudes upward from a slot 79*a* that is formed through a bottom plate 79. The bottom plate 79 is sequentially raised by an elevating mechanism (not shown) as the number of paper sheets P stacked in a cassette case 78 of the paper cassette 2 decreases. The paper guide 76 has a screening portion 76*b* on its underside, while two transmission type photosensors or similar sensors 77A and 77B are positioned at spaced locations in the direction E. The sensors 77A and 77B are each responsive to the screening portion 76*b* of the paper guide 76. It is possible, therefore, to determine the size of paper sheets P present in the paper cassette 2 on the basis of the combination of output levels of the sensors 77A and 77B**.

Specifically, with the paper size sensing means implemented by two sensors as shown in FIG. 5, it is possible to identify formats A4, B4 and A3 in distinction from each other by the combinations of output levels of the sensors 77A and 77B which are tabulated below.

| SENSOR 77A | SENSOR 77B | PAPER SIZE |
|---|---|---|
| L | L | A 4 |
| H | L | B 4 |
| H | H | A 3 |

When the paper guide 76 assumes a position indicated by a solid line in FIG. 5 which is associated with a comparatively small paper size, i.e., format A4, none of the sensors 77A and 77B and 77B senses the screening portion **76*b* of the paper guide 76 and, therefore, their output levels are low or "L". When the paper guide 76 is shifted to a position indicated by a phantom line in the figure and which is associated with an medium paper size (B4 in the illustrative embodiment), only the output level of the sensor 77A becomes high or "H" because the sensor 77A alone senses the screening portion 76*b*. For format A3, the output levels of the senors 77A and 77B** become "H".

Figure 6:
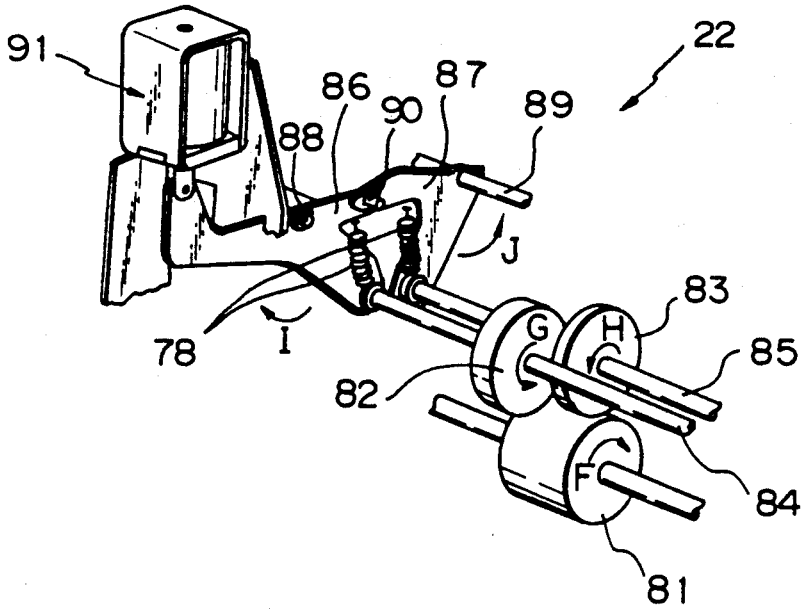
FIGS. 6 and 7 indicate the construction and operation of a switching unit shown in FIG. 1.

Referring to FIG. 6, the switching unit 22 of FIG. 1 is shown in an enlarged perspective view. As shown, the switching unit 22 includes a main reversal roller 81, and a front roller 82 and a rear roller 83 which are pressed against the roller 81. The main reversal roller 81 is rotatable as indicated by an arrow F, while the front and rear rollers 82 and 83 are rotatable as indicated by arrows G and H, respectively. The rollers 82 and 83 are mounted respectively on shafts 84 and 85 which in turn are rotatably mounted respectively on roller drive arms 86 and 87. The roller drive arms 86 and 87 are rotatably supported at their substantially intermediate portions by shafts 88 and 89, respectively. Springs 78 are individually anchored to one end of the arms 86 and 87, whereby the arms 86 and 87 tend to rotate respectively in directions opposite to directions I and J shown in FIG. 6. The arms 86 and 87 are rotatably joined together by a pin 90 at their overlapping ends. The other end of the arm 86 is rotatably connected to a plunger of a solenoid 91. When the solenoid 91 is turned on, the arms 86 and 87 are rotated respectively in the directions I and J. As a result, as shown in FIG. 7, the front and rear rollers 82 and 83 are shifted from their positions indicated by solid lines to the positions indicated by phantom lines away from each other, whereby a reversal transport path 92 is unblocked.

Figure 7:
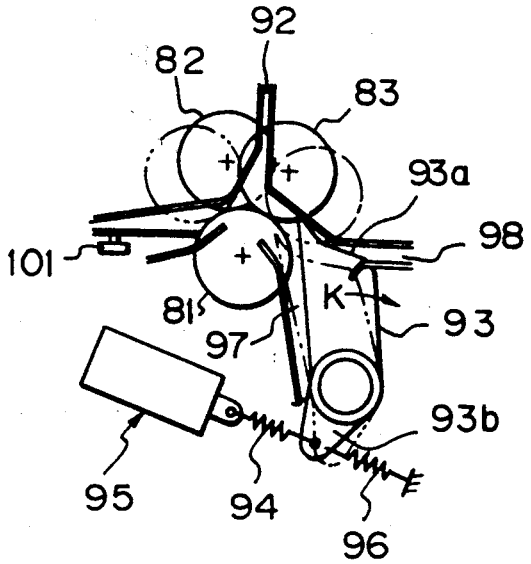

In FIG. 7, a pawl 93 has an arcuate guide surface **93*a* at its upper end and a lever portion 93*b* at its lower end. A spring 94 is anchored at one end to the lever portion 93*b* and at the other end to the plunger of a solenoid 95. A return spring 96 is anchored at one end to the lever portion 93*b* at the opposite side of the spring 94 with respect to the lever portion 93*b*. When the solenoid 95 is not turned on, the pawl 93 is held in a position indicated by a phantom line in FIG. 7. On the turn-on of the solenoid 95, the pawl 93 is rotated as indicated by an arrow K in FIG. 7 to a position indicated by a solid line, whereby a transport path 97 leading to the two-side unit 23 (FIG. 1) is unblocked. When the solenoid 95 is turned off, the pawl 93 returns to the phantom line position under the action of the return spring 96 so that a transport path 98 leading to the finisher 30** is unblocked.

Depending upon a command which may be entered on the operation board 40 (FIG. 2), the solenoids 95 and 91 are operated in any of four different modes, as enumerated below.

(1) A mode for fixing a toner image on a paper sheet and then driving it to the finisher 30: Both the solenoids 91 and 95 are turned off to maintain the front and rear rollers 82 and 83 in the solid line positions shown in FIG. 7 and to maintain the pawl 93 in the phantom line position. In this condition, a paper sheet is directly transported to the finisher 30 via the transport path 98.

(2) A mode for fixing a toner image on a paper sheet, then turning it over, and then transporting it to the finisher 30: The solenoid 91 is turned on to shift the front and rear rollers 82 and 83 away from each other, as indicated by phantom lines in FIG. 7. The solenoid 95 is not turned on to maintain the pawl 93 in the phantom line position. At this time, a paper sheet is once driven upward into the reversal transport path 92 the leading edge ahead and then moved downward the trailing edge ahead, so that the paper sheet is guided by the arcuate guide surface **93*a* of the pawl 93 toward the finisher 30 along the transport path 98**.

(3) A mode for fixing a toner image on a paper sheet and then driving it toward the two-side unit 23: The solenoid 91 is maintained turned off while the solenoid 95 is turned on. In this condition, the rollers 82 and 83 are shifted toward each other as indicated by solid lines in FIG. 7, while the pawl 93 is caused into an upright position as indicated by a solid line in FIG. 7. A paper sheet, therefore, is driven along the transport path 97 to reach the both-side unit 23.

(4) A mode for fixing a toner image on a paper sheet, then turning it over, and then transporting it toward the two-side unit 23: Both the solenoids 91 and 95 are turned on to move the rollers 82 and 83 away from each other and to move the pawl 93 to the upright position. In this configuration, a paper sheet is once fed into the reversal transport path 92, the leading edge ahead as in the mode (2) and then lowered the trailing edge ahead. At this time, the paper sheet is guided to the left edge of the pawl 93 to enter the transport path 97 which terminates at the two-side unit 23.

As shown in FIG. 7, a jam sensor 101 is responsive to a paper jam in the fixing station. The output of the jam sensor 101 is also used to determine the timings for operating the solenoids 91 and 95 as stated above.

The construction and operation of the finisher 30 will be described in detail with reference to FIGS. 8 to 10 as well as to FIG. 1.

A paper sheet PE which has undergone the previously discussed copying procedure, or copy, is driven into the finisher 30 by way of the transport path of the copier body 20 shown in FIG. 1. In the finisher 30, a roller 105 is driven by a main motor (not shown) to drive the incoming copied paper sheet PE by way of a position where the inlet sensor 24 is located. The inlet sensor 24 is used to sense the entry of the copy PE and the size thereof at the same time by a procedure which will be described in detail later. The copy PE moved away from the inlet sensor 24 is fed to a belt transport portion 106 which is included in the reference position changing unit 25 and rotated as indicated by an arrow in the figure.

Figure 8:
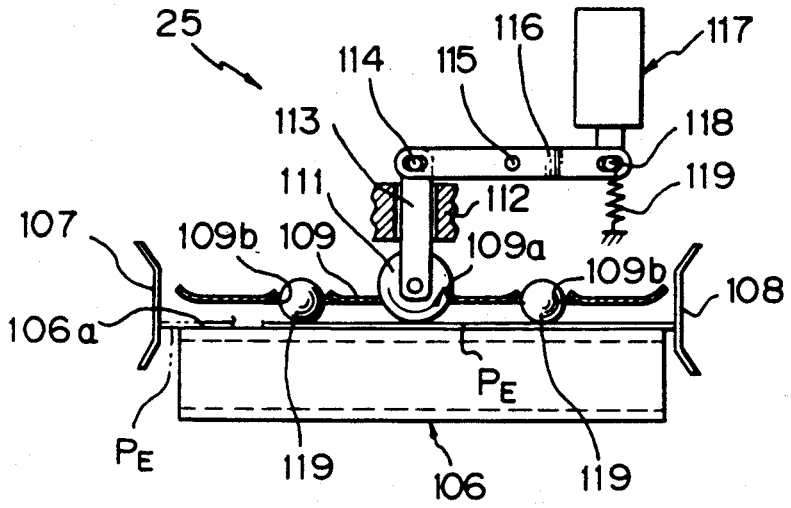
FIG. 8 is a fragmentary section of a reference position changing unit shown in FIG. 1.

As shown in FIG. 8, in the reference position changing unit 25, the belt transport portion 106 is interposed between a right and a left reference wall 108 and 107, respectively. A guide plate 109 is disposed above the belt transport portion 106 and in parallel with the upper surface **106*a* of the belt transport portion 106. The guide plate 109 is provided with an opening 109*a* at substantially the intermediate portion thereof, while a reversible reference changing roller 111 is movable into and out of the opening 109*a*. Specifically, the reference changing roller 111 is rotatably supported by a support lever 113 which is allowed to move in the up-and-down direction only by an elevation guide 112. A pin 114 is studded on an upper part of the support lever 113 and received in a slot which is formed through one end of a rotatable lever 116 that is supported by a pin 115. The other end of the rotatable lever 116 is engaged with the plunger of a solenoid 117 by a pin 118**.

While the solenoid 117 is not turned on, its plunger is pulled down by a tension spring 119 which is anchored to one end of the rotatable lever 116. In this condition, the lever 116 is rotated clockwise about the pin 115 as viewed in FIG. 8. The reference changing roller 111, therefore, is raised through the support lever 113 away from the belt upper surface **106*a* of the belt transport portion 106. When the solenoid 117 is turned on, the rotatable lever 116 is moved counterclockwise as viewed in FIG. 8. This causes the reference changing roller 111 to make contact with the belt upper surface 106*a* while exerting a pressure on the latter which does not disturb the transport of the copy PE by the belt transport portion 106. The guide plate 109 is provided with a plurality of equally spaced ball sockets 109***a* around the opening 109*a*, while balls 119 are individudally rollably received in the ball sockets 109*a*. The balls 119 serve to guide the upper surface of the paper sheet P which is driven by the belt transport portion 106 into the reference position changing unit 25. The reference changing roller 111 is driven by a main motor (not shown) adapted to drive the transport roller 105 (FIG. 1).

For effecting stapler processing with the finisher 30, the pawl 26 is switched over to the solid line position shown in FIG. 1 so that a copy may be transported to the staple processing section 28 while being turned over. The staple processing section 28 is made up of a stacker portion 120 for stacking copied paper sheets, or copies, thereon, a shift roller unit 130 for shifting the copies PE to one side in conformity to a desired stapling position, and a stapler unit 150 for binding the copies PE. A sensor 122 is located in the vicinity of the end of a transport path 121 along which the copies PE are transported to the stacker portion 120.

Figure 9:
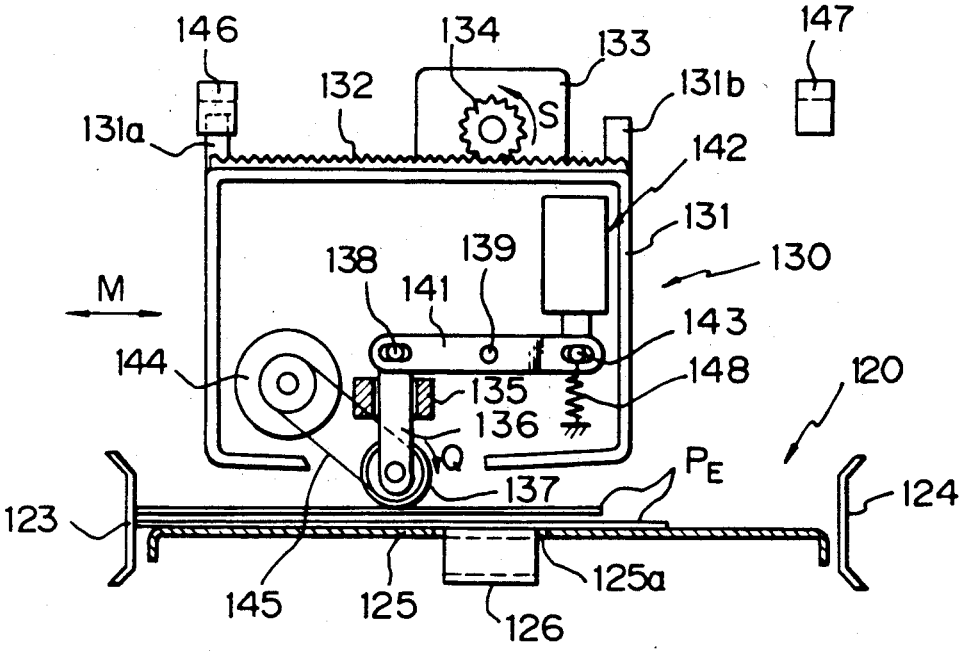
FIGS. 9 and 10 are sections showing a stacker section and a shift roller unit of FIG. 1 in a left bind position and a right bind position, respectively.
Figure 10:
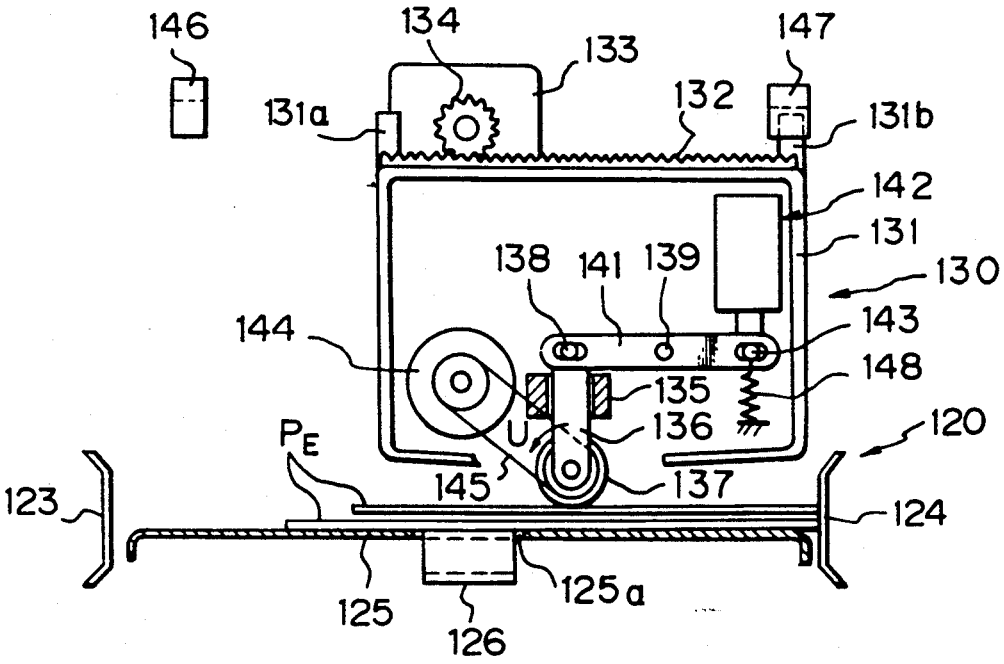

As shown in FIGS. 9 and 10, the stacker portion 120 has a right reference wall 124, a left reference wall 123, and a stacker 125 securely mounted between the reference walls 123 and 124 and implemented by a plate the opposite ends of which are bent downward. The stacker 125 is provided with a slot 125*a* which extends in the intended direction of transport (right-and-left direction in FIG. 1) in a substantially intermediate portion of the stacker 125. The slot 125*a* allows a transport belt 126 to slightly protrude upward from the upper end of the stacker 125, as described in detail later. The shift roller unti 130 is disposed above the stacker 125 and engaged with a guide member (not shown) to be movable in a direction indicated by an arrow M in FIG. 9. A unit case 131 accommodates the entire shift roller unit 130 and is provided with a rack 132 on its top. The rack 132 extends in a direction perpendicular to the intended direction of paper P transport (right-and-left direction in the figure). A pinion 134 is mounted on the output shaft of a reversible motor 133 and held in mesh with the rack 132. In the unit case 131, a support lever 136 is allowed to move in the up-and-down direction only by an elevation guide 135. A shift roller 137 is rotatably supported by the lower end of the support lever 136. A pin 138 is studded on an upper part of the support lever 136 and received in a slot which is formed through one end of a rotatable lever 141. This lever 141 is rotatably supported by a pin 139 at its intermediate portion. The other end of the rotatable lever 141 is engaged with the plunger of a solenoid 142 by a pin 143.

When the solenoid 142 is not turned on, its plunger is pulled down by a tension spring 148 which is anchored to one end of the rotatable lever 141. In this condition, the lever 141 is rotated clockwise as viewed in FIG. 9 so that the lever 141 is raised by the support lever 136 away from the top of the stacker 125 (or the upper surface of a paper sheet when the latter is present). When the solenoid 142 is turned on, the lever 141 is rotated counterclockwise to cause the shift roller 137 to make contact with the top of the stacker 125 with a predetermined force. As a reversible motor 144 is rotated, the shift roller 137 is rotated in a reversible direction by a timing belt 145 which is passed over pulleys.

Positioning sensors 146 and 147 implemented by transmission type photosensors, for example, are fixed in place. Projections 131*a* and 131*b* extend upward from the upper opposite ends of the unit case 131. When any of he projections 131*a* and 131*b* blocks the optical path of the associated positioning sensor 146 or 147, the movement of the shift roller unit 130 is stopped. The positioning sensors 146 and 147 are located such that when a paper sheet of the minimum size usable with the copier body 20 (FIG. 1) arrives at the stacker 125, the shift roller 137 is capable of making contact with that paper sheet without fail. As shown in FIG. 1, the transport belt 126 is provided with a projection 126*a* in a part of its periphery so as to further enhance positive discharge of the paper PE from the belt 126 to the lower tray 27 as the belt 126 is rotated as indicated by the arrow.

Figure 11:
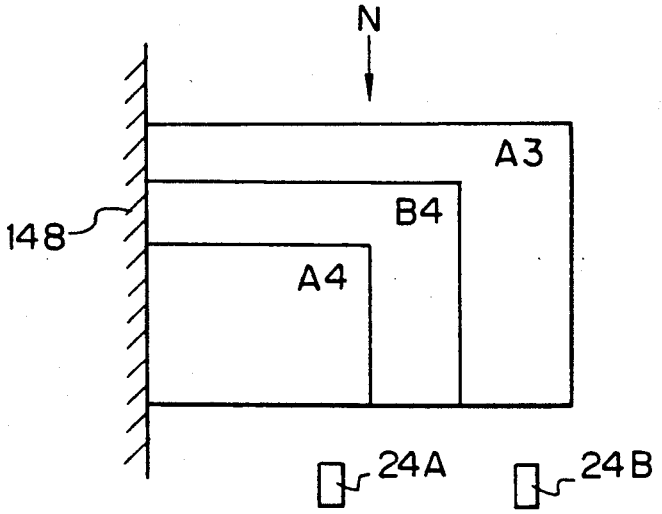
FIG. 11 shows a specific construction of an inlet sensor shown in FIG. 1.

FIG. 11 is a sketch showing a specific implementation for identifying the size of a paper sheet on the basis of the output of the inlet sensor 24. As shown, the inlet sensor 24 is constituted by two sensors 24A and 24B, for example. The sensor 24A is so located as to be responsive to all the paper sheets of formats A3 to A4 (inclusive of paper sheet of format B5 and smaller formats when such paper sheets are used) which are transported sideways with their one side edge being guided by a transport guide 148, while the senor 24B is so located as to be responsive to paper sheets of format A3 only. The size of a paper sheet is determined in response to the outputs of the sensors 24A and 24B which may appear in the following combinations.

| | | SENSOR 24B | |
|---|---|---|---|
| | | H | L |
| SENSOR 24A | H | A 3 | A 4, B 4 |
| | L | — | — |

In the above table, the high level or "H" and the low level or "L" are representative of "present" and "absent", respectively. When the output level of the sensor 24A is "H" and that of the sensor 24B is "L", formats A4 and B4 are distinguished from each other on the basis of the period of time needed for the paper sheet to move away from the sensor (i.e. the duration of "H").

Assume that two consecutive copies are fed one after another into the finisher 30, and that a command is entered for binding them together at their left edge. Then, the inlet sensor 24 senses the first paper sheet by the above-mentioned principle so as to identify its format. The paper sheet P having moved away from the inlet sensor 24 reaches the belt 106*a* of the belt transport portion 106. In this instance, since the solenoid 117 shown in FIG. 8 is in an OFF state, the reference changing roller 111 is held in the raised position where it is spaced apart from the upper surface of the belt 106*a*. Hence, the paper sheet PE is transported with its upper surface guided by the balls 119. The paper sheet PE is transported to the belt transport portion 106 with its left edge constantly moving along the left reference wall 107, as indicated by a phantom line in FIG. 8.

If the staple mode has been selected, the paper sheet PE is transported while being turned over by the pawl 26 (FIG. 1). As soon as the sensor 122 senses the leading edge of the paper sheet PE, the reversible motor 144 of the shift roller unit 130 shown in FIG. 9 is rotated. Then, reference changing roller 111 remaining in its elevated position due to the OFF state of the solenoid 142 is rotated as indicated by an arrow Q, so that the paper sheet PE slides on and along the stacker 125 of FIG. 9 until its leading edge contacts an abutment 150*a* of the stapler unit 150 (FIG. 1). Then, the solenoid 142 shown in FIG. 9 is operated (turned on) to lower the shift roller 13 rotating in the direction Q into pressing contact with the paper sheet PE (two paper sheets of different sizes being shown in FIG. 9 by way of example), whereby the paper sheet PE is fully regulated in position.

In general, despite that a paper sheet is transported in the reference position changing unit 25 with its left edge being guided along the reference position 107, it is apt to slightly skew or otherwise deviate from its predetermined position due to the substantial length of the transport path which terminates at the stacker 125 in the finisher 30. In light of this, the shift roller 137 is used to more neatly regulate the positions of the two paper sheets P, as stated above.

As the second paper sheet is introduced in the finisher 30, the sensor 24 again identifies the size of the paper sheet. Then, the paper sheet is transported in the reference position changing unit 25 along the left reference position 107 (FIG. 8), while being turned over by the pawl 26. On reaching the stacker portion 120, the second paper sheet is laid on the first paper sheet which has been positioned on the stacker 125. The second paper sheet, like the first paper sheet, is brought to a stop with its leading edge abutting against the abutment 150*a* (FIG. 1) of the stapler unit 150 and its left edge being regulated by the reference changing roller 111 with respect to the reference wall 123. After the stapler 31 shown in FIG. 1 has been actuated to bind the two paper sheets together, the transport belt 126 is driven as indicated by the arrow. As a result, the paper sheets PE stapled together at their left edge are discharged to the lower tray 27.

Assume that the two paper sheets are to be stapled at their right edge. As the first paper sheet or copy PE arrives at the finisher 30, the inlet sensor 24 identifies the size of the paper sheet PE. In response to the output of the inlet sensor 24 representative of the leading edge of the paper sheet PE (or in response to any other suitable kind of signal), the reversible motor 133 shown in FIG. 9 is rotated in a direction indicated by an arrow S so as to move the entire shift roller unit 130 to the right. As soon as the positioning sensor 147 senses the projection 131*b* provided on the unit case 131, the reversible motor 133 is deenergized to stop the movement of the shift roller unit 130 at the position shown in FIG. 10. In this instance, since the solenoid 142 is in an OFF state, the shift roller 137 is held in its raised or retracted position. If the shift roller unit 130 has already been held in the position shown in FIG. 10 (as is the case with a control in which the unit 130 is not automatically returned to the FIG. 9 position), it it not necessary to rotate the motor 133.

When a predetermined period of time expires after the inlet sensor 24 has sensed the paper sheet PE, i.e., when the paper sheet PE is brought by the belt transport portion 106 to a position immediately below the reference changing position 111 which is in the raised position, the solenoid 117 is turned on to lower the roller 111 rotating in the direction indicated by the arrow onto the paper sheet PE. Consequently, as indicated by a solid line in FIG. 8, the paper sheet PE is transported toward the pawl 26 (FIG. 1) with its right edge abutting against the right reference wall 108.

When the sensor 122 senses the leading edge of the paper sheet PE which is being turned over by the pawl 26, the reversible motor 144 shown in FIG. 10 is rotated in the opposite direction to the direction associated with the right edge stapling. Then, the shift roller 137 held in the raised position due to the OFF state of the solenoid 142 is rotated as indicated by an arrow U. Hence, the paper sheet PE slides on and along the stacker 125 until its leading edge abuts against the abutment 150*a* of the stapler unit 150. Thereafter, the solenoid 142 is operated to lower the shift roller 137 which is rotating in the direction U. On contact with the paper sheet PE, the shift roller 137 brings the right edge of the paper sheet PE into contact with the right reference wall 124 (paper sheets of different sizes being shown in FIG. 10 for convenience), whereby the paper sheet PE is fully positioned. It is to be noted that the solenoids 117 and 142 are operated at different timings (ON time) depending on the paper size which the inlet sensor 24 senses, allowing one edge of a paper sheet to be arraned in matching relation to the paper size.

When the second paper sheet or copy PE arrives at the finisher 30, the inlet sensor 24 identifies its size. The second copy PE, like the first copy, is sequentially transported with its right edge being held in abutment against the reference wall 108 (FIG. 8) by the reference changing roller 111. As the copy PE arrives at the stacker portion 120 while being turned over by the pawl 26, it is laid on the first copy PE on the stacker 125. The second copy PE, therefore, is brought to a halt with its leading edge abutting against the abutment 150*a* (FIG. 1) of the stapler unit 150 and its right edge abutting against the reference wall 124.

Finally, the stapler 31 shown in FIG. 1 is operated to bind the two copies PE together. The transport belt 126 is then rotated to discharge the stapled copies onto the lower tray 27.

When the copies PE to be bound at their left edge have a size different from the above-stated size, the various sections forming the finisher 30 are operated in the same manner as described above except for the shift of a particular edge of the copies PE which depends on the paper size. Specifically, when the copies PE are to be stapled at their left edge, the right edge of the copies PE will be deviated as shown in FIG. 9; when they are to be stapled at their right edge, the left edge will be deviated as shown in FIG. 10.

Figure 12:
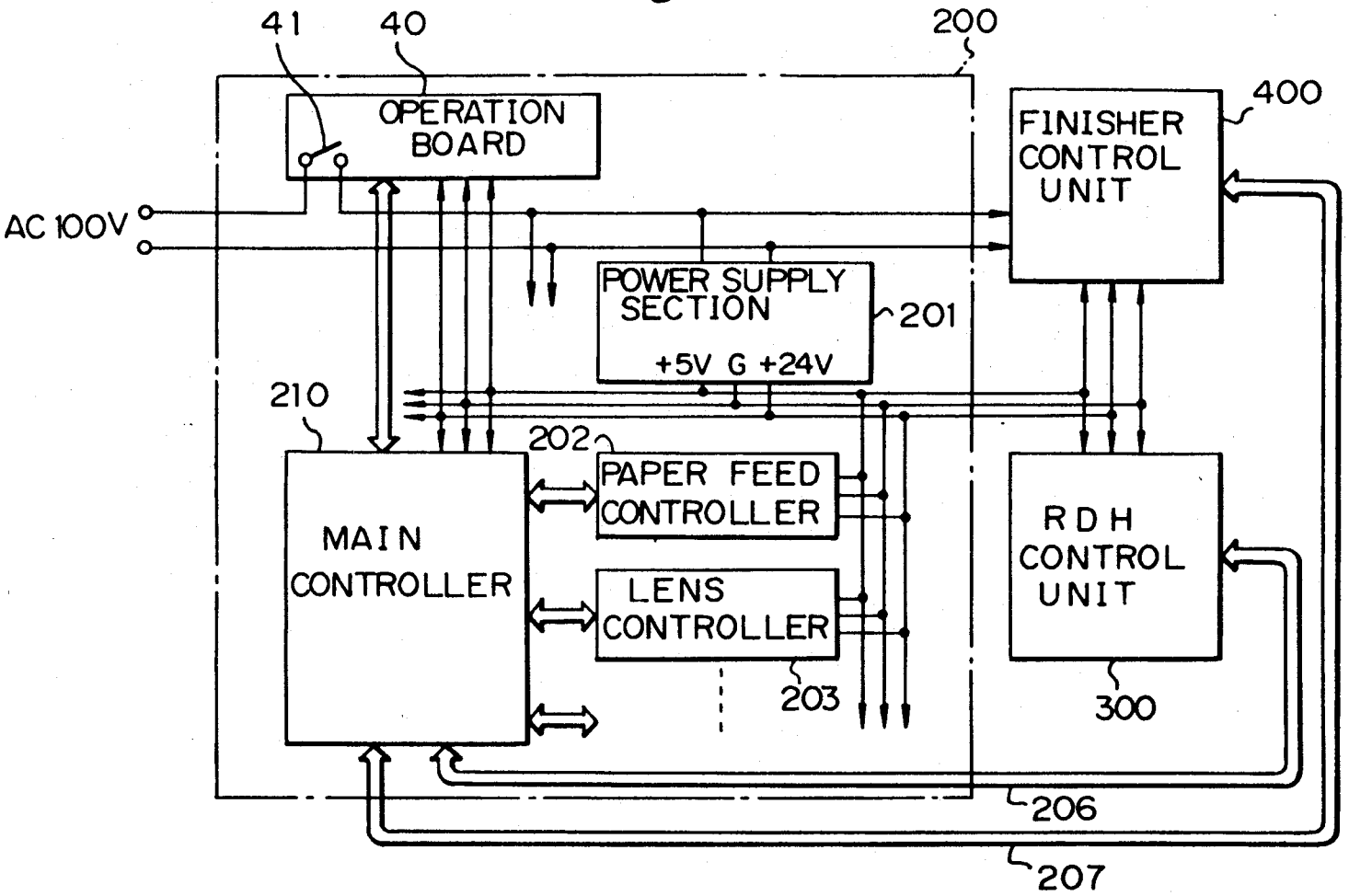
FIG. 12 is a schematic block diagram showing a control section associated with the copier of the present invention.

Referring to FIG. 12, a control section installed in the above-described copier is shown in a block diagram. The copier shown in FIG. 1 is made up of the RDH 10, copier body 20, and finisher 30 and, therefore, the control section of FIG. 12 is also made up of a copier body control unit 200, an RDH control unit 300, and a finisher control unit 400. The copier body control unit 200 has the operation board 40 (FIG. 2) which includes the main switch 41 and enters various copy modes and displays various kinds of information, a power supply section 201 for feeding DC voltages to various components of the copier, a plurality of unit controllers such as a paper feed controller 202 for controlling the three paper cassettes 2A to 2C, a lens controller 203 for controlling the motor 57 adapted to drive the lens 58 (FIG. 4), and a main controller 210 for supervising such unit controllers. The RDH control unit 300 and finisher control unit 400 are connected to the main controller 210 by control signal interface lines 206 and 207, respectively.

Figures 13, 13A:
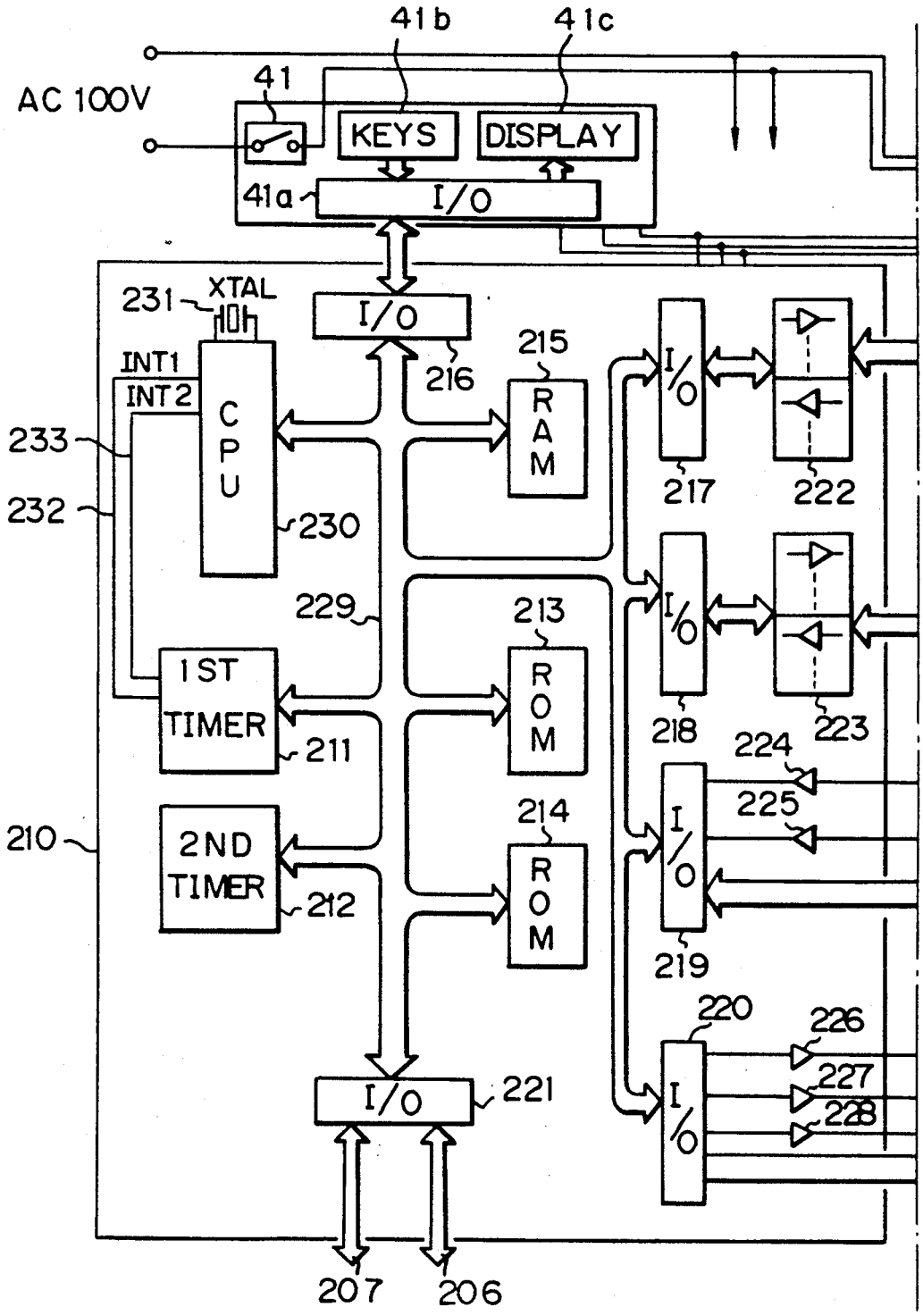
FIG. 13 is a schematic block diagram representative of a copier body control unit included in the control section of FIG. 12.
Figure 13B:
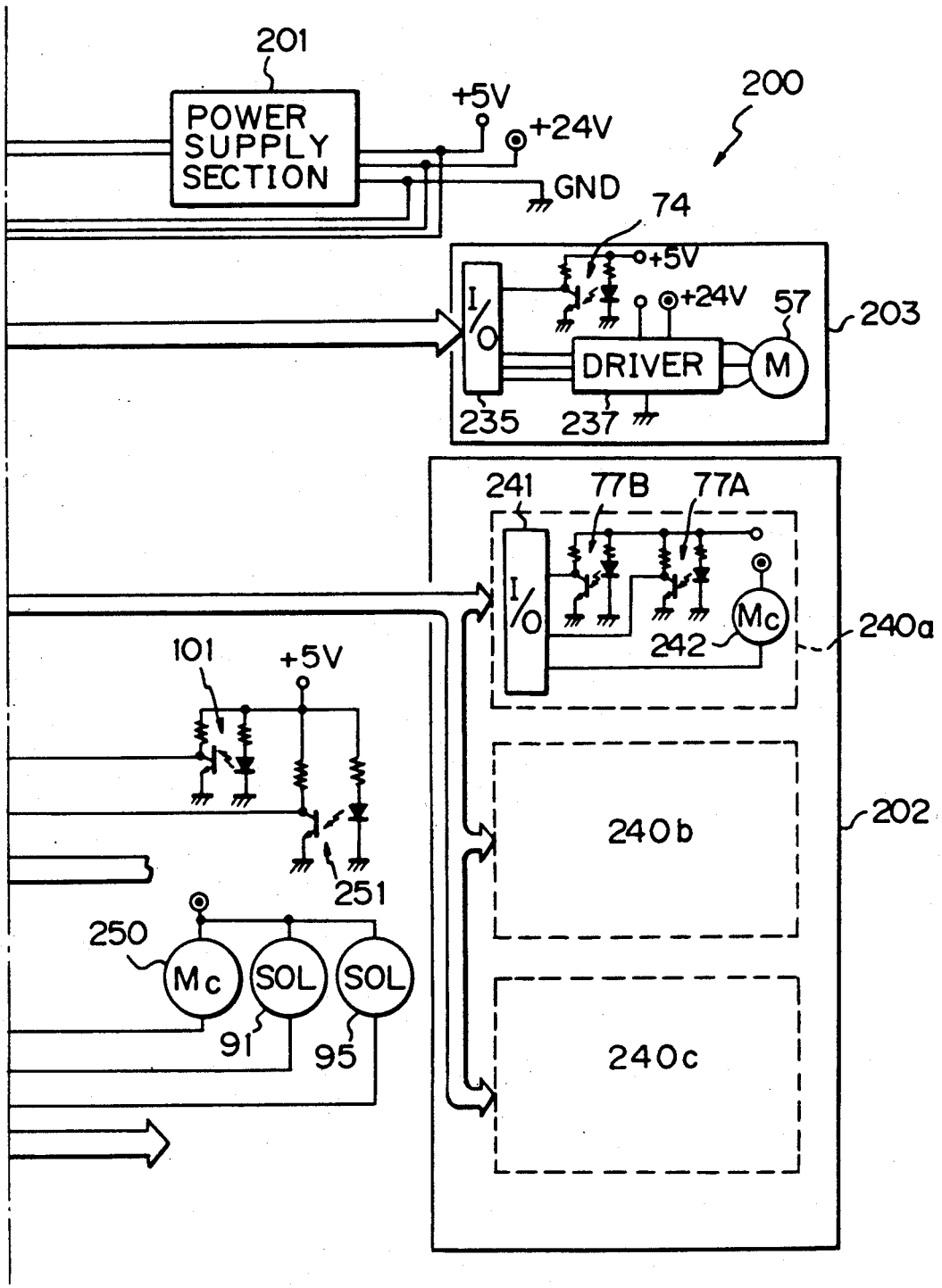

FIG. 13 shows the copier control unit 200 in detail. In the figure, the main controller 210 includes a first and a second timer 211 and 212, respectively, which serve a plurality of timer and counter functions and ROMs 213 and 214 which are loaded with control programs, a RAM 215 for temporarily storing control data, input-/output (I/O) interfaces 216 to 221 for interfacing the main controller 210 to the unit controllers, RHD control unit 300 and finisher control unit 400, driver buffer arrays 222 and 223, drivers 224 and 225, buffers 226 to 228, a bus 229 for connecting them together, a central processing unit (CPU) 230 for controlling the above-mentioned elements, and a reference oscillator 231 for oscillating a reference clock. The timer 211 has a 1 kilohertz output signal line 232 and a 100 hertz output signal line 233 which are used used for 1 millisecond interrupt control and 10 millisecond interrupt control, respectively. The operation board 40 includes an I/O interface **41*a* for interfacing the operation board 40 to the main controller 210, a key section 41*b*, a display section 41*c*, and the main switch (power switch) 41**.

The lens controller 203 includes an I/O interface 235 for interfacing the controller 203 to the main controller 210, the lens home sensor 74 (see FIG. 4) for defining a reference position for the lens drive, and a driver 237 for driving the lens drive motor 57. The paper feed controller 202 is constituted by three similar control circuits **240*a*, 240*b* and 240*c* each having an I/O interface 241 which controls the interchange of data with the main controller 210, the size sensors 77A and 77B shown in FIG. 5, and a paper feed clutch 242. Also shown in FIG. 13 are the previously stated solenoids 91 and 95, a two-side paper feed clutch 250, the jam sensor 101 shown in FIG. 7, and a two-side empty sensor 251 for determining that the two-side unit 23 of FIG. 1** is empty.

Figure 14:
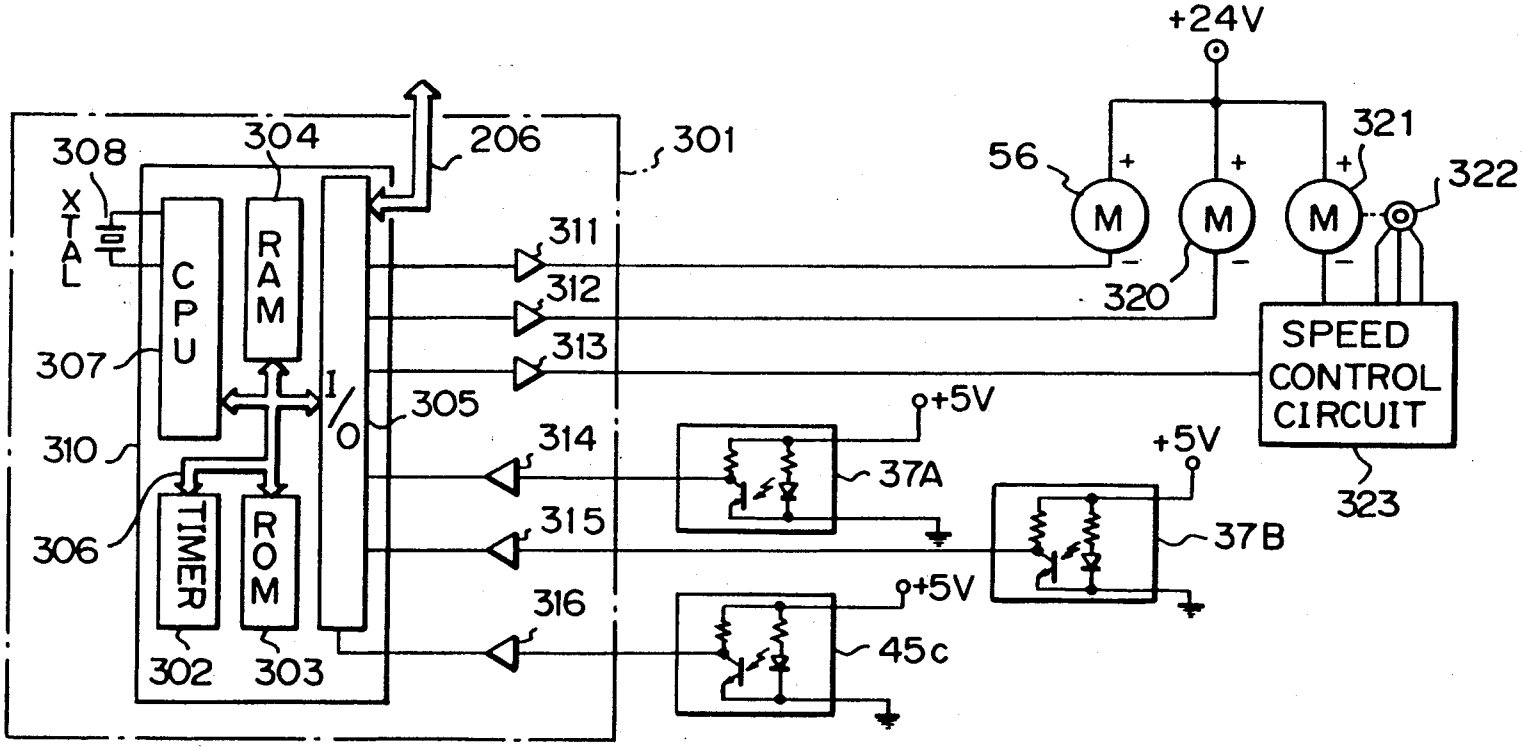
FIG. 14 is a schematic block diagram showing an RDH control unit of FIG. 12.

FIG. 14 shows the RDH control unit 300 in detail. As shown, the RDH control unit 300 has a main controller 301 which includes a 1-chip microcomputer 310. The microcomputer 310 in turn includes a timer 302, a ROM 303 for storing control programs therein, a RAM 304 for temporarily storing control data, an input and output control section 305, a bus 306 interconnecting them together, a CPU 307 for controlling the above-mentioned blocks, and a reference oscillator 308 for generating a control clock. The RDH control unit 300 further has output drivers 311 to 313, input buffers 314 to 316, and a signal control interface line 206 connecting to the copier body control unit 200. Also shown in FIG. 14 are the feeler set motor 56 associated with the last document sensor 45 (FIG. 3), a motor 320 for transporting documents, a motor 321 for driving the transport belt, a rotation sensor 322 rotatable in synchronism with the motor 321, and a motor speed control circuit 323 for controlling the rotation speed of the motor 321 in response to an output of the rotation sensor 322.

Two reflection type photosensors 37A and 37B constitute the document sensor 37 shown in FIG. 3. Arranged in the same manner as the sensors 24A and 24B of FIG. 11, the sensors 37A and 37B are capable of distinguishing three different document sizes from each other. Specifically, when the document has the maximum size (A3) usable with the copier, both the sensors 37A and 37B are turned on. When the document has either the minimum size (A4) or the medium size (B4), only the sensor 37A is turned on; formats A4 and B5 are distinguished on the basis of the duration of the ON state of the sensor 37A. Labeled **45*c* is the photointerrupter of the last document sensor 45 shown in FIG. 3**.

Figures 15, 15A:
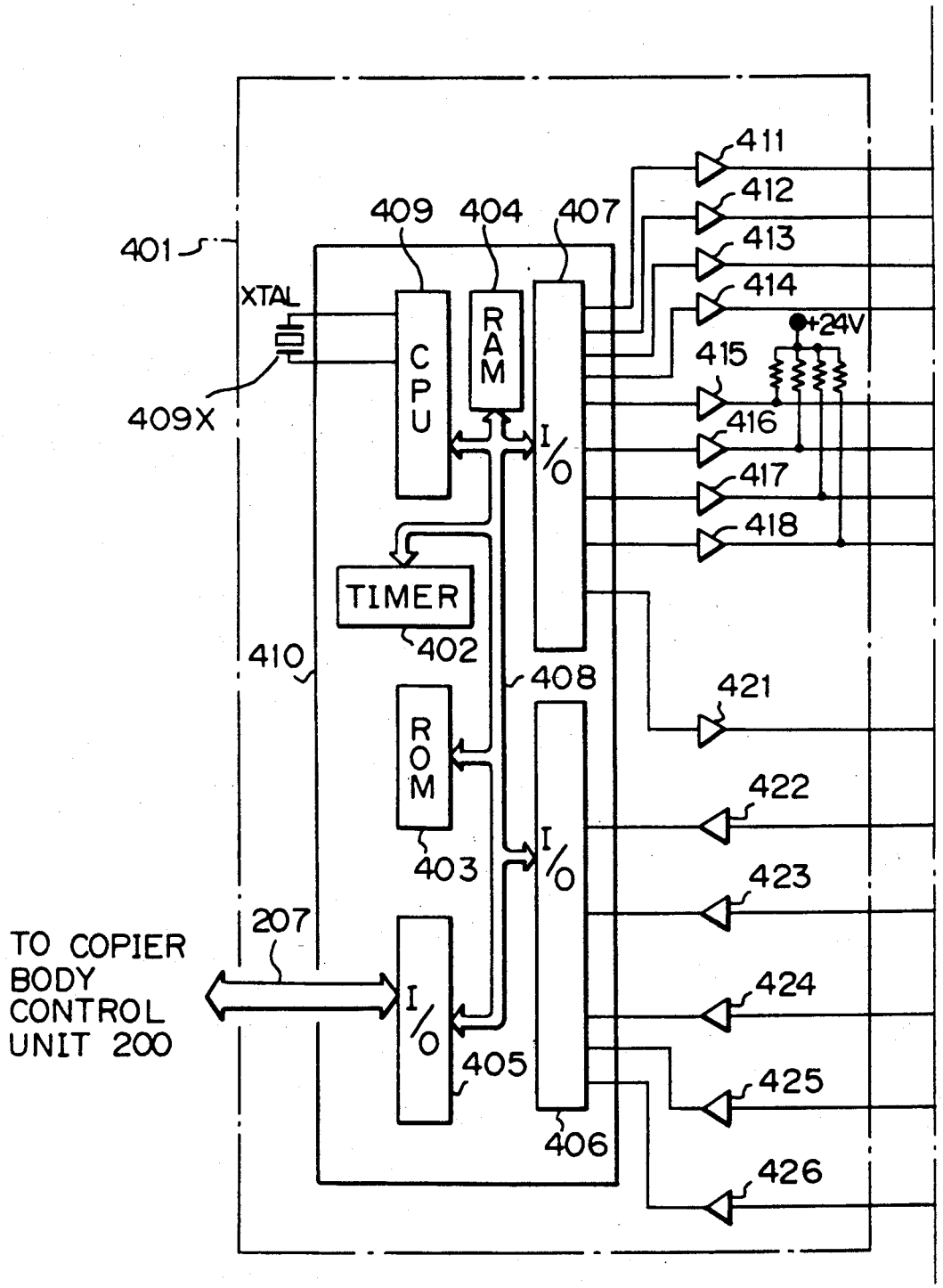
FIG. 15 is a schematic block diagram showing a finisher control unit of FIG. 12.
Figure 15B:
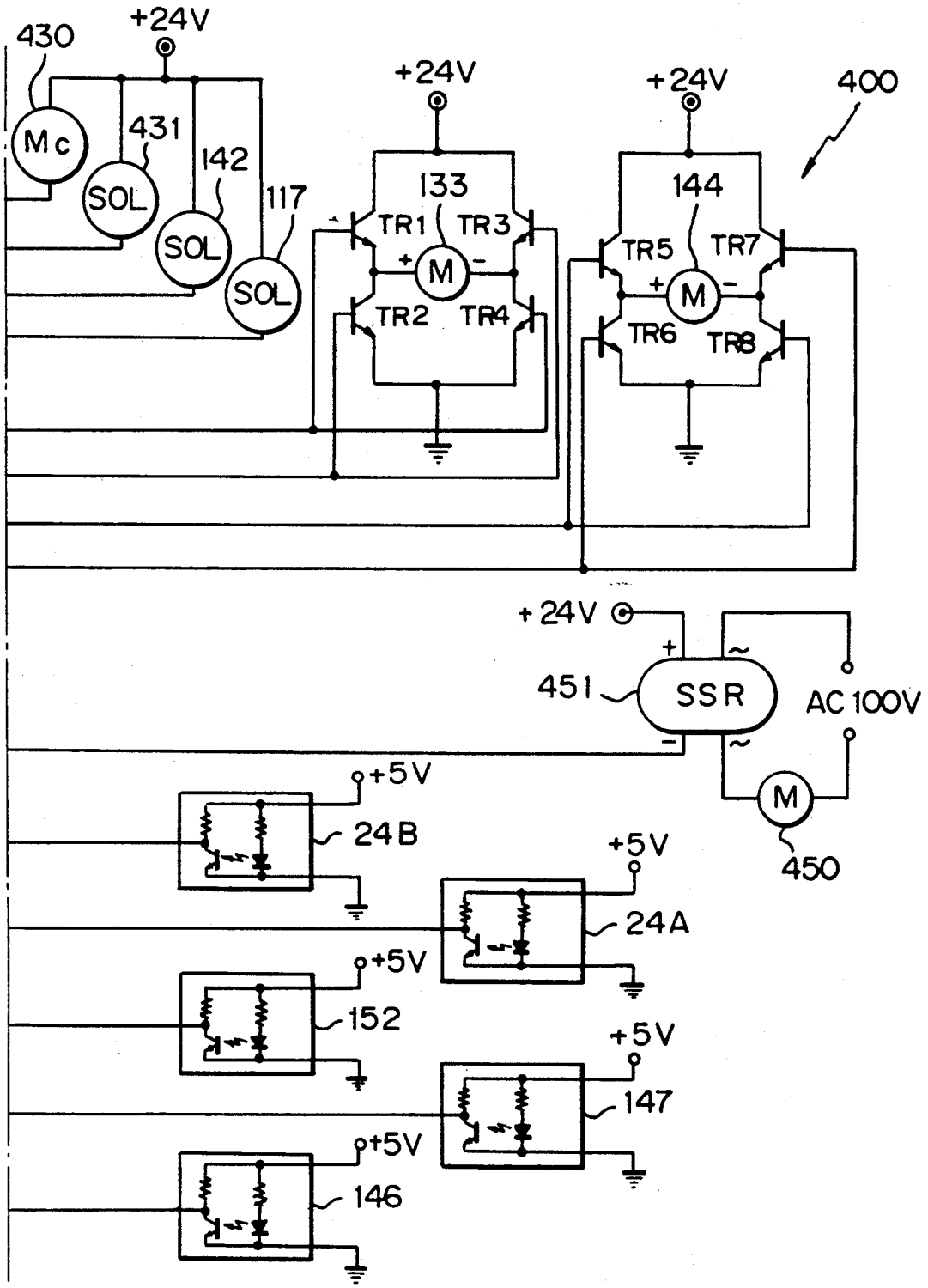

Referring to FIG. 15, the finisher control unit 400 includes a main controller 401 having a 1-chip microcomputer 410, output drivers 411 to 418, input buffers 421 to 426, control signal interface line 207 connecting to the copier body control unit 200, etc. The microcomputer 410 includes a timer 402 for implementing a plurality of timer functions, a ROM 403 loaded with finisher control programs, a RAM 404 for temporarily storing control data, input and output control sections 405 to 407, a bus 408 interconnecting the above-mentioned blocks, a CPU 409 for controlling such various blocks, and a reference oscillator 409X for oscillating a control clock. A discharge clutch 430 causes stapled copies to be discharged to the tray 27. A staple solenoid 431 activates and deactivates the stapler 31. The solenoid 142 brings the shift roller 137 shown in FIGS. 9 and 10 into contact with the surface of a paper sheet. The solenoid 117 operates the reference changing roller 111 shown in FIG. 8 in order to change the reference position for paper transport depending on the stapling edge. Specifically, when paper sheets are to be bound at their left edge, the ON time of the solenoid 117 is changed paper size by paper size for thereby insuring an accurate change of transport reference.

The reversible motor 133 changes the operative position of the shift roller unit 130 shown in FIG. 10, depending on the binding edge of copied paper sheets. Switching transistors TR1 to TR4 are provided for driving the motor 133. Specifically, when the output level of the driver 415 is turned from "L" to "H" to turn on the transistors TR1 and TR4, the motor 133 is rotated counterclockwise to move the shift roller unit 130 to the reference position associated with right edge stapling. When the output of the driver 416 is turned from "L" to "H" to turn on the transistors TR2 and TR3, the motor 133 is rotated counterclockwise to move the shift roller unit 130 to the reference position associated with left edge stapling. The reversible motor 144 rotates the shift roller 137 shown in FIGS. 9 and 10 either forwardly or reversely depending upon the stapling position of copies. Switching transistors TR5 to TR8 drive the motor 144. In the case of left edge stapling, the output of the driver 417 is turned from "L" to "H" to turn on the transistors TR5 and TR8, whereby the motor 144 is rotated clockwise. In the case of right edge stapling, the output of the driver 417 is turned from "L" to "H" to turn on the transistors TR6 and TR7, whereby the motor 144 is rotated counterclockwise.

A synchronous motor (main motor) 450 serves as a main drive motor of the finisher 30. The motor 450 is selectively energized and deenergized by a solid state relay. The two paper size sensors 24A and 24B constitute the inlet sensor 24 shown in FIG. 1 and is capable of distinguishing three different paper sizes from each other. Specifically, when the paper size is maximum (A3), both the sensors 24A and 24B are turned on. When the paper size is minimum (A4) or medium (B4), only the sensor 24A is turned on; the minimum and medium paper sizes are distinguished from each other on the basis of the duration of the ON time of the sensor 24A. The output of the sensor 24A serves as a reference for the control which will be performed in the finisher 30 afterwards. The discharge solenoid 152 defines a timing for driving the solenoid 142 which brings the shift roller 137 of the shift roller unit 130 into contact with the paper sheet PE. The solenoid 142 is turned on after the lapse of a predetermined period of time as counted from the instant when the discharge sensor 152 has sensed the leading edge of a paper sheet. The positioning sensors 146 and 147 position the shift roller unit 130 shown in FIGS. 9 and 10 for right edge stapling and left edge stapling, respectively.

The control section of the copier having the above construction will operate as follows.

FIRST EMBODIMENT

Figure 16:
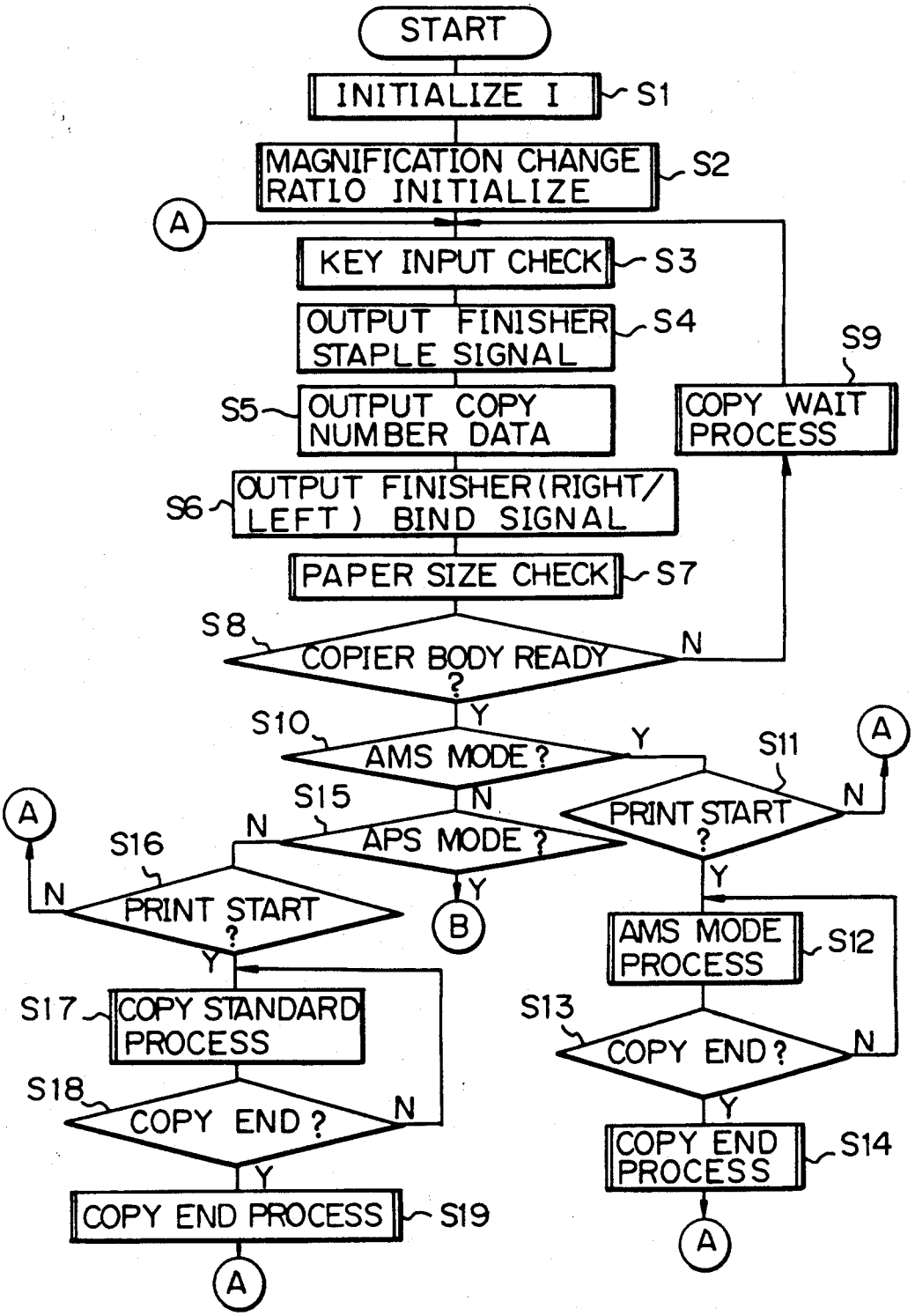

A control procedure representative of a first embodiment will be described with reference to FIGS. 16 to 29. To begin with, the control over the copier body 20 effected by the copier body control unit 200 will be described with reference to FIGS. 16 to 22. When the main switch 41 of the operation board 40 is turned on, the main controller 210 of the control unit 200 is fed with DC voltages (+5 volts and +24 volts) from the power supply section 201 so as to start on a control program. First, as shown in FIG. 16, the controller 210 executes an INITIALIZE (I) subroutine for setting initial data and initial modes necessary for the control over the copier (step S1), and a MAGNIFICATION CHANGE RATIO INITIAL SET subroutine for setting an initial magnification (e.g. 100%) (S2). This is followed by a KEY INPUT CHECK subroutine for checking the input conditions of the key section 41*b* of the operation panel 40 (S3), thereby determining input data, modes and so forth. Based on the result of the step S3, a staple signal, copy number data and a finisher (right/left) bind signal are fed to the finisher 30 (S4 to S6) to execute a PAPER SIZE CHECK subroutine (S7). In this subroutine, the paper sizes associated with the paper cassettes 2A to 2C are determined by referencing the outputs of the size sensors 77A and 77B (see FIG. 5) which are associated with each of the paper cassettes 2A to 2C.

In a step S8, whether or not various conditions of the copier body 20 have been established to render the copier body ready to operate is determined. If the answer of the step S8 is NO, a COPY WAIT PROCESS subroutine is executed (S9) for controlling the waiting conditions of the copier body 20, and then the program returns to the KEY INPUT CHECK subroutine. If the answer of the step S8 is YES, whether or not an automatic magnification selection mode (AMS) has been set up is determined (S10). If the answer of the step S10 is YES, whether or not the print key 42 has been pressed is determined (S11). If the answer of the step S11 is NO, the program returns to the KEY INPUT CHECK subroutine; if it is YES, an AMS MODE PROCESS subroutine is executed to effect an AMS copy mode (S12). After the copying operation (S13), a COPY END PROCESS subroutine is executed (S14), and then the program returns to the KEY INPUT CHECK subroutine to prepare for the next copying operation.

When the result of the step S10 is NO, whether or not an automatic paper selection mode (APS mode) has been set up is determined (S15). If the answer is NO, whether or not the print key 42 has been turned on is determined (S16) and, if it has not been turned on, the program returns to the KEY INPUT CHECK subroutine while, if it has been turned on, a COPY STANDARD PROCESS subroutine (S17) is executed to perform copying in an ordinary copy mode. After the copying operation (S18), a COPY END PROCESS subroutine (S19) is executed and followed by the KEY INPUT CHECK subroutine for preparing for the next copying operation.

In accordance with the present invention a first to sixth control operation are selectively performed, as follows.

FIRST CONTROL OPERATION

Figure 17A:
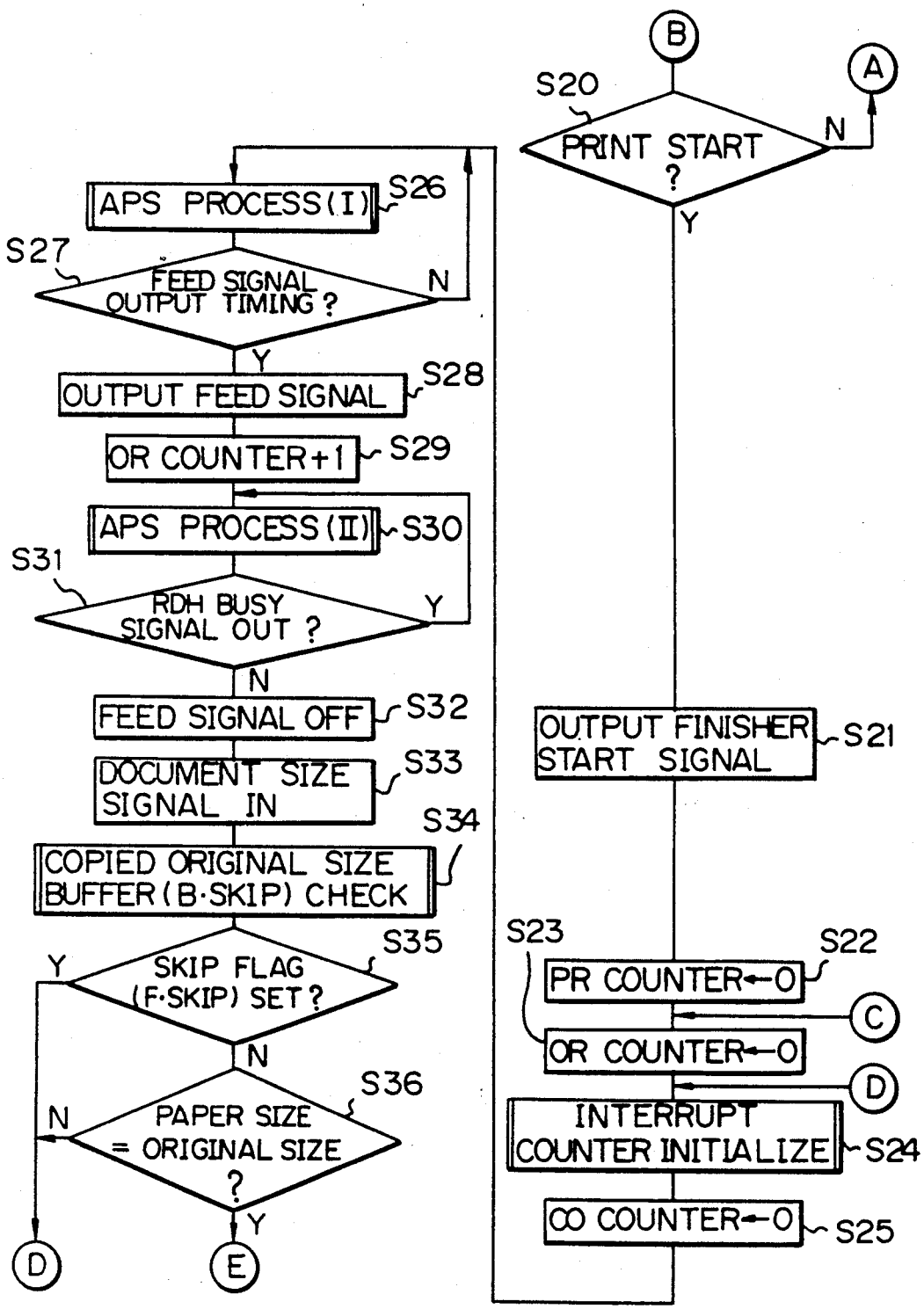

If the answer of the step S15 shown in FIG. 16 is YES, processing shown in FIG. 17A is executed. The processing begins with a step S20 for determining whether or not the print key 42 has been turned on. If the answer is NO, the program returns to the KEY INPUT CHECK subroutine shown in FIG. 16 while, if the answer is YES, a finisher start signal is delivered (S21). Subsequently, a PR counter for counting the number of times that an APS process (III) has been performed is cleared (S22). The APS process (III) is a copy producing process associated with the PAS mode. Then, an OR counter for counting documents is cleared (S23). This is followed by an INTERRUPT COUNTER INITIALIZE subroutine (S24) for initializing an interrupt counter which is used for control, whereafter a CO counter which is a copy counter is cleared (S25). Then, an APS PROCESS (I) subroutine (S26) is executed for controlling an APS process (I) which is the copy process occurring up to the instant of appearance of a feed signal for the RDH 10. A feed singal output timing is determined (S27). If the answer of the step S27 is NO, the APS process (I) subroutine is repeated; if it is YES, the program advances to a step S28.

In the step S28, a feed signal is fed to the RDH 10 while the OR counter, or document counter, is incremented by 1 (one) (S29). The step S29 is followed by a step S30 for executing an APS PROCESS (II) subroutine (S30) which is adapted to control the copy process during the replacement of a document in the RDH 10. Whether or not the RDH 10 is producing a BUSY signal is determined (S31); if the answer is YES, the APS PROCESS (II) subroutine is repeated while, if it is NO, the program advances to the next step S32. In the step S32, the feed signal is turned from ON to OFF. Then, document size data from the RDH 10 is read (S33), and a COPIED ORIGINAL SIZE BUFFER (B-CPID) CHECK subroutine is executed (S 34). The buffer B.CPID stores all the size data associated whith the original documents which have been copied. The stored size data and the document size data taken in from the RDH 10 in the step S33 are compared and, if any document of the same size is present, a skip flag (F.SKIP) for deciding to skip the copy process with such a document is set.

If the skip flag (F.SKIP) has been set as decided in the next step (S35), the program skips the subsequent copy process and returns to the INTERRUPT COUNTER INITIALIZE subroutine so as to execute processing with the next document. If the answer of the step S35 is NO, the paper size data stored in the paper size buffer and the document size data from the RDH 10 are compared (S36); if they compare equal, processing shown in FIG. 17B is executed while, if they do not compare equal, the program returns to the INTERRUPT COUNTER INITIALIZE subroutine.

Figure 17B:
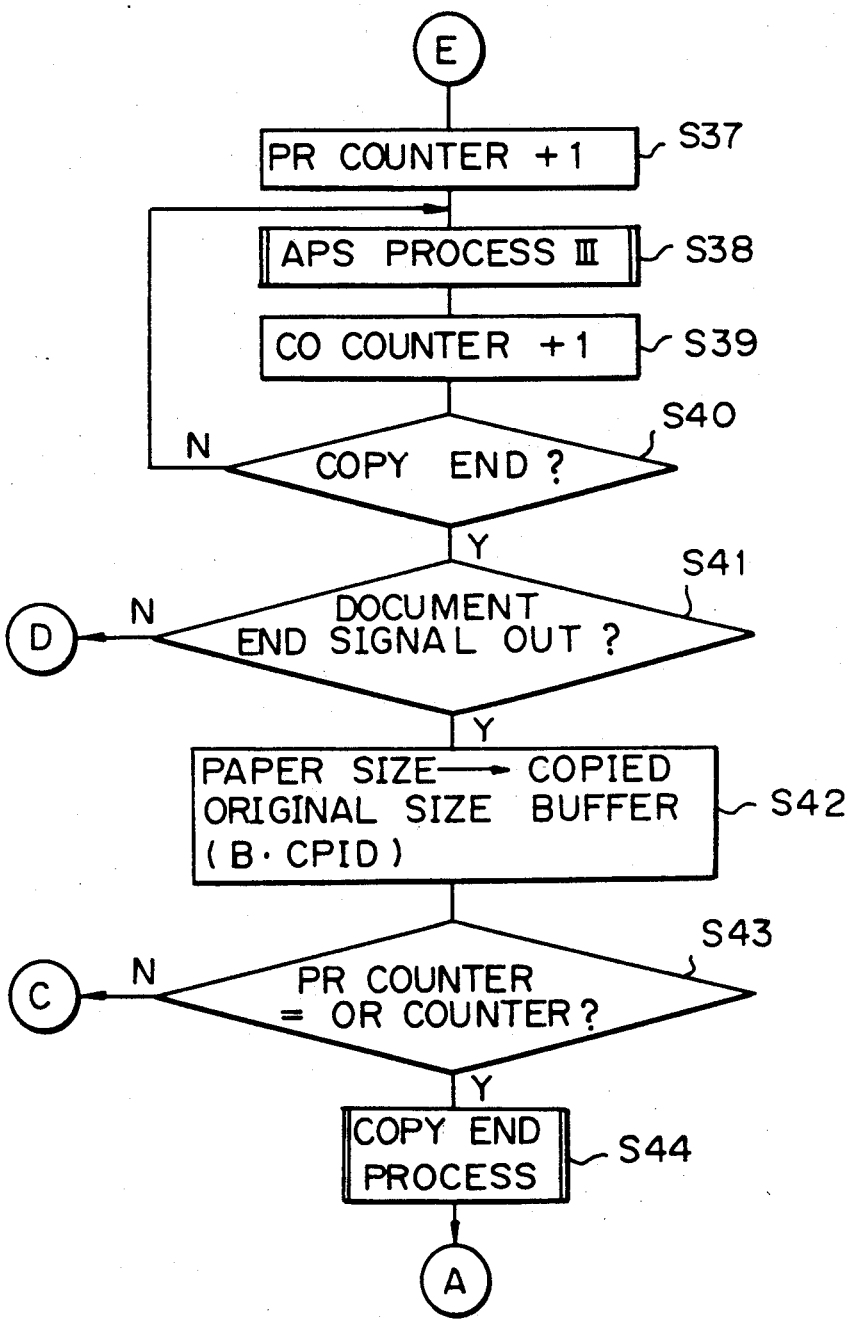

The procedure shown in FIG. 17B begins with a step S37 for incrementing the PR counter by 1. Then, an APS PROCESS (III) subroutine is executed (S38). This subroutine controls the copying process associated with a document being laid on the glass platen, one copy being produced every time the subroutine is executed. Next, the CO counter is incremented by 1 (S39) and, then, whether or not the CO counter is coincident with the copy number data set by the KEY INPUT CHECK subroutine of FIG. 16, i.e., whether or not the copying operation with the current document has been completed (copy end) is determined (S40). If the answer of the step S40 is NO, the APS PROCESS (III) subroutine is repeated. If it is YES, whether or not the RDH 10 is producing a document end signal is determined (S41). If the answer of the step S41 is NO, the program returns to the INTERRUPT COUNTER INITIALIZE subroutine of FIG. 17A while, if it is YES, the copied original size buffer (B.CPID) is loaded with the paper size data of the paper size buffer (B.PAPER) (S42). Thereupon, the PR counter and the OR counter are compared (S43). If they do not compare equal, the program returns to OR COUNTER CLEAR of FIG. 17A while, if they compare equal, a COPY END PROCESS subroutine is executed (S44) for controlling the final processing of copy process. Then, the program returns to the KEY INPUT CHECK subroutine of FIG. 16 to prepare for next copying.

SECOND CONTROL OPERATION

Figure 18A:
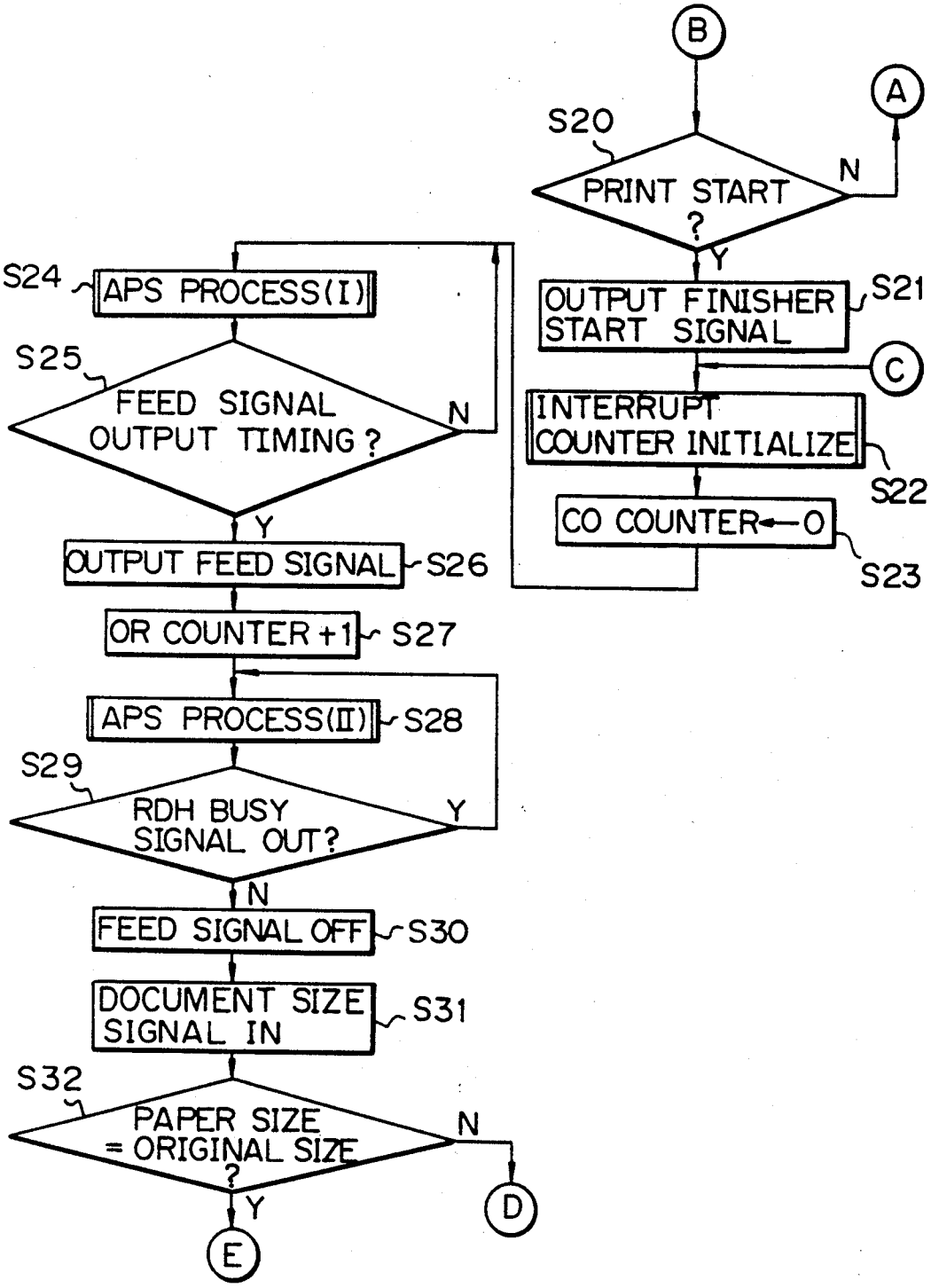

If the answer of the step S15 is YES, the operation is transferred to a procedure shown in FIG. 18A. In FIG. 18A, whether or not the print key 42 has been turned on is determined (S20) and, if the answer is NO, the KEY INPUT CHECK subroutine shown in FIG. 16 is repeated. If the answer is YES, a finisher start signal is fed out (S21). Then, an INTERRUPT COUNTER INITIALIZE subroutine is executed (S22) for initializing the interrupt counter adapted for control, whereafter the CO counter is cleared (S23). An APS PROCESS (I) subroutine (S24) is executed for controlling an APS process (I) which is the copy process occurring up to the instant of appearance of a feed signal for the RDH 10. A feed signal output timing is determined (S25). If the answer of the step S27 is NO, the APS process (I) subroutine is repeated; if it is YES, the program advances to a step S26. In the step S26, a feed signal is sent to the RDH 10 while the OR counter, or document counter, is incremented by 1 (one) (S27).

The step S27 is followed by a step S38 for executing an APS PROCESS (II) subroutine which is adapted to control the copy process during the replacement of a document in the RDH 10. Whether or not the RDH 10 is producing a BUSY signal is determined (S29); if the answer is YES, the APS PROCESS (II) subroutine is repeated while, if it is NO, the program advances to the next step S30. In the step S30, the feed signal is turned from ON to OFF. Then, document size data from the RDH 10 is read (S31), and paper size data stored in the paper size buffer and associated with copied paper sheets and the document size data from the RDH 10 are compared (S32). If they compare equal, the program advances to a procedure which begins with (E) of a flowchart of FIG. 18B while, if otherwise, the program advances to a procedure which begins with (D) of the same figure.

Figure 18B:
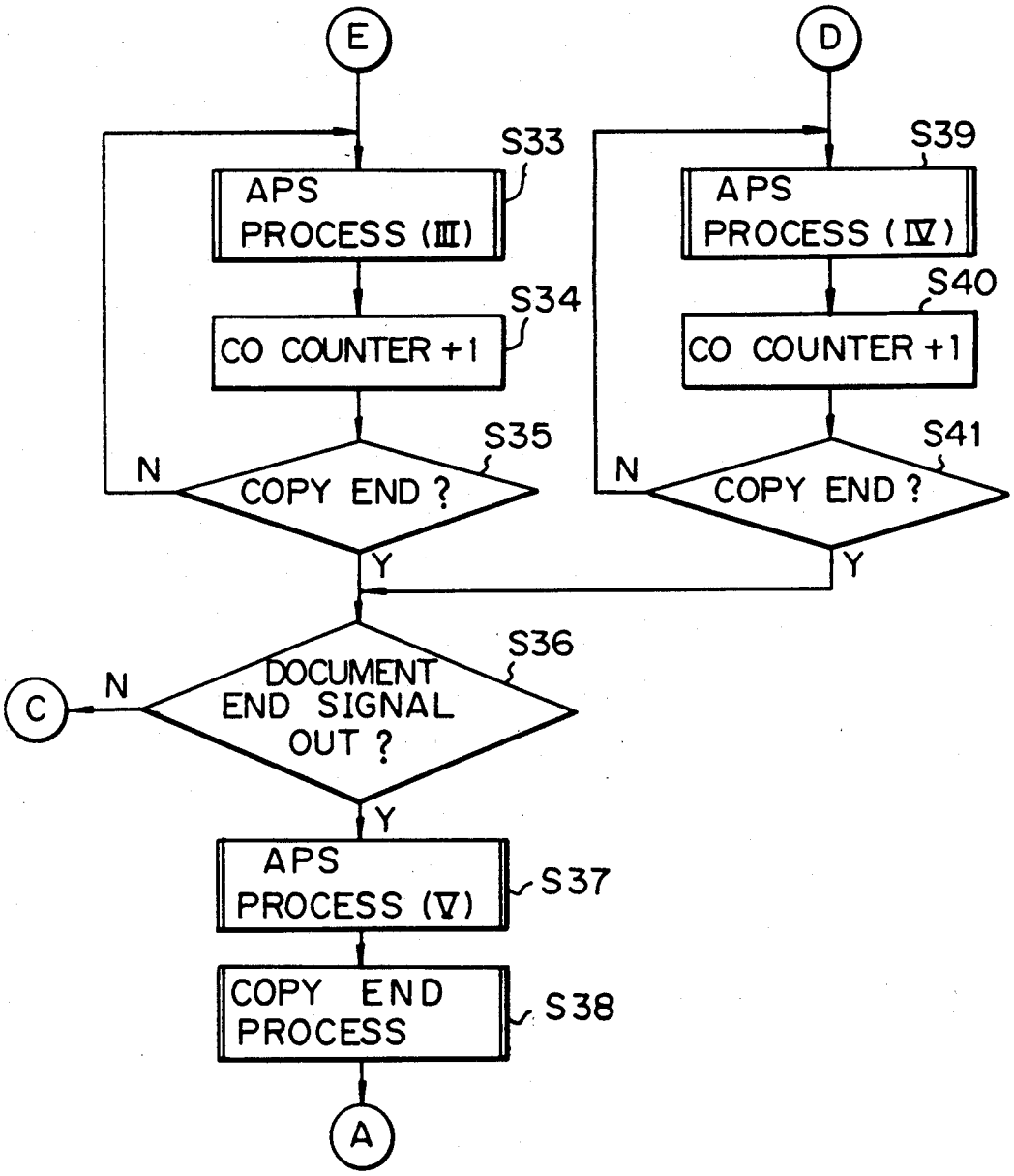

The procedure labeled (E) in FIG. 18B begins with an APS PROCESS (III) subroutine (S33). This subroutine controls the copying process associated with a document being laid on the glass platen, one copy being produced every time the subroutine is executed. Next, the CO counter is incremented by 1 (S34) and, then, whether or not the CO counter is coincident with the copy number data set by the KEY INPUT CHECK subroutine of FIG. 16, i.e., whether or not the copying operation with the current document has been completed (copy end) is determined (S35). If the answer of the step S35 is NO, the APS PROCESS (III) subroutine is repeated. If it is YES, whether or not the RDH 10 is producing a document end signal is determined (S36). If the answer of the step S36 is NO, the program returns to the INTERRUPT COUNTER INITIALIZE subroutine (C) of FIG. 18A while, if it is YES, an APS PROCESS (V) which is a subroutine for discharging all of the copied paper sheets PD being temporarily stacked on an intermediate tray of the two-side unit 23 is executed (S37). Subsequently, after a COPY END PROCESS subroutine for controlling the final processing of the copy process has been executed (S38), the program returns to the KEY INPUT CHECK subroutine (A) of FIG. 16 to prepare for the next copying.

In the flow beginning at (D) of FIG. 18B, an APS (IV) PROCESS subroutine is executed (S39) for copying a document being set on the glass platen 3 and temporarily stacking a copied paper sheet on the intermediate tray of the two-side unit 23. Every time this subroutine is effected, one copy is produced and stacked on the intermediate tray. Then, the CO counter is incremented by 1 (S40) to see if the copying operation with the current document has been completed (S41). If the answer is NO, the APS PROCESS (IV) subroutine is repeated while, if it is YES, whether or not the RDH 10 is producing a document end signal is determined and followed by the same routine which begins at (E).

THIRD CONTROL OPERATION

If the answer of the step S15 shown in FIG. 16 is YES, processing which begins at (B) of the flowchart shown in FIG. 17A is executed. That is, the third control operation is the same as the first control operation so long as the steps S20 to S36 of FIG. 17A are concerned. However, in the third control operation, if the skip flag (F.SKIP) has not been set as decided in the step S35 of FIG. 17A, the paper size data being stored in the paper size buffer and the document size data from the RDH 10 are compared (S36). If they compare equal, the program advances to a procedure which begins at (F) of FIG. 19 and, if otherwise, it advances to a procedure which begins at (G) of the same figure.

Figure 19:
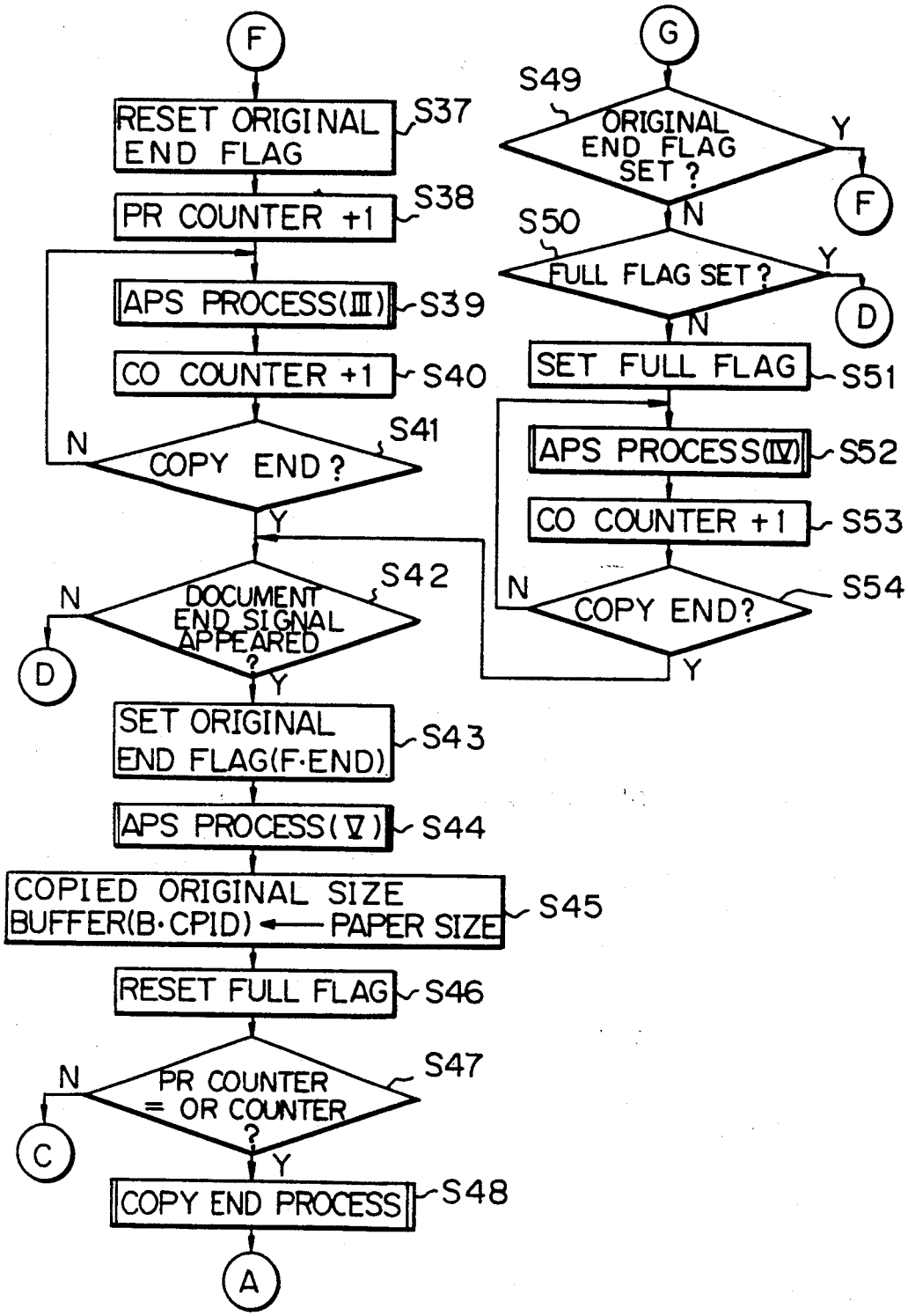

In the flow beginning at (F) of FIG. 19, an original end flag (F.END) which is set every time the RDH 10 produces a document end signal is reset (S37), then the PR counter is incremented by 1 (S38), and then the APS PROCESS (III) subroutine is executed (S39). This subroutine is adapted to control the copying process with a document being laid on the glass platen and, every time it is executed, one copy is produced. Then, the CO counter is incremented by 1 (S40). In the next step S41, whether the CO counter is coincident with the copy number data which has been set by the KEY INPUT CHECK ROUTINE of FIG. 16, i.e., whether the copying operation with the current document has been completed (copy end) is determined. If the answer of the step S41 is NO, the APS PROCESS (III) is repeated while, if it is YES, whether or not the RDH 10 is producing a document end signal is determined (S42). If the answer of the step S42 is NO, the INTERRUPT COUNTER INITIALIZE subroutine (D) of FIG. 17A is repeated while, if it is YES, the original end flag (F.END) is set (S43).

This is followed by an APS PROCESS (V) (S44) subroutine for discharging all of the copied paper sheets PD being temporarily stacked on the intermediate tray of the two-side unit 23 (FIG. 1). Then, the copied original size buffer (B.CPID) is loaded with the paper size data of the paper size buffer (B.PAPER), followed by the next step. A full flag (F.FULL) showing that copied paper sheets are stacked on the intermediate tray is reset (S46), and then the PR counter and the OR counter are compared (S47). If the two counters do not compare equal, the program returns to OR COUNTER CLEAR (C) of FIG. 17A while, if they compare equal, a COPY END PROCESS subroutine is executed (S48) for controlling the final processing of the copy process (S48). Subsequently, the program returns to the KEY INPUT CHECK subroutine (A) of FIG. 16 to prepare for the next copying operation.

In the flow beginning at (G) of FIG. 19, whether or not the original end flag (F.END) has been set is determined (S49) and, if the answer is YES, the operation is transferred to (F). If the answer is NO, whether the full-flag (F.FULL) has been set is determined (S50). If the answer of the step S50 is YES, the program returns to the INTERRUPT COUNTER INTIALIZE subroutine (D) of FIG. 17A while, it is NO, the full flag (F.FULL) is set (S51) to execute the APS PROCESS (IV) suroutine (S52). This subroutine is executed to produce a copy with a document being set on the glass platen 3 and to temporarily stack a copy on the intermediate tray of the two-side unit 23. Every time this routine is executed, one copy is produced and stacked on the intermediate tray. Subsequently, the CO counter is incremented by 1 (S53), and then whether or not the copying operation with the current document has been completed (copy end) is determined (S54). If the answer of the step S54 is NO, the APS PROCESS (IV) subroutine is repeated while, if it is YES, whether or not the RDH 10 is producing a document end signal is determined. This is followed by the same routine as the processing which begins at (F).

FOURTH CONTROL OPERATION

Figure 20A:
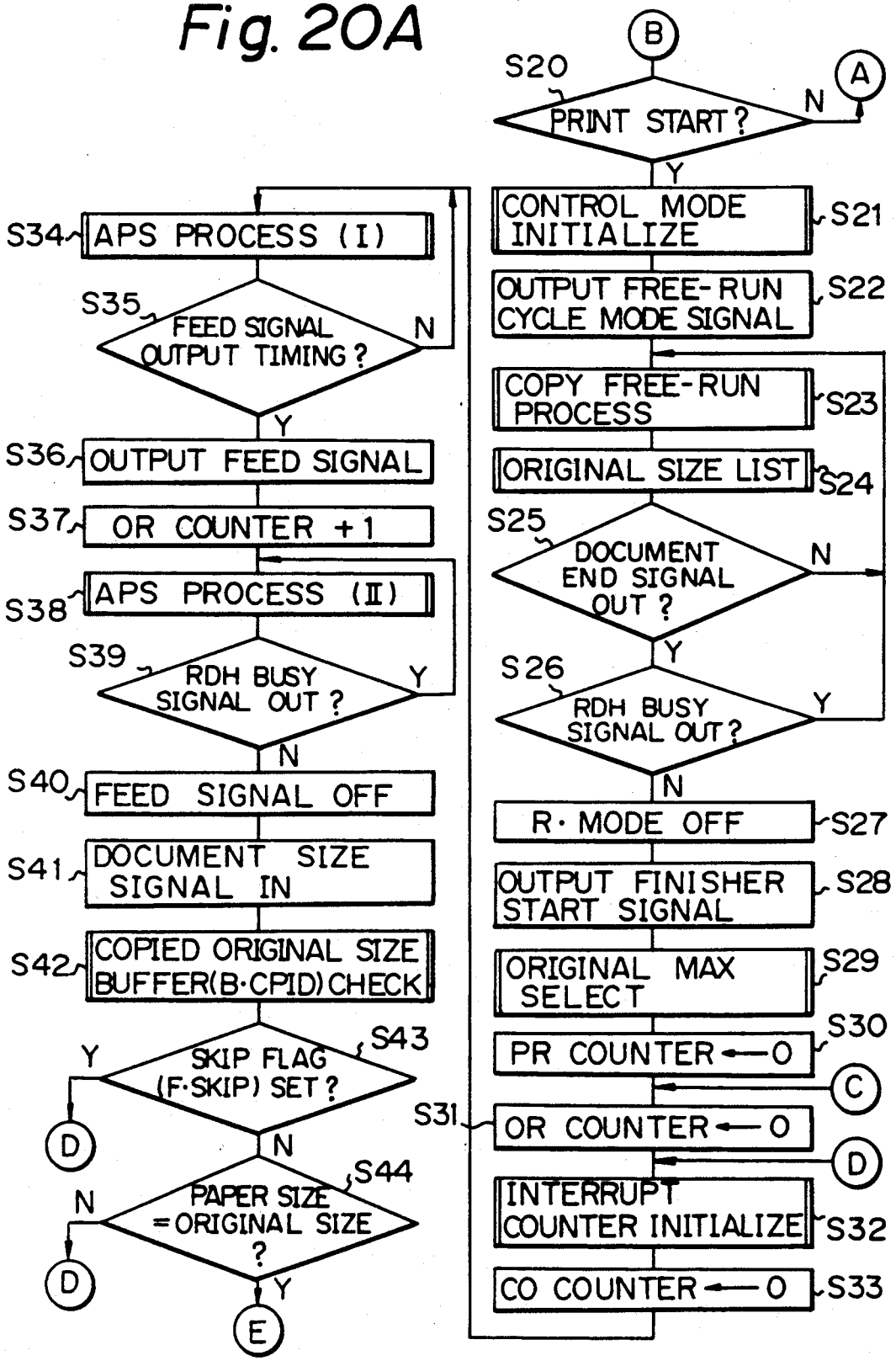

When the answer of the step S15 shown in FIG. 16 is YES, processing which begins at (B) of FIG. 20A is executed. First, whether or not the print key 42 has been turned on is determined (S20). If the answer is NO, the program returns to the KEY INPUT CHECK subroutine (A) of FIG. 16 while, if it is YES, the CONTROL MODE INITIALIZE subroutine is executed to initialize the control data and modes for the APS mode (S21). Then, a free-run recycle mode signal (R.MODE) is fed to the RDH 10 (S22) to effect a COPY FREE-RUN PROCESS subroutine (S23). This subroutine is adapted to execute wait mode control while the RDH 10 executes a free-run recycle mode. In the next step S24, an ORIGINAL SIZE LIST subroutine is executed for preparing an original size list in the RAM 215 (FIG. 13), as shown in FIG. 20C. The original size list is produced by sequentially memorizing in any addresses of the RAM 215 the sizes of the individual documents which are indicated by document size signals from the RDH 10.

The step S24 is followed by a step S25 for determining whether or not the RDH 10 has outputted a document end signal. If the answer is NO, the program returns to the COPY FREE-RUN PROCESS subroutine while, if it is YES, whether or not the RDH 10 is producing a BUSY signal is determined (S26). If the answer of the step S26 is YES, the program returns to the COPY FREE-RUN PROCESS subroutine while, it is NO, the free-run recycle mode signal (R.MODE) is turned off (S27). This is followed by a step S28 for delivering a finisher start signal. Then, an ORIGINAL MAX SELECT subroutine is executed (S29) to select the maximum size out of the original size list shown in FIG. 20C. The original size data is written in a paper size buffer (B.PAPER) which is adapted to temporarily store data representative of paper sizes which are to be used for the copy process. Subsequently, the PR counter for counting the number of times that the APS PROCESS (III) has been executed is cleared (S30), as is also the OR counter or document counter (S31). This is followed by an INTERRUPT COUNTER INITIALIZE subroutine (S32) for initializing the interrupt counter which is used for control, whereafter the CO counter or copy counter is cleared (S33).

Subsequently, a subroutine (S34) is executed for controlling the APS PROCESS (I) which is the copy process occurring up to the instant of appearance of a feed signal for the RDH 10. Then, whether or not the timing for delivering a feed signal has been reached is determined (S35). If the answer is NO, the APS PROCESS (I) subroutine is repeated while, if it is YES, a step S36 is executed. In the step S36, a feed signal is sent to the RDH 10. Then, the OR counter is incremented by 1 (S37). This is followed by a step (S38) for effecting an APS PROCESS (II) which is adapted to control the copy process during the replacement of a document in the RDH 10. Subsequently, whether or not the RDH 10 is producing a BUSY signal is determined (S39). If the answer of the step S39 is YES, the APS PROCESS (II) subroutine is repeated while, if it is NO, the program advances to a step S40 for turning off the feed signal. After document size data has been taken in from the RDH 10 (S41), a COPIED ORIGINAL SIZE BUFFER (B.CPID) CHECK subroutine is executed (S42).

The buffer B.CPID stores all the size data associated with documents which have been copied. This size data and the size data newly taken in from the RDH 10 are compared and, if any of the former coincides with the latter, a skip flag (F.SKIP) is set for skipping the copy process associated with the current document. Whether or not the skip flag (F.SKIP) has been set is determined (S43) and, if the answer is YES, the subsequent copy process is skipped to return to the INTERRRUPT COUNTER INITIALIZE subroutine (D) for thereby executing processing for the next document. If the answer of the step S43 is NO, the document size data from the RDH 10 is compared with the paper size data (original size) being stored in the paper size buffer (S44). If the two data compare equal, processing beginning at (E) of FIG. 20B is executed while, if they do not compare equal, the program returns to the INTERRUPT COUNTER INITIALIZE subroutine.

Figure 20B:
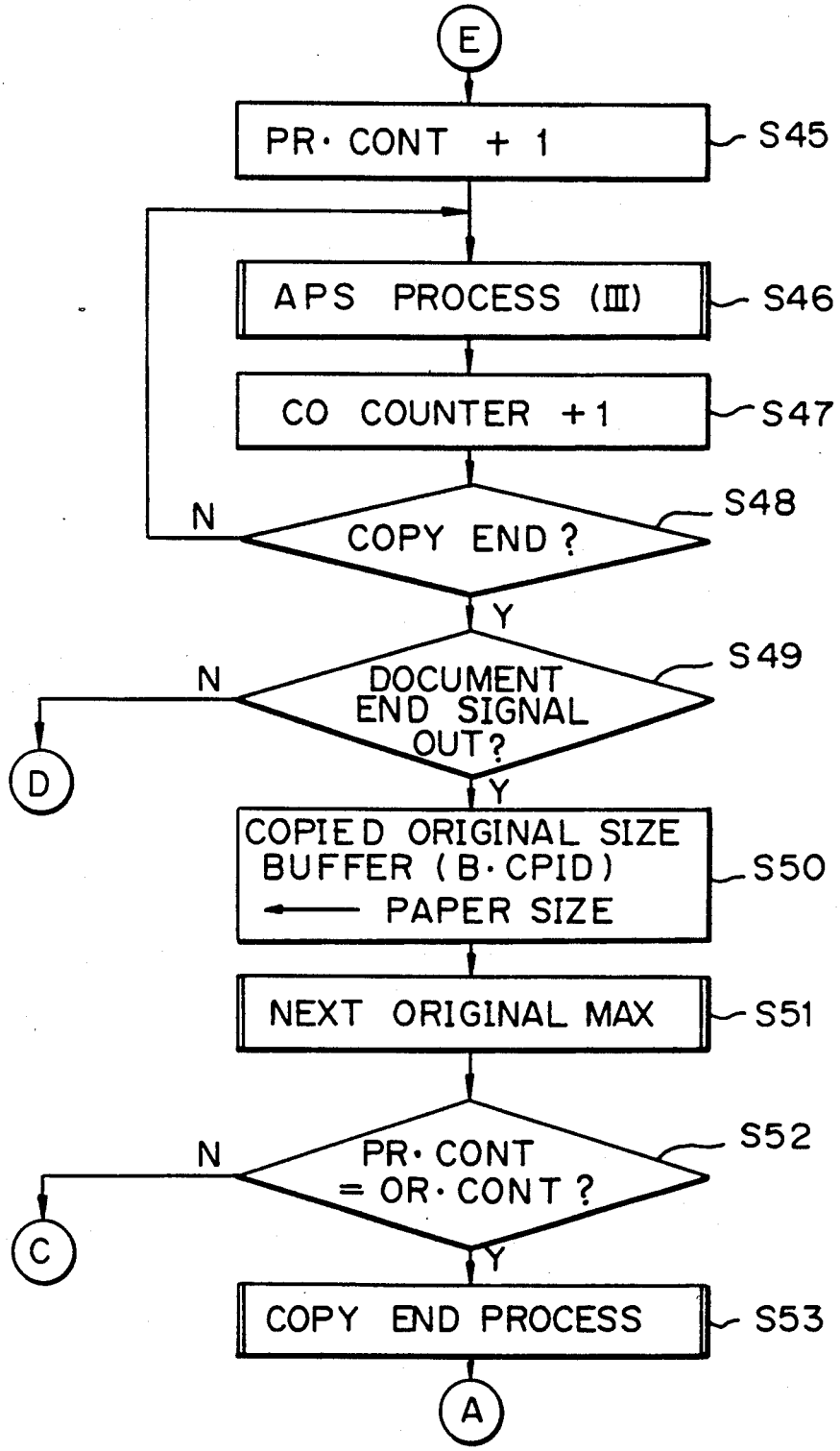

In the flowchart shown in FIG. 20B, the PR counter is incremented by 1 (S45), and then the APS PROCESS (III) subroutine is executed (S46). Subsequently, the CO counter is incremented by 1 (S47). In this condition, whether or not the content of the counter CO is equal to the copy number data set by the KEY INPUT CHECK subroutine of FIG. 16, i.e., whether or not the copying operation with the current document has been completed (copy end) is determined (S48). If the answer of the step S48 is NO, the APS PROCESS (III) subroutine is repeated. If it is YES, whether or not the RDH 10 is producing a document end signal is determined (S49). If the answer of the step S49 is NO, the program returns to the INTERRUPT COUNTER INITIALIZE subroutine (D) of FIG. 20A while, if it is YES, the copied original size buffer (B.CPID) is loaded with the paper size data which is stored in the paper size buffer (B.PAPER).

Next, a NEXT ORIGINAL MAX subroutine is executed (S51). In this subroutine, size data next to the paper size data being loaded in the paper size buffer (B.PAPER) is selected out of the original size list shown in FIG. 20C and is set in the paper size buffer (B.PAPER). Then, the PR counter and OR counter are compared (S52) and, if they do not compare equal, the program returns to OR COUNTER CLEAR (C) of FIG. 20A. If they compare equal, the COPY END PROCESS subroutine is executed (S53) for controlling the final processing of the copy process, whereafter the program returns to the KEY INPUT CHECK subroutine (A) of FIG. 16 to prepare for the next copying.

FIFTH CONTROL OPERATION

Figure 21A:
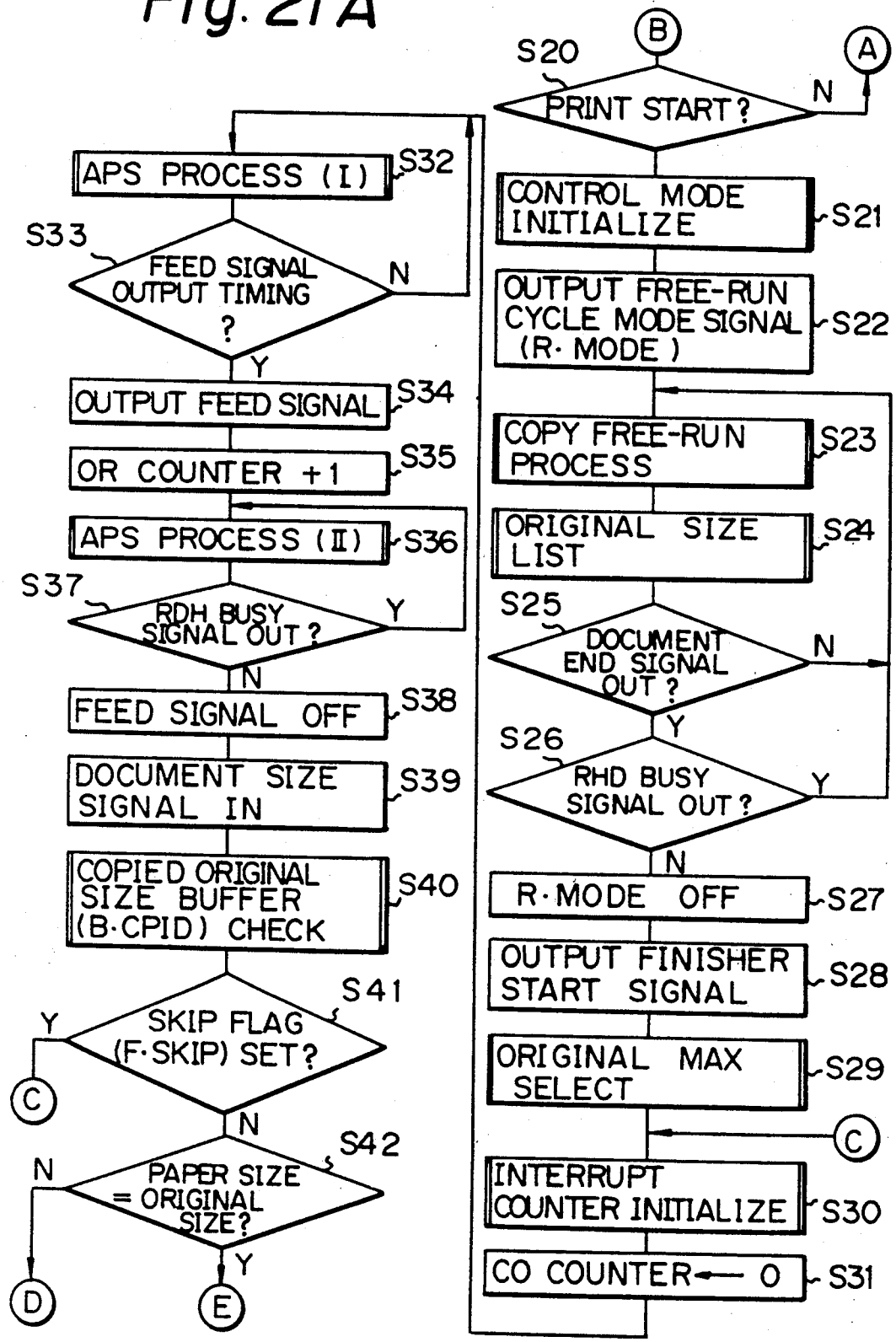

If the answer of the step S15 shown in FIG. 16 is YES, the program advances to processing which begins at (B) of FIG. 21A. First, whether or not the print key 42 has been turned on is determined (S20). If the answer of the step S20 is NO, the program returns to the KEY INPUT CHECK subroutine (A) shown in FIG. 16 while, if it is YES, the program executes the CONTROL MODE INITIALIZE subroutine to initialize the control data and modes for APS mode (S21). Then, a free-run recycle mode signal (R.MODE) is sent to the RDH 10 (S22) to execute a COPY FREE-RUN PROCESS subroutine (S23) which has been described. The sep S23 is followed by a step S24 for executing the ORIGINAL SIZE LIST subroutine which has been described also.

After the step S24, whether or not the RDH 10 has produced a document end signal is determined (S25). If the answer is NO, the program returns to the COPY FREE-RUN PROCESS subroutine while, if it is YES, whether or not the RDH 10 is producing a BUSY signal is determined (S26). If the answer of the step S26 is YES, the program returns to the COPY REEE-RUN PROCESS subroutine while, if it is NO, the free-run recycle mode signal (R.MODE) is turned off (S27). In the next step S28, a finisher start signal is delivered. Thereupon, the ORIGINAL MAX SELECT subroutine is executed (S29) to select the maximum size out of the original size list shown in FIG. 20C. The original size data is written in the paper size buffer (B.PAPER) which is adapted to temporarily store data representative of paper sizes which are to be used for the copy process. Subsequently, the INTERRUPT COUNTER INITIALIZE subroutine is executed (S30), and then the CO counter or copy counter is cleared (S31). Then, the subroutine (S32) is executed for controlling the APS PROCESS (I) which is the copy process occurring up to the instant of appearance of a feed signal for the RDH 10. Then, whether or not the timing for delivering a feed signal has been reached is determined (S33). If the answer is NO, the APS PROCESS (I) subroutine is repeated while, if it is YES, a step S34 is executed.

In the step S34, a feed signal is sent to the RDH 10. Then, the OR counter is incremented by 1 (S35). This is followed by a step (S36) for effecting the APS PROCESS (II) which is adapted to control the copy process during the replacement of a document in the RDH 10. Subsequently, whether or not the RDH 10 is producing a BUSY signal is determined (S37). If the answer of the step S37 is YES, the APS PROCESS (II) subroutine is repeated while, if it is NO, the program advances to a step S38 for turning off the feed signal. After document size data has been taken in from the RDH 10 (S39), the COPIED ORIGINAL SIZE BUFFER (B.CPID) CHECK subroutine is executed (S40). The buffer B.CPID stores all the size data associated with documents which have been copied. This size data and the size data newly taken in from the RDH 10 are compared and, if any of the former coincides with the latter, the skip flag (F.SKIP) is set for skipping the copy process associated with the current document. Whether or no the skip flag (F.SKIP) has been set is determined (S41) and, if the answer is YES, the subsequent copy process is skipped to return to the INTERRUPT COUNTER INITIALIZE subroutine (D) for thereby executing processing for the next document. If the answer of the step S41 is NO, the document size data from the RDH 10 is compared with the paper size data (original size) being stored in the paper size buffer (S42). If the two data compare equal, processing beginning at (E) of FIG. 21B is executed while, if they do not compare equal, processing beginning at (D) of the same figure is executed.

Figure 21B:
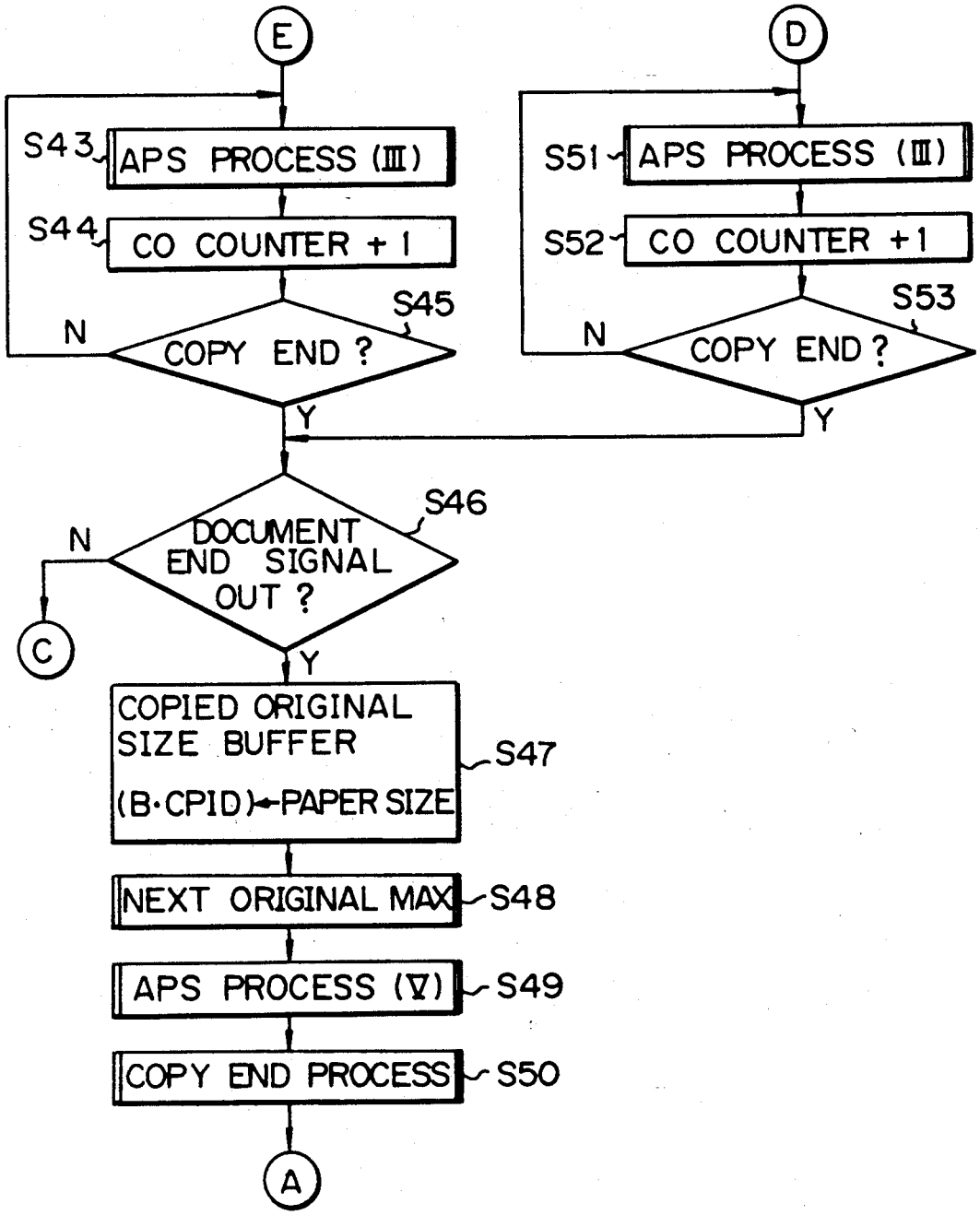

In the processing which begins at (E) of FIG. 21B, the APS PROCESS (III) subroutine is executed (S43) which is adapted to control the copying process with a document being laid on the glass platen and, every time it is executed, one copy is produced. Then, the CO counter is incremented by 1 (S44). In the next step S45, whether the CO counter is coincident with the copy number data which has been set by the KEY INPUT CHECK ROUTINE of FIG. 16, i.e., whether the copying operation with the current document has been completed (copy end) is determined. If the answer of the step S45 is NO, the APS PROCESS (III) is repeated while, if it is YES, whether or not the RDH 10 is producing a document end signal is determined (S46). If the answer of the step S46 is NO, the INTERRUPT COUNTER INITIALIZE subroutine (C) of FIG. 21A is repeated while, if it is YES, the copied original size buffer (B.CPID) is loaded with the paper size data being stored in the paper size buffer (B.PAPER).

Next, a NEXT ORIGINAL MAX subroutine is executed (S48). In this subroutine, smaller size data listed in the original size list of FIG. 20C is set in the paper size buffer (B.PAPER). Then, the APS PROCESS (V) is executed (S49) for discharging all of the copied paper sheets PD which are temporarily stacked on the intermediate tray of the two-side unit 23 of FIG. 1. Finally, the COPY END PROCESS subroutine is executed (S50) for controlling the final processing of the copy process, whereafter the program returns to the KEY INPUT CHECK subroutine (A) of FIG. 16 to prepare for the next copying.

In the flow which begins at (D) of FIG. 21B, the APS PROCESS (IV) subroutine is executed (S51) which has been stated. This is followed by a step (S52) for incrementing the CO counter by 1 and determining whether or not the copying operation with the current document has been completed (copy end). If the answer of the step S52 is NO, the APS PROCESS (IV) subroutine is repeated. If the answer of the step S52 is YES, whether or not the RDH 10 is producing a document end signal is determined. This is followed by the same routine as the processing which begins at (E).

SIXTH CONTROL OPERATION

Figure 22:
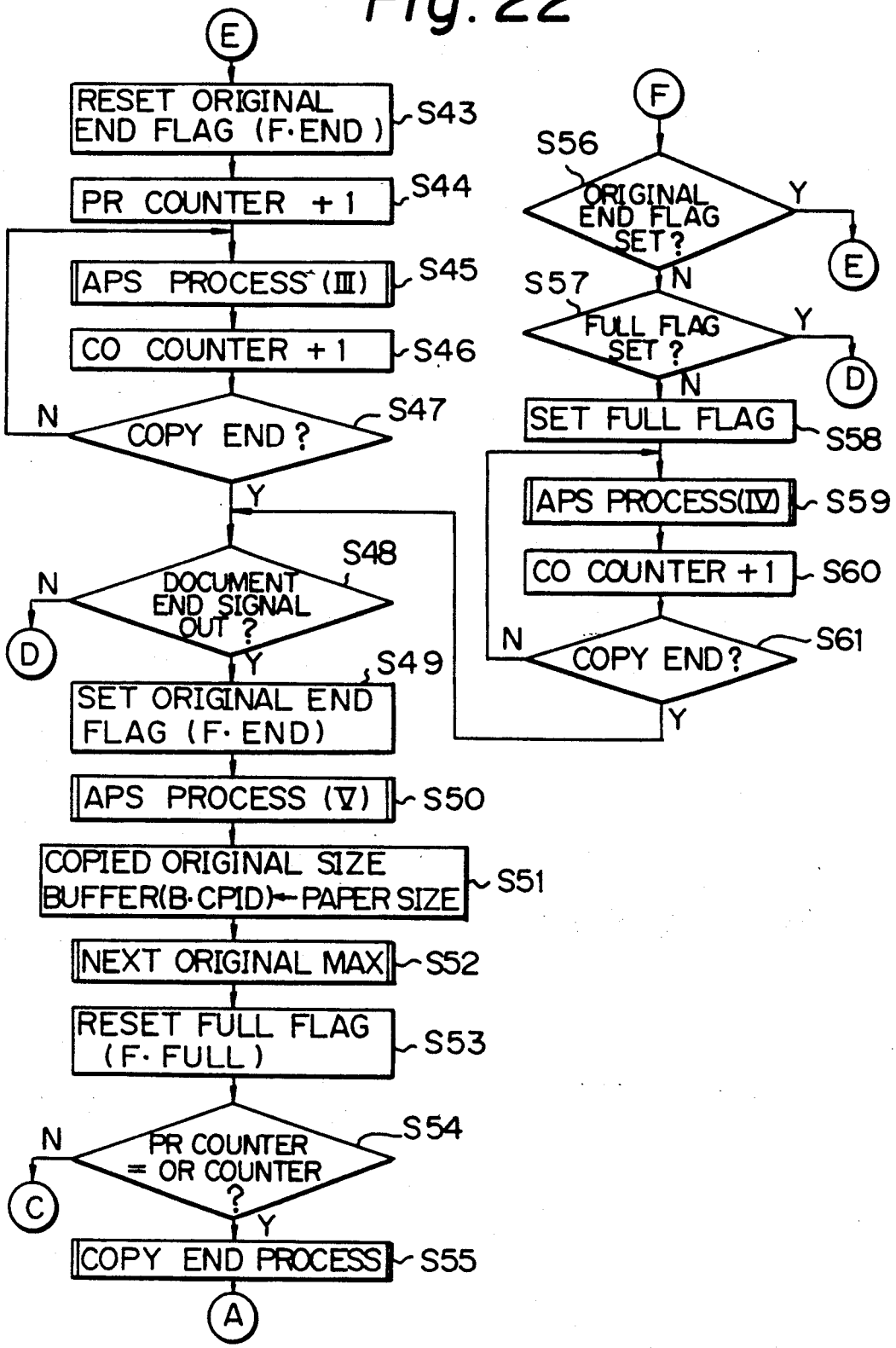

If the answer of the step S15 shown in FIG. 16 is YES, processing which begins at (B) OF FIG. 20A is executed. That is, this control operation is the same as the fourth control operation so far as the steps S20 to S44 are concerned. If the answer of the step S43 shown in FIG. 20A is NO, the document size data newly taken in from the RDH 10 is compared with the paper size data (original size) being stored in the paper size buffer and, if the former is coincident with the latter, processing which begins at (E) of FIG. 22 is executed. If they do not compare equal, processing beginning at (F) of FIG. 22 is executed.

In the flow beginning at (E) of FIG. 22, the original end flag (F.END) which is set every time the RDH 10 delivers a document end signal is reset (S43). After the PR counter has been incremented by 1 (S44), the APS PROCESS (III) subroutine is executed. Then, the CO counter is incremented by 1 (S46). This is followed by a step S47 for determining whether or not the content of the CO counter is coincident with the copy number data which has been set by the KEY INPUT CHECK subroutine of FIG. 16, i.e., whether or not the copying operation with the current copy has been ended (copy end). If the answer is NO, the APS PROCESS (III) subroutine is repeated. If the answer is YES, whether or not the RDH 10 is producing a document end signal is determined (S48). If the answer of the step S48 is NO, the program returns to the INTERRUPT COUNTER INITIALIZE subroutine (D) of FIG. 20A while, if it is YES, the original end flag (F.END) is set (S49).

This is followed by a step (S50) for executing the APS PROCESS (V) which is adapted to discharge all of the copied paper sheets PD being temporarily stacked on the intermediate plate of the two-side unit 23. Then, paper size data stored in the paper size buffer (B.PAPER) is transferred to the copied original size buffer (B.CPID), followed by the next step S51. The NEXT ORIGINAL MAX subroutine is executed (S52) to select size data next to the paper size data being set in the paper size buffer (B.PAPER) out of the original size list of FIG. 20C and is written in the paper size buffer (B.PAPER). Then, the full flag (F.FULL) indicative of the fact that copied paper sheets are temporarily stacked is reset (S53). In this condition, the PR counter and OR counter are compared (S54). If they do not compare equal, the program returns to OR COUNTER CLEAR (C) of FIG. 20A while, if they compare equal, the COPY END PROCESS subroutine is effected (S55). The step S55 is followed by the KEY INPUT CHECK subroutine (A) of FIG. 16 to prepare for next copying.

In the flow beginning at (F) of FIG. 22, whether or not the original end flag (F.END) has been set is determined (S56) and, if the answer is YES, the operation is transferred to (E). If the answer of the step S56 is NO, whether or not the full flag (F.FULL) has been set is determined (S57). If the answer of the step S57 is YES, the program returns to the INTERRUPT COUNTER INITIALIZE subroutine (D) of FIG. 20A while, if it is NO, the full flag (F.FULL) is set (S58) and the APS PROCESS (IV) subroutine is executed (S59). Then, the CO counter is incremented by 1 (S60) to see if the copying operation with the current document has been completed (copy end) (S61). If the answer of the step S61 is NO, the APS PROCESS (IV) subroutine is repeated while, if it is YES, whether or not the RDH 10 is producing a document end signal is determined. This is followed by the same routine as the processing which begins at (E).

Figure 23:
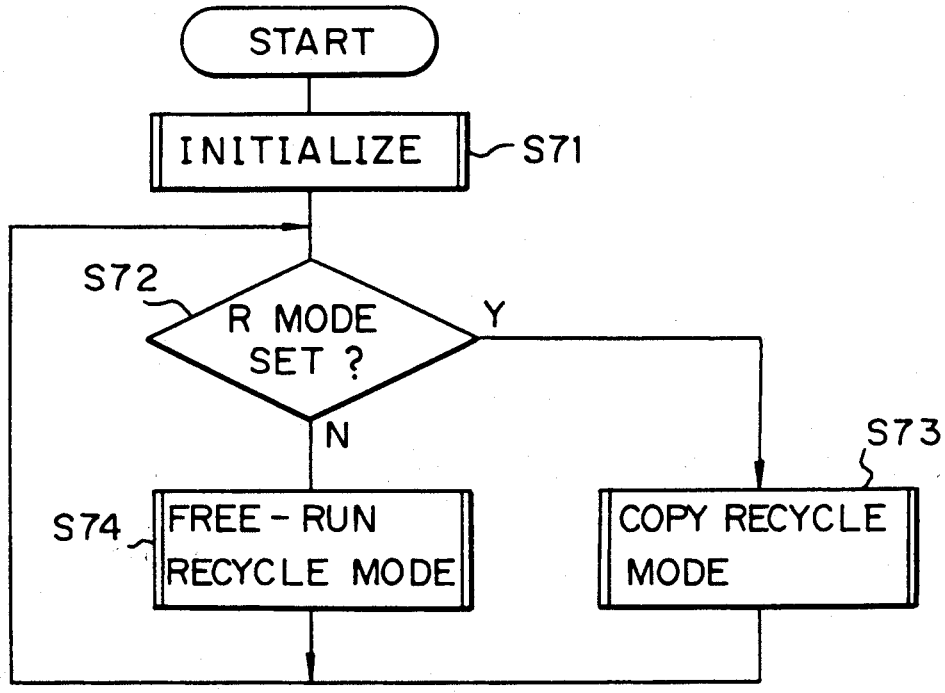
FIGS. 23, 24 and 25 are flowcharts demonstrating specific operations of the RDH control unit.
Figure 24:
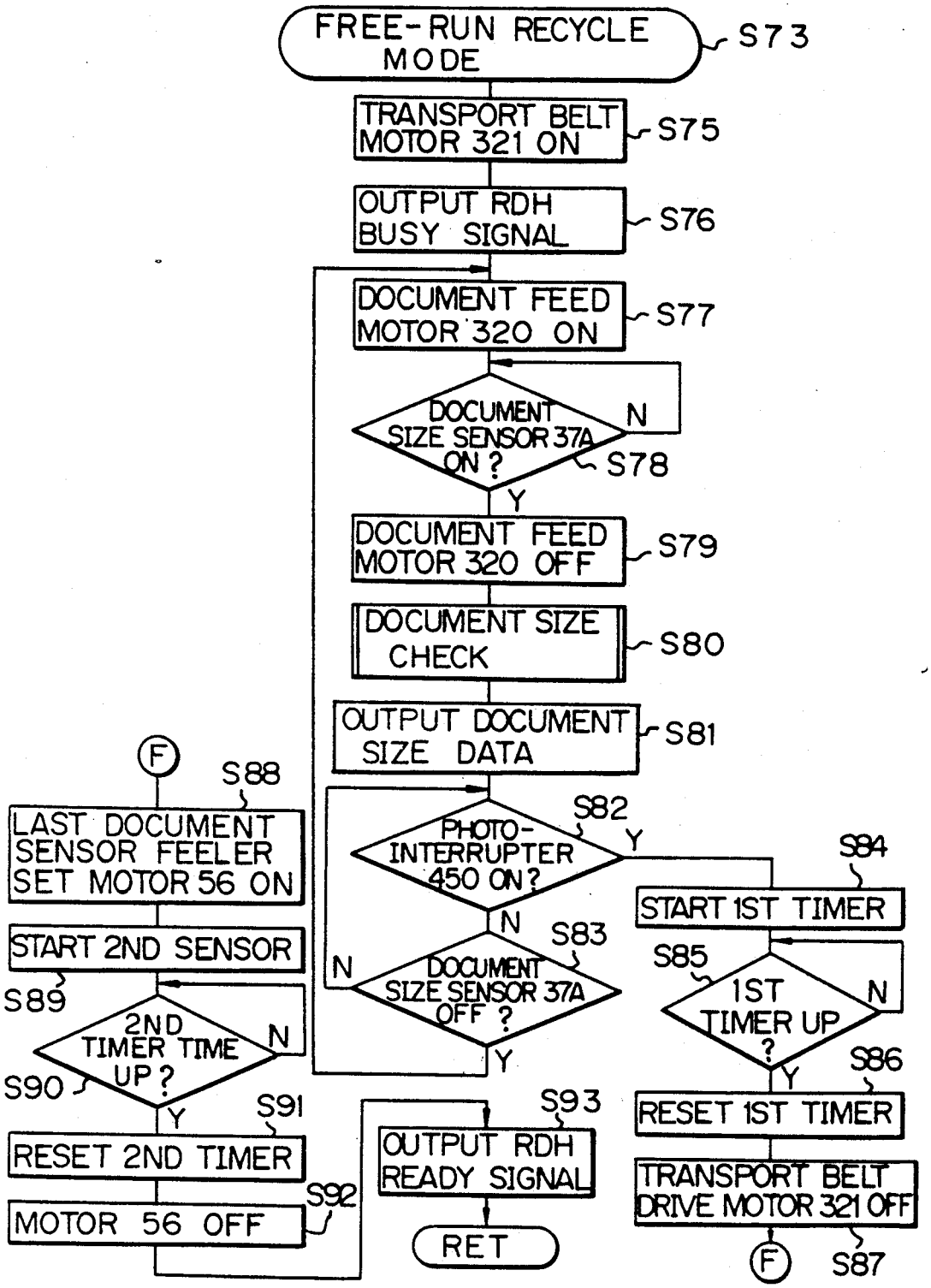
Figure 25:
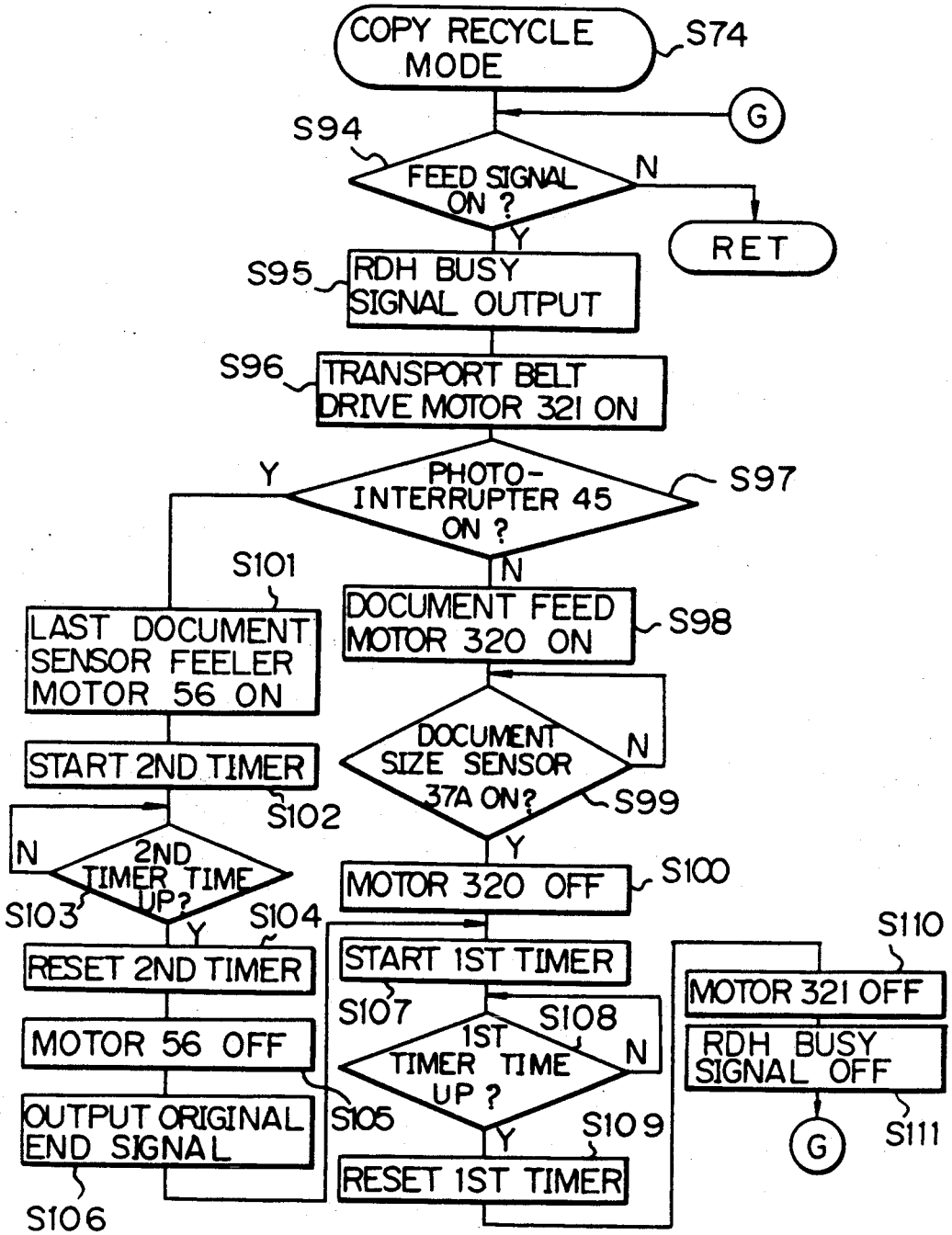

Reference will be made to FIGS. 23 to 25 for describing specific control operations of the RDH control unit 300 over the RDH 10.

Referring to FIG. 23, the main flow of RDH control is shown. As the main switch 41 of the copier body is turned on, DC voltages (+5 volts and +24 volts) are fed from the power supply section 201 to the main controller 301 of the RDH control unit 300, as shown in FIG. 12. In response, the main controller 301 starts on the control program. First, the controller 301 executes an INITIALIZE subroutine (S71) for setting initial data and modes which are necessary for the control over the RDH 10. Then, whether or not a control mode flag (R.MODE) which is a control signal from the copier body has been set is determined (S72). If the answer of the step S72 is YES, a FREE-RUN RECYCLE MODE subroutine is executed (S73) while, if it is NO, a COPY RECYCLE MODE subroutine is executed (S74). In the free-run recycle mode, documents stacked on the tray 1 of the RDH 10 are sequentially circulated to sense their sizes while sending the sensed sizes to the copier body 20. In this mode, therefore, the copy producing process of the copier body 20 remains deactivated. On the other hand, in the copy recycle mode, documents stacked on the tray 1 are sequentially circulated in response to feed signals which are the document feed control signals fed from the copier body 20, while activating the copy producing process of the copier body 20 in synchronism with the RDH 10.

The two different modes mentioned above will be described in detail hereinafter.

FIG. 24 is a flowchart demonstrating various subroutines associated with the free-run recycle mode. First, the transport belt drive motor 321 is energized (S75), and then an RDH BUSY signal is sent to the copier body 20 to inform the latter of the fact that the RDH 10 is replacing a document (S76). Then, the document feed motor 320 is energized (S77). In the next step S78, whether or not the size sensor 37A has been turned on (i.e. whether it has been sensing a document) is determined (S78). If the answer of the step S78 is NO, the status of the size sensor 37A is repetitively checked. If the answer of the step S78 is YES, a step S79 is executed for deenergizing the document feed motor 320, and then a step S80 or DOCUMENT SIZE CHECK subroutine is executed. In this subroutine, the status of the size sensor 37B is checked to determine a document size. In the subsequent step S81, the sensed document size data is fed to the copier body 20 (S81).

Subsequently, whether or not the photointerrupter of the last document detector 45 (see FIG. 3) has been turned on is determined to see if the last document or last page has been fed out (S82). If the answer of the step S82 is NO, meaning that the presence of a document or documents which have not yet been circulated, the program returns to the processing for turning on the motor 320 after the turn-off of the size sensor 37A (S83). If the answer of the step S82 is YES, a first timer is started (S84). After the time-up of the first timer (S85), the timer is reset (S86) and the motor 321 is deenergized (S87). The first timer is loaded with a time which is long enough for a document to be discharged to the tray 1 (see FIG. 3).

Next, the motor 56 for setting the feeler of the last document sensor 45 is turned on (S88), and then a second timer is started (S89). After the time-up of the second timer (S90), the timer is reset (S91) and the motor 56 is deenergized. (S92). The second timer is loaded with a time which is long enough for the feeler 45a of the sensor 45 to reach the top of the stack of documents being laid on the tray 1. Then, a control signal RHD READY indicative of the end of document replacement in the RDH 10 is sent to the copier body 20 (S93), whereafter the program returns to the main routine shown in FIG. 23.

FIG. 25 indicates the COPY RECYCLE MODE subroutine. This subroutine begins with a step S94 for determining whether or not the copier body 20 has outputted a feed signal, or document replacement request control signal. If the answer of the step S94 is NO, the program returns to the main routine of FIG. 23. If it is YES, a step S95 is executed to feed a RDH BUSY signal to the copier body 20, and then the transport belt drive motor 321 is energized (S96). This is followed by a step S97 for checking the status of the photointerrupter 45c of the last document sensor 45 (S97). If the photointerrupter 45c is not turned on, the document feed motor 320 is energized (S98), then the status of the size sensor 37A is checked (S99), and then the next step S100 is executed as soon as the sensor 37A turns on. In the step S100, the motor 320 is turned off (S100). If the photointerrupter 45c has been turned on as decided in the step S97, the feeler set motor 56 is turned on (S101) and the second timer is started (S102). On the time-up of the second timer (S103), the timer is reset (S104) to deenergize the motor 56 (S105). Then, a document end signal is fed to the copier body 20 (S106), and the first timer is started (S107). On the time-up of the first timer (S108), the timer is reset (S109), then the motor 321 is deenergized (S110), and then the RDH BUSY signal is turned off (S111), whereafter the program returns to the feed signal checking step.

Referring to FIGS. 26 to 29, specific control operations of the finisher control unit 400 over the finisher 30 are demonstrated in flowcharts.

When the main switch 41 of the copier body 20 is turned on, DC voltages (+5 volts and +24 volts) are applied from the power supply section 201 to the main controller 401 of the finisher control unit 400. In response, the main controller 401 starts on the control program. First, in the flowchart of FIG. 26, an INITIALIZE subroutine is executed (S121) for setting initial data and modes necessary for the control over the finisher 30. Next, whether or not the copier body 20 has generated a start signal is determined (S122) and, if the answer is NO, the main motor 450 is deenergized (S123), then the reversible motor 133 associated with the shift roller unit 130 is deenergized (S124), and then the start checking step is repeated. If the answer of the step S122 is YES, whether or not a paper sheet has reached the inlet sensor 24A (i.e. whether or not the sensor 24A has been turned on) is determined (S125). As soon as the sensor 24A turns from OFF to ON, a step S126 is executed.

In the step S126, the first timer is loaded with a particular time TIMA (S126). The time TIMA is long enough to allow the leading edge of a paper sheet to reach the reference position changing unit 25 (see FIG. 1) after it has moved away from the inlet sensor 24A. Next, a register CO counter for counting paper sheets which pass the inlet sensor 24A is incremented (S127). This is followed by a SIZE CHECK subroutine (S128) in which a paper size is identified on the basis of the outputs of the inlet sensors 24A and 24B. Then, a SHIFT ROLLER UNIT 130 CONTROL subroutine is executed (S129). In the next step S130, whether the first timer has counted the desired time TIMA is determined (S130). If the answer of the step S130 is YES, the first timer is reset (S131). In the subsequent step (S132), whether the paper size is A3 or not is determined (S132). If the answer is YES, the operation is transferred to a DISCHARGE SENSOR CHECK subroutine shown in FIG. 27 while, if it is NO, whether or not the right bind mode has been selected is determined (S133). A mode signal representative of the right bind mode is fed from the copier body 20 to the finisher 30 over the control line interface line 207. If the right bind mode has been selected, the operation is transferred to the DISCHARGE SENSOR CHECK routine of FIG. 27. If otherwise, the program returns to the first step of FIG. 27.

Figure 27:
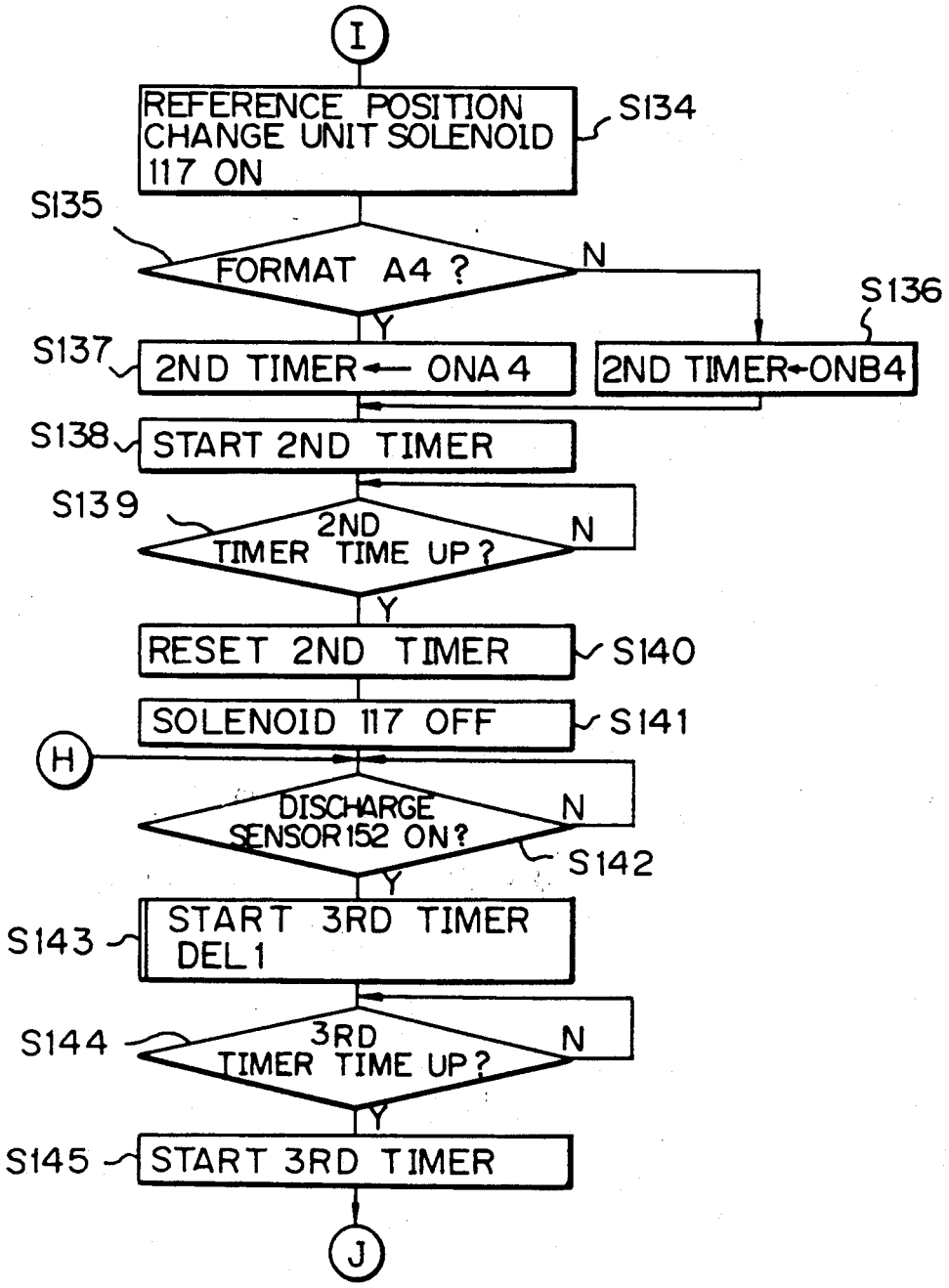
Figure 28:
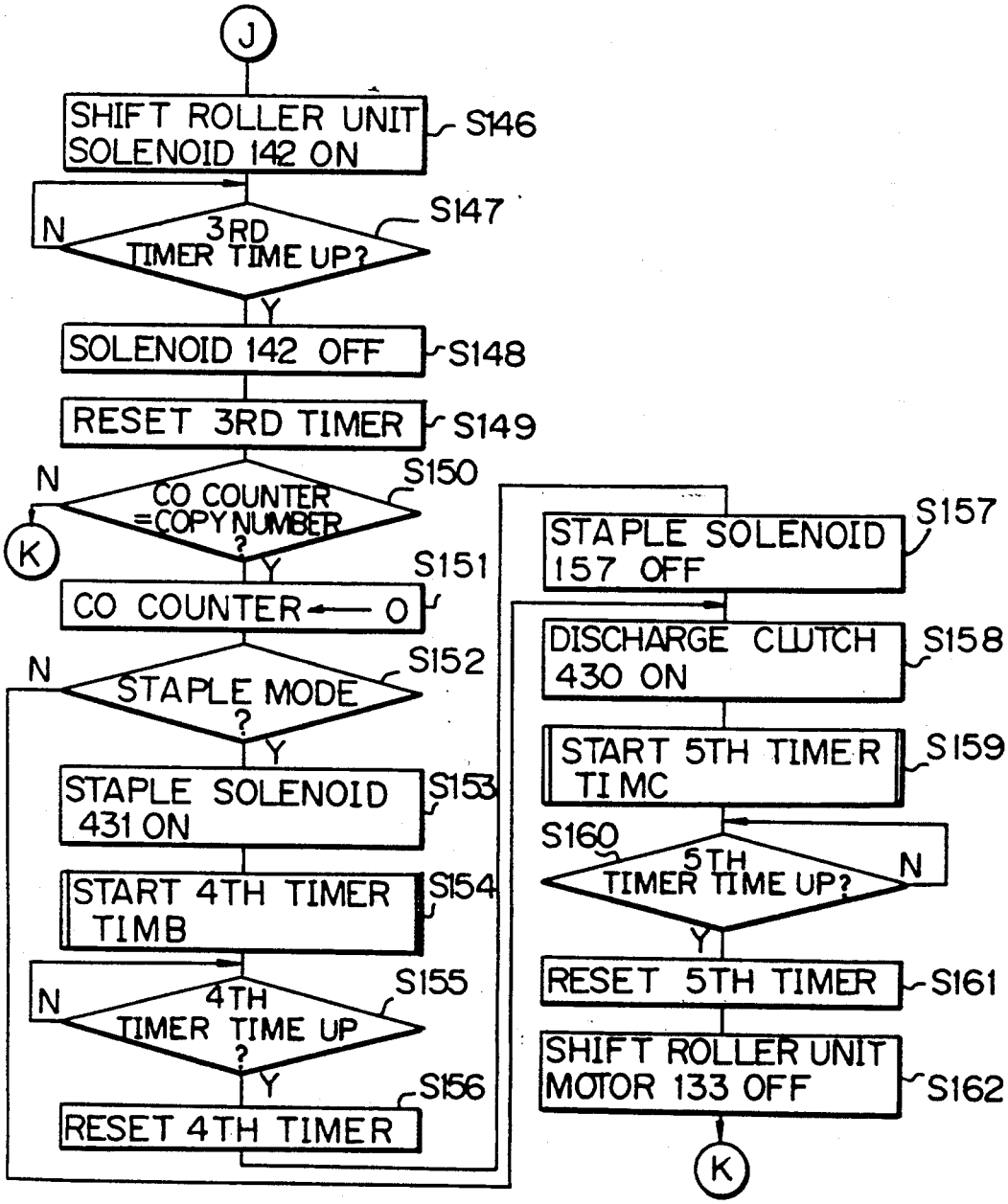

The procedure shown in FIG. 27 begins with a step S134 for energizing the solenoid 117 associated with the reference position changing unit 25. In the next step S135, whether or not the paper size is A4 is determined. If the answer of the step S135 is NO, the second timer is loaded with a particular time ONB4 (S136) and then started (S137). If the answer of the step S135 is YES, the second timer is loaded with another particular value ONA4 (S137) and then started (S138). The times ONB4 and ONA4 are associated with formats B4 and A4, respectively, and are so selected as to promote optimum change of reference. Whether or not the second timer has reached the particular time is determined (S139) and, if the answer is YES, the second timer is reset (S140) and the solenoid 117 is deenergized (S141). By such a procedure, it is possible to accurately control the changeover of reference position size by size. The step S141 is followed by a step S142 for determining whether or not the leading edge of a paper sheet has reached the discharge sensor 152. If the sensor 152 has been turned on, a third timer is loaded with a particular time DEL1 and then started (S143). On the time-up of the third timer as decided in a step S144, the timer is loaded with another particular time DEL2 and then started (S145). This is followed by processing which is shown in FIG. 28. It is to be noted that the particular time DEL2 is long enough for the shift roller unit 130 to be optimally shifted either to the right bind position or the left bind position.

The processing shown in FIG. 28 begins with a step S146 for energizing the solenoid 142 of the shift roller unit 130 (see FIG. 9). On the time-up of the third timer as decided in the following step S147, the solenoid 142 is deenergized (S148), and then the third timer is reset (S149). In the next step S150, whether or not the CO counter or paper counter is coincident with the copy number data is determined (S150). The copy number data is fed from the copier body 20 over the control signal interface line 207. If the answer of the step S150 is NO, the program returns to the START SIGNAL CHECK subroutine of FIG. 26 to repeat the above procedure. If the answer of the step S150 is YES, the CO counter is reset (S151), and whether or not the staple mode has been selected is determined (S152). A staple mode signal is fed from the copier body 20 over the control signal interface line 207. When the staple mode has been selected, the staple solenoid 431 is energized (S153), and a fourth timer is loaded with a particular time TIMB and then started (S154). The time TIMB is long enough for a bundle of copied paper sheets to be stapled together.

On the time-up of the fourth timer as decided in a step S155, the timer is reset (S156), the staple solenoid 431 is deenergized (S157), and the discharge clutch 430 is coupled (S158). If the staple mode is not selected, the program directly skips to the step of coupling the discharge clutch 430. Thereupon, a fifth timer is loaded with a particular time TIMC and then started (S159). The time TIMC is long enough for a stapled set of copied paper sheets to be discharged to the tray as shown in FIG. 1. On the time-up of the fifth timer as decided in the next step S160, the timer is reset (S161), and the reversible motor 133 of the shift roller unit 130 is deenergized (S162), and the program returns to the START SIGNAL CHECK subroutine of FIG. 22.

Figure 26:
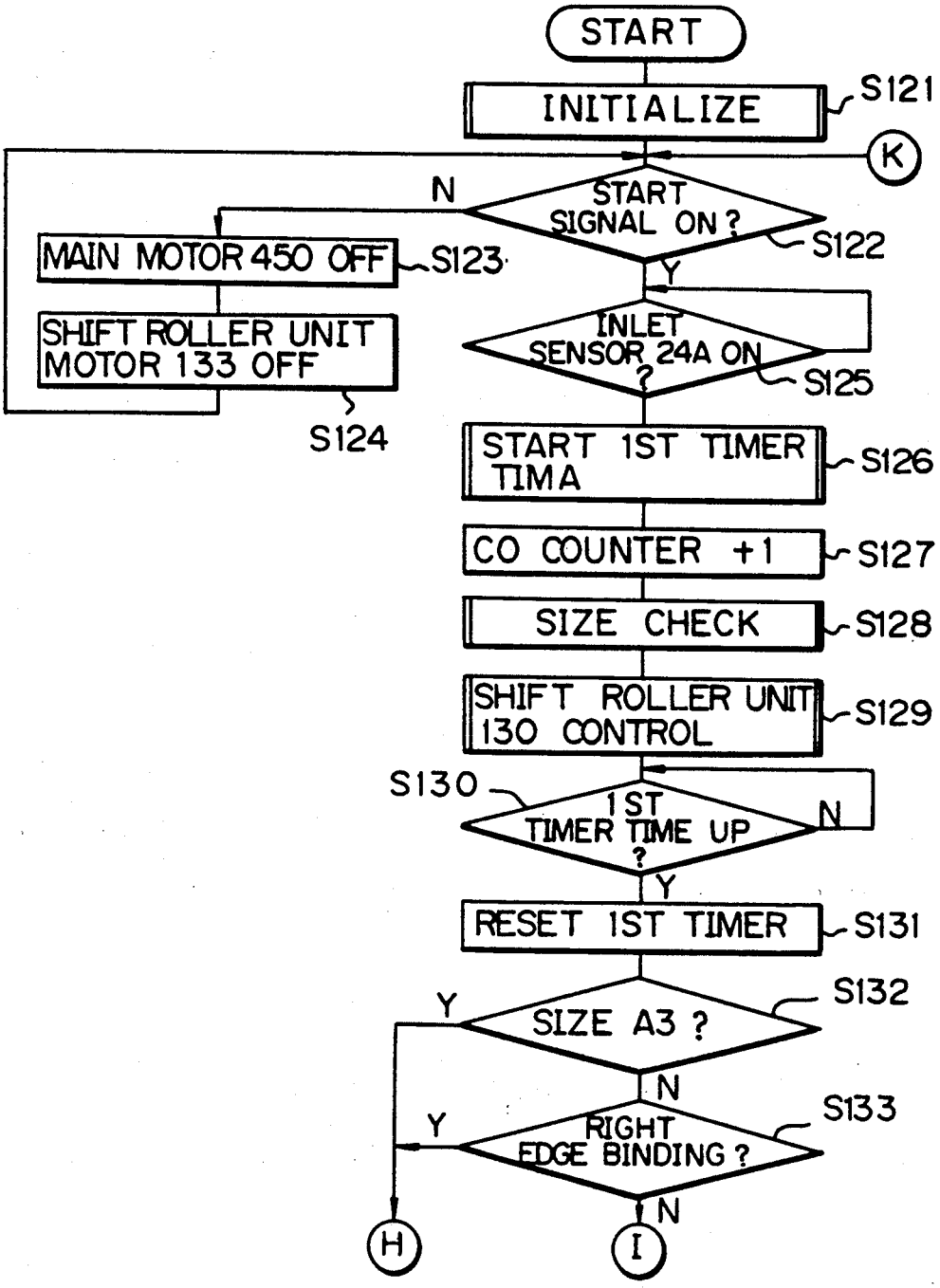
FIGS. 26, 27, 28 and 29 are flowcharts representative of specific operations of the finisher control unit.
Figure 29:
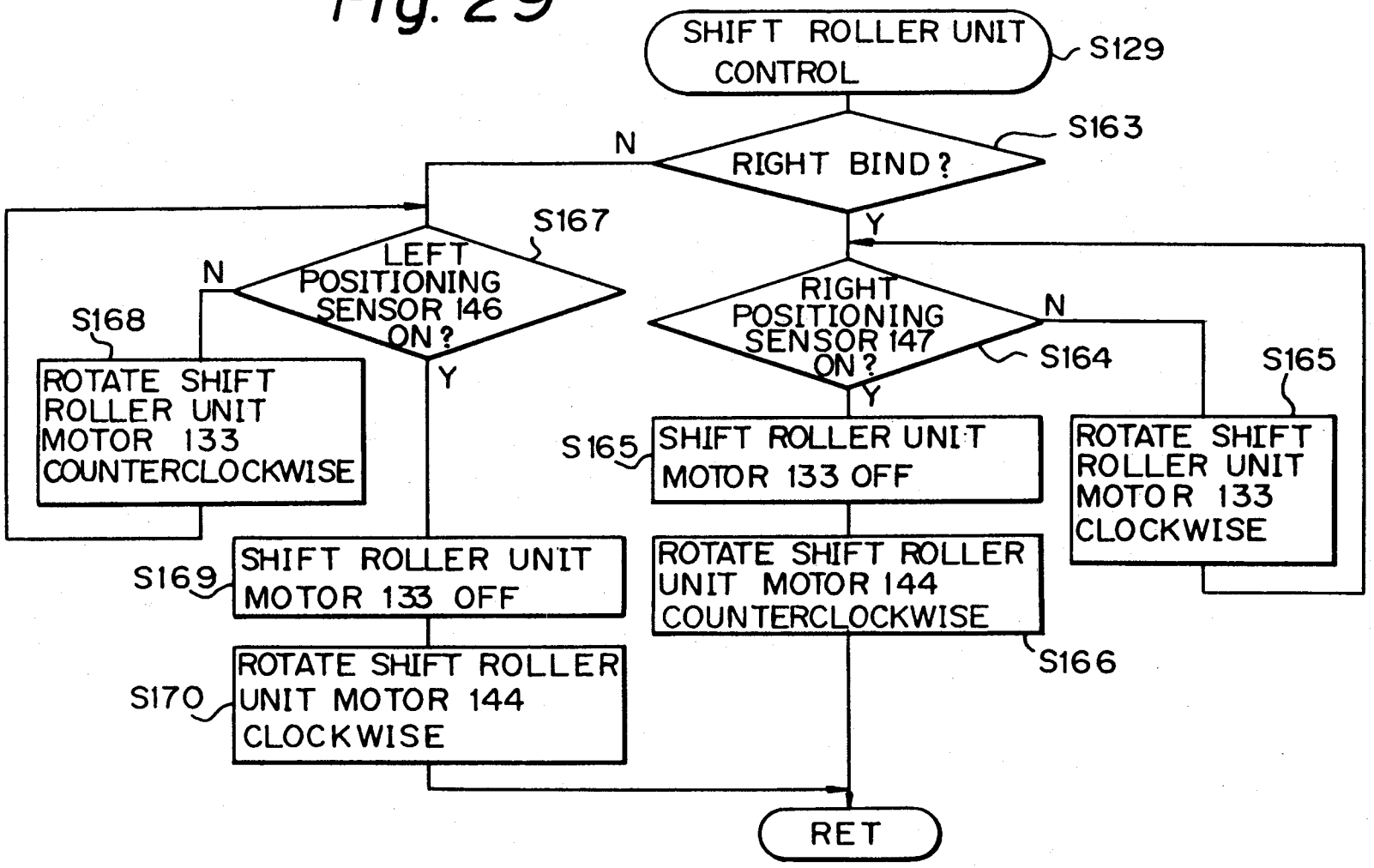

FIG. 29 demonstrates the details of the processing shown in FIG. 26. This subroutine is adapted to change the reference position of the shift roller unit 130 depending upon the binding position of copied paper sheets. Specifically, whether or not copied paper sheets, or copies, are to be bound at the right edge is determined (S163) and, if the answer is YES, whether or not the right positioning sensor 147 has been turned on is determined (S164). If the answer of the step S164 is NO, i.e., if the shift roller unit 130 does not assume the reference position for right edge binding, the reversible motor 133 associated with the unit 130 is rotated clockwise (S165), and then the status of the right positioning sensor 147 is checked again (S164). If the sensor 147 has been turned on, the motor 133 is deenergized (S165), then the other reversible motor 144 is rotated counterclockwise (S166), and then the program returns to the main routine shown in FIG. 26. If paper sheets are not to be bound at the right edge, whether or not the left positioning sensor 146 has been turned on is determined (S167). If the answer of the step S167 is NO, meaning that that the shift roller unit 130 is not located in the reference position for left edge binding, the reversible motor 133 is rotated counterclockwise (S168), and then the left positioning sensor 146 is checked again (S167). If the sensor 146 has been turned on, the motor 133 is deenergized (S169), then the other motor 144 is rotated clockwise (S170), and then the program returns to the main routine of FIG. 26.

The first to sixth control operations available with the first embodiment of the copier in accordance with the present invention as stated above will be summarized together with advantages attainable therewith.

(1) As regards the first control operation, assume that documents of different sizes are stacked on the RDH 10 randomly. When the RDH 10 feeds the first document to the exposing station on the copier body 20 after the start of a copying operation, the document sensor 37 senses its size. Thereafter, while all the documents are circulated once, the copier body 20 performs the copy process with only those documents whose size is the same as the sensed size; documents having the other sizes are simply returned to the set position on the RDH 10 without being copied. While the stack of documents of different sizes are circulated again, the copier 20 copies only those documents having the same size as the second size which will be sensed by the document sensor 37; the other documents are again simply returned to the set position on the RDH 10. Such processing is repeated a particular number of times associated with the kinds of the documents. Every time copies are produced with all the documents having the same size, the finisher 30 binds and discharges the resulting copied paper sheets. Hence, bound sets of copies which have been sorted on a document size basis are produced automatically. This eliminates the need for extra labor otherwise needed to rearrange documents of different sizes before loading them on an RDH. This advantages holds true with all the other control operations also.

(2) As regards the second control operation, when documents of two different sizes are stacked on the RDH 10 randomly, the document sensor 37 senses the document sizes while the RDH 10 sequentially transports the documents toward the exposing station on the copier body 20. The copier body 20 reproduces the documents on paper sheets of a particular size matching the size of the documents. Copies produced with the documents the size of which has been sensed first are immediately transferred from the copier body 20 to the finisher 30, while copies produced with the other documents whose size has been sensed later are temporarily stacked on the intermediate tray inside the copier body 20 and then transferred from the copier body 20 to the finisher 30. The finisher 30, therefore, binds and discharges the introduced copies of the first size when the copier body 20 ends its copying operations and, thereafter, receives the copies of the second size and binds and discharges them. This allows bound sets of copies to be produced automatically after being sorted on the basis of the document size, simply by circulating all the documents once. Hence, it is not necessary to recycle documents many times on the RDH 10. This minimizes the damage to the documents as well as the deterioration of the belt and feed roller while reducing the contamination of the document transport paths, especially the contamination of the glass platen 3 and transport belt 39 (FIG. 3) which would lead to the degradation of reproduced images. With this control operation, although the copier is not operable when documents of three or more different sizes are stacked together on the RDH 10, it is still useful because two document sizes are generally predominant, such as A4 and A3 in Europe and Japan, B5 and B4 in Japanese government and municipal offices, and letter size and legal size in U.S.A. . While copies have been shown and described as being stacked on the intermediate tray of the two-side unit, they may of course be stacked on any other document refeeding device installed in the copier body, e.g. an intermediate tray of a combination copy unit.

(3) Concerning the third control operation, when three different sizes of documents are stacked on the RDH 10 randomly, the document sensor 37 senses the document sizes while the RDH 10 sequentially transports the documents to the exposing position on the copier body 20. While all the documents are circulated by the RDH 10 for the first time, the copier body 20 reproduces only the documents having the first and second sizes sensed in sequence on paper sheets whose sizes are associated with those documents. Copies of the documents having the first size are immediately discharged, while copies of the documents of the second size are temporarily stacked on an intermediate tray available in the copier body 20. After all the documents have been circulated through the RDH 10, the stacked copies of the second size are discharged. During the second ciculation of the documents through the RDH 10, the copier body 20 copies the documents having the third and fourth sizes which are sensed in sequence by the document sensor 37, and copies of the documents of the third size are immediately discharged while copies of the documents of the fourth size are temporarily stacked on the intermediate tray. After all the documents have been circulated through the RDH 10, the stacked copies of the fourth size are bodily discharged.

In this manner, documents of two different sizes are sequentially reproduced every time all the documents are circulated through the RDH 10. Every time all the documents are circulated by the RDH 10, the finisher binds and discharges the copies which it has received from the copier body 20. Hence, bound sets of copies of two different sizes individually associated with documents of two different sizes are produced automatically every time all the documents are circulated. This procedure is repeated to automatically produce bound sets of copies with all the documents having different sizes. Such a procedure can be implemented with a minimum number of times that the RDH 10 recycles documents, whereby the damage to documents and the deterioration of the belt and feed roller are reduced. In addition, the document transport paths and, especially, the glass platen 3 and transport belt 39 (FIG. 3) which have critical influence on the image quality are free from noticeable contamination. Again, the intermediate tray used to stack copied paper sheets within the copier body 20 may be replaced with any other document feeding device, e.g. an intermediate tray of a combination copy unit.

(4) As regards the fourth control operation, when the copier starts operating with documents of different sizes being loaded on the RDH 10, the RDH 10 circulates all the documents once so as to cause the document sensor 37 to sense the sizes of all the documents. While all the documents are circulated once, the documents having the largest size or the smallest size are reproduced with the other documents being simply returned to the tray 1. Such processing is repeated with all the documents in the order of size. Every time the documents of one size are reproduced in the order of size as stated, the finisher 30 binds and discharges the resulting copies which it receives. Hence, bound sets of copies are automatically produced in association with the size of documents. Further, since the bindings are completed in the order of document size and sequentially stacked on the tray 27, stable stacking is enhanced and a binging of comparatively small size is prevented from being hidden by another binding of a comparatively large size.

(5) As regards the fifth control operation, when the copier starts operating with documents of two different sizes stacked on the RDH 10 randomly, the RDH 10 circulates all the documents once while causing the document sensor 37 to sense their sizes. Then, the RDH 10 again circulates all the documents through an exposing station one after another, while the copier body 20 reproduces the documents on paper sheets the sizes of which are individually associated with the document sizes. The resulting copies of first or larger size are discharged immediately, while the copies of the second or smaller size are temporarily stacked on the intermediate tray 23 of the two-side unit 23. After all the copies have been reproduced, the copies of the second size sequentially stacked on the intermediate tray are discharge. When the copier body 20 ends its copying operation, the finisher 30 binds and discharges the copies which it has received and, then, binds and discharges the copies of the second size which come in after the documents of the first size. In this manner, the copies of different sizes are bound on the size basis. Moreover, since a bound set of copies of larger size is discharged from the finisher 30 to the tray 27 first and, then, a bound set of copies of smaller size is discharged, the bindings are neatly stacked on the tray 27 and can be confirmed with ease. By circulating all the documents to sense their sizes beforehand and then starting a copying operation, it is possible to determine whether to use the same copy size as the current copy size for next copying or to change it beforehand. This is successful in reducing the time needed for manipulations when the number of documents or that of desired copies is large. With this control operation, although the copier is not operable when documents of three or more different sizes are stacked together on the RDH 10, it is still useful because two document sizes are generally predominant, such as A4 and A3 in Europe and Japan, B5 and B4 in Japanese government and municipal offices, and letter size and legal size in U.S.A. Again, the intermediate tray of the two-side unit used to stack copies may be replaced with any other suitable document refeeding device such as an intermediate tray of a combination copy unit or an exclusive intermediate tray.

(6) As regards the sixth control operation, when the copier starts operating with documents of different sizes being stacked on the RDH 10 randomly, the RDH 10 circulates all of the documents once while causing the document sensor 37 to sense all of the different document sizes. Thereafter, while the RDH 10 circulates all the documents once, the copier body 20 reproduces only the documents having the largest and second-largest sizes on paper sheets which are individually associated in size with the documents. Copies associated with the largest document size are discharged immediately, while copies associated with the second-largest document are temporarily stacked on the intermediate tray of the two-side unit 23 and, then discharged after the circulation of all of the copies. Such a sequence of operations is repeated with all the documents in the order of size. Every time the RDH 10 ends the circulation of all the documents, the finisher 30 binds and discharges copies which it has received and, thereafter, receives copies having been stacked in the copier body 20 to bind and discharge them. Hence, bound sets of copies are obtained on a size basis. Furthermore, a binding associated with the largest document size is discharged from the finisher 30 to the tray 27 first. This allows the bindings to be stacked neatly and stably on the tray 27 without jamming the outlet of the finisher and to be confirmed with ease. In addition, since the sizes of all the documents are sensed and memorized before the start of actual copying operations, whether to use the same copy size as the current copy size for the next copying or to change it can be determined beforehand. This reduces the time needed for manipulations when the number of documents or desired copies is large. If desired, the intermediate tray of the two-side unit used to stack copies may be replaced with any other suitable document refeeding device installed in the copier, e.g. an intermediate tray of a combination copy unit or an exclusive intermediate tray.

Reference will be made to FIGS. 30 to 44C for describing a second embodiment of the control which is performed by the control section of the document recycling copier.

SECOND EMBODIMENT

Figure 30:
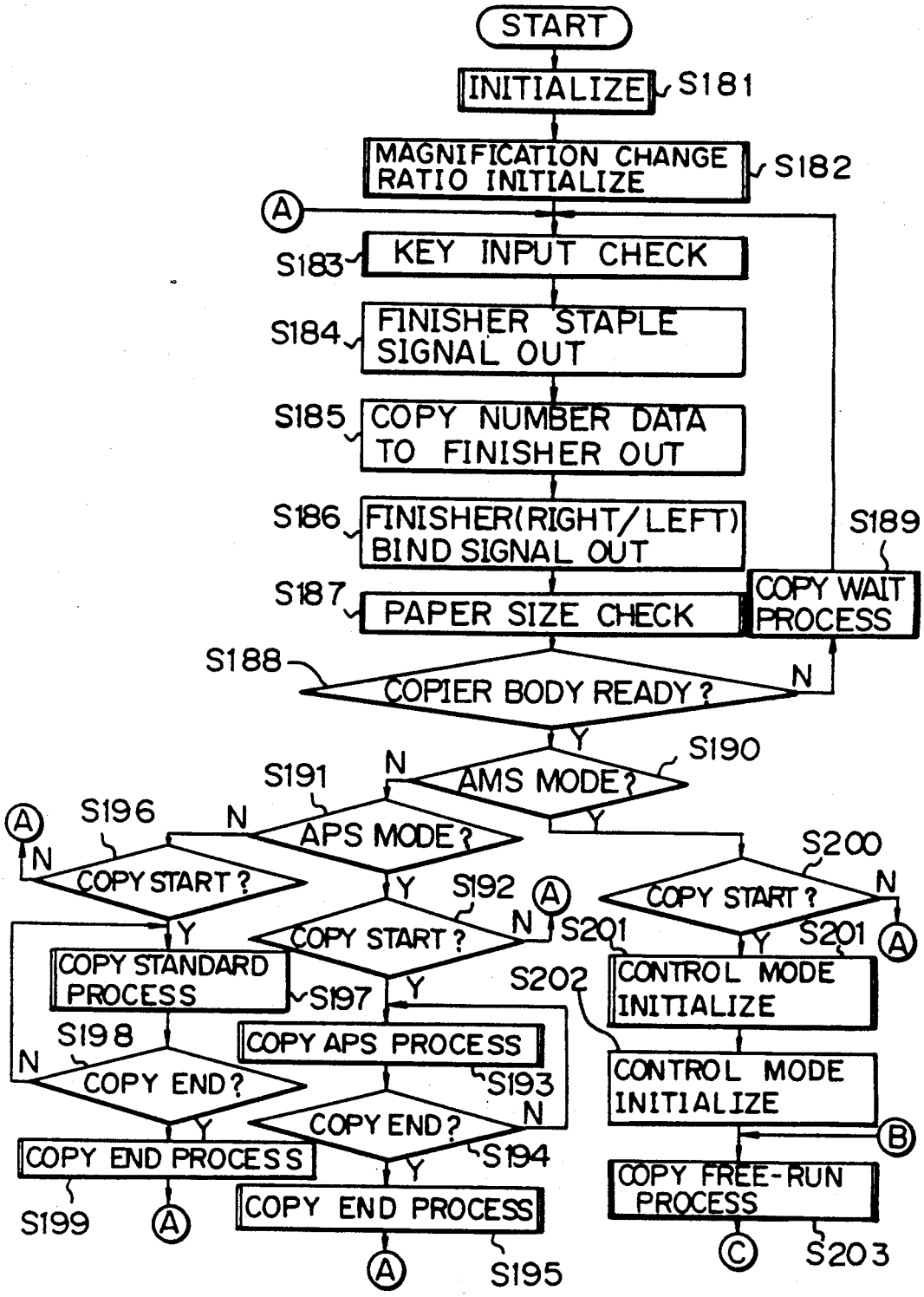
FIGS. 30 and 31 are flowcharts demonstrating a second embodiment of the control operations as performed by the copier body.
Figure 31:
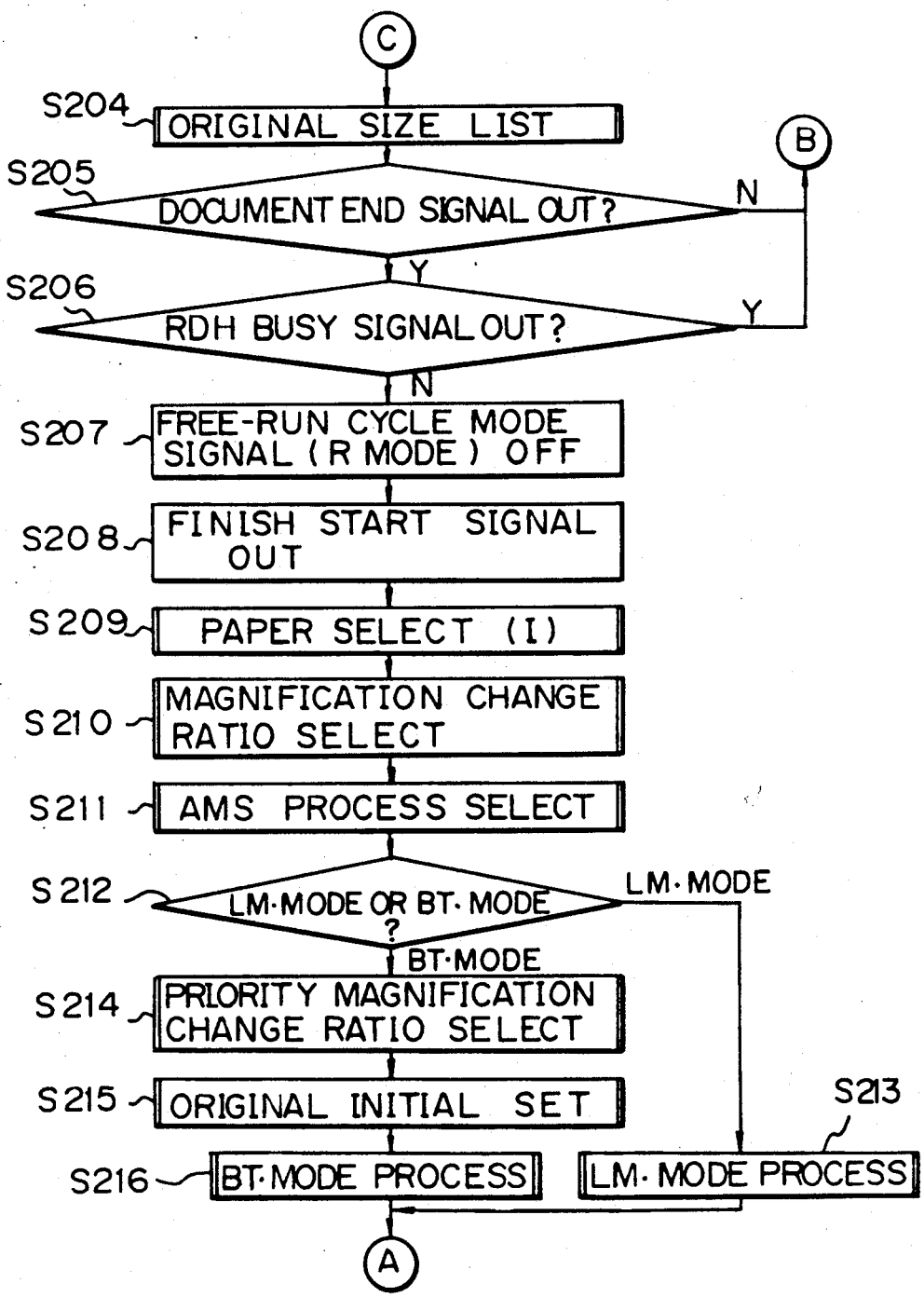

Referring to FIGS. 30 and 31, a main routine assigned to the copier body 20 is shown. When the main switch 41 of the copier body 20 is turned on, a current adapted for control is fed from the power supply section 201 to the main controller 210. In response, main controller 210 starts on the control program. This program begins with a step S181 for executing an INITIALIZE (I)

subroutine, i.e., for setting initial data and modes necessary for control. The step S181 is followed by a step S182 or MAGNIFICATION CHANGE RATIO INITIALIZE subroutine which sets an initial magnification (e.g. 100%). Thereafter, a KEY INPUT CHECK subroutine is executed (S183) to check the status of each of the keys which are included in the key section **41*b* of the operation board 40, whereby input data and modes are determined. Then, a staple signal associated with the finisher 30 is delivered (S184), then copy number data is fed to the finisher 30 according to the result of KEY INPUT CHECK subroutine (S185), then a signal representative of right edge binding or left edge binding is sent to the finisher 30 (S186), and then a PAPER SIZE CHECK subroutine is executed (S187). In this step S187, the outputs of the paper size sensors 77A and 77B which are associated with each of the paper cassettes 2A to 2C are checked to determine the sizes of paper sheets being loaded in the cassettes. In the next step S188, various conditions of the copier body 20 are set up and, then, whether the copier body 20** is ready to operate is determined.

If the answer of the step S188 is NO, a COPY WAIT PROCESS subroutine is executed (S189) for controlling the waiting condition of the copier body 20, and then the program returns to the step S183. If the answer of the step S188 is YES, whether or not the AMS mode has been selected is determined (S190). If the answer of the step S190 is NO, whether or not the APS mode has been selected is determined (S191). If the APS mode has been set, a step S192 is executed to see if a copying operation has started, i.e., whether or not the print key 42 has been turned on. If the answer of the step S192 is NO, the program returns to (A) which immediately precedes the step S183. If the answer of the step S192 is YES, a COPY APS PROCESS subroutine is executed (S193) for effecting the APS copy mode. Whether or not copying in the APS copy mode has ended is determined in a step S194 and, if it has not ended, the step S193 is repeated. If it has ended, a COPY END PROCESS is executed (S195), the program then returning to (A). If the answer of the step S191 is NO, whether a copying operation has started with the print start key 42 having being turned on is determined (S196). If the answer of the step S196 is NO, the program returns to (A) while, if it is YES, a COPY STANDARD PROCESS subroutine is executed (S197) for effecting copying in an ordinary copy mode. When copying is ended as decided in a step S198, a COPY END PROCESS subroutine is executed (S199) and the program returns to (A). On the other hand, when the AMS is selected as determined in the step S190, whether a copying operation has started with the print key 42 being turned on is determined (S200). If the answer of the step S200 is NO, the program returns to (A) while, if it is YES, a CONTROL MODE INITIALIZE subroutine is executed (S201) so as to initialize control data and modes necessary for the AMS copy mode. In a step S202, a free-run recycle mode signal (R-MODE) is fed to the RDH 10. Then, a COPY FREE-RUN PROCESS subroutine is executed (S203), whereafter the operation is transferred to an ORIGINAL SIZE LIST subroutine (S203, FIG. 31). While the step S203 executes a wait mode control over the copier body 20 during the free-run recycle mode operation, the step S204 prepares an original list which has been described in relation with the first embodiment.

After the original list has been prepared, whether or not a document end signal which may be fed from the photointerrupter **45*c* of the RDH 10 via the input buffer 316 of the RDH main controller 301 is present is determined (S 205). If the answer of the step S205 is NO, the program returns to (B) of FIG. 30 (immediately preceding the step S203) while, if it is YES, whether or not the RDH 10 has generated a BUSY signal is determined (S206). If the answer of the step S206 is YES, i.e., if the replacement of a document is under way in the RDH 10, the program returns to (B); if otherwise, i.e., if the RDH 10 has prepared a document D, the free-run recycle signal (R-MODE) is turned off (S207), then a start signal is sent to the finisher 30 (S208), and then a PAPER SELECT (I) subroutine is executed (S209) for selecting a paper sheet on the basis of a set mode which will be described. In the next step S210, a MAGNIFICATION CHANGE RATIO SELECT subroutine is executed (S210) for selecting two different magnification change ratios associated with documents D, as described in detail later. Further, an AMS PROCESS SELECT subroutine which will also be described is executed (S211) to select either one of an LM mode and a BT mode which is shorter than the other with respect to the copy processing time, according to predetermined conditions. The LM and BT modes will be described later. When the LM mode is selected as decided in the step S212, an LM MODE PROCESS subroutine is executed (S213**) and the program returns to (A).

When the BT mode is selected in the step S212, a PRIORITY MAGNIFICATION SELECT subroutine which will be described is executed (S214) so as to select one of the two magnification change ratios as selected by the step S210 which is to be executed first, according to predetermined conditions. Then, an ORIGINAL INITIAL SET subroutine which will be described is executed (S215) to operate the RDH 10 such that a document D matching the magnification selected by the step S214 is laid on the glass platen 3. This is followed by a step S216 for executing a BT MODE PROCESS subroutine which will also be described. Thereupon, the program returns to (A) to prepare for next copying.

What is most important with the second embodiment is how to select a paper size and a magnification change ratio which match the size of a document D. For the selection of a paper size, two different modes are available: a major size select mode in which a major document size greater in number than the others is used as a reference, and a medium size select mode in which a medium document size is used as a reference.

Figure 32:
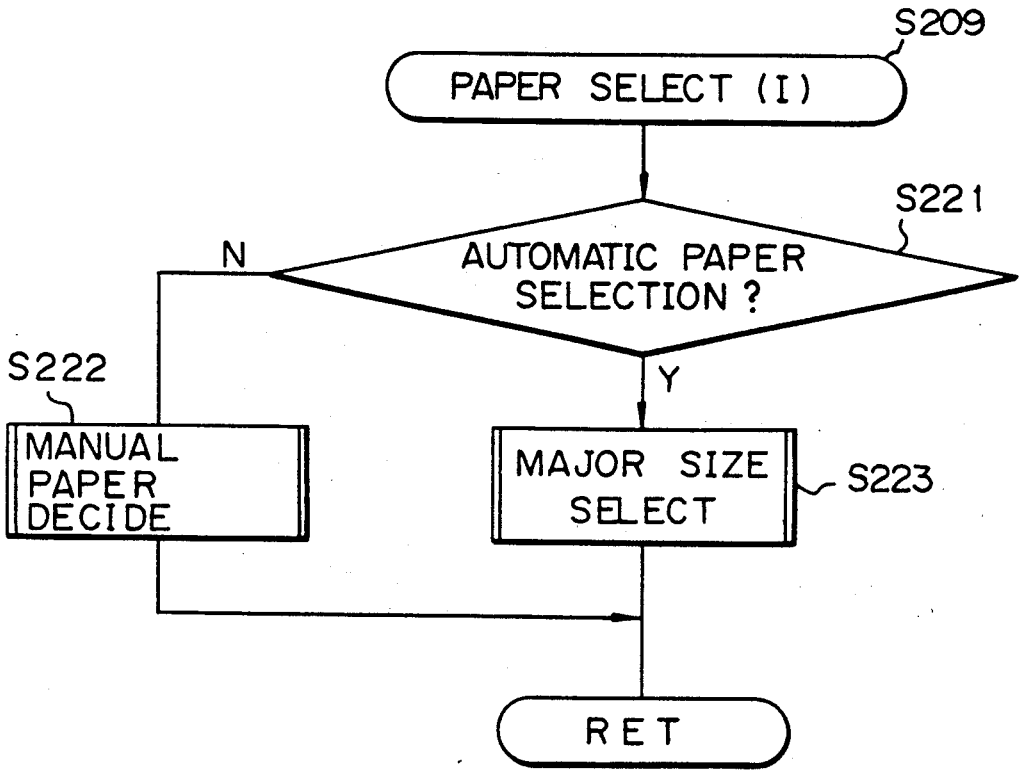
FIG. 32 is a flowchart showing a specific example of a PAPER SELECT (I) subroutine.

The major size select mode will be described first. FIG. 32 shows a subroutine associated with the major size select mode which is included in the step S209 of FIG. 31. As shown, whether or not the APS mode has been selected is determined (S221). If the answer of the step S221 is NO, a MANUAL PAPER SELECT subroutine is executed (S222) to select any of the paper sheets PA, PB and PC which has been manually selected on the paper key 44. If the answer of the step S221 is YES, a MAJOR SIZE SELECT subroutine is executed (S223). The "major size select" implies a procedure wherein a major size of documents D is selected out of the original list, or original size data, which is shown in FIG. 35, and paper sheets of the same size as the major document size are selected. It is to be noted that when documents of two different sizes are present, the largest document size may be selected while, when documents of thee different sizes are present, the intermediate document size may be selected. The original list is prepared by sequentially memorizing the document sizes which are read by the document sensor 37 of the RDH 10, in the stacking order.

Figure 33:
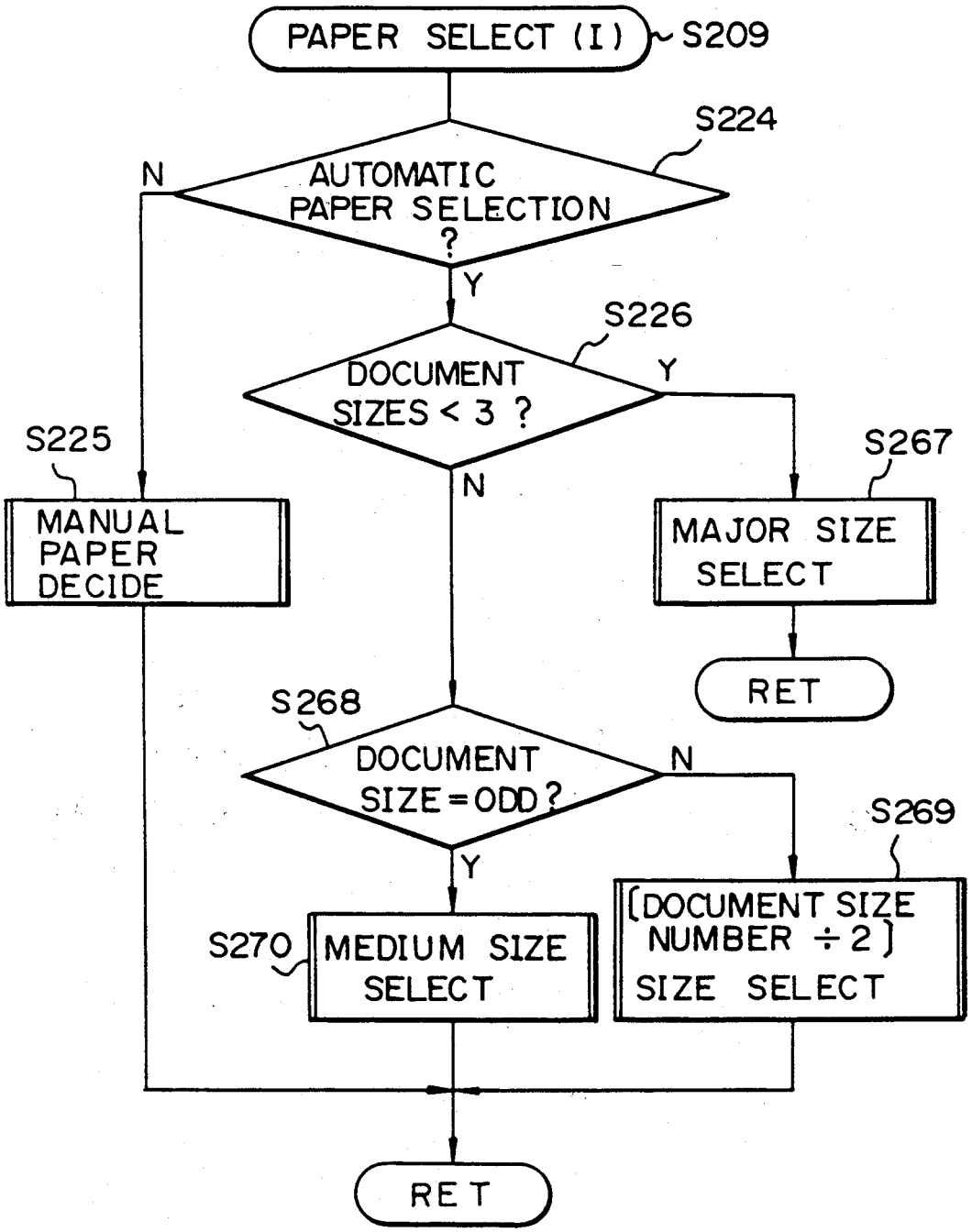
FIG. 33 is a flowchart showing another example of the PAPER SELECT (I) subroutine.

As shown in FIG. 33, in the medium size select mode, whether or not the APS mode has been selected is determined (S224) and, if the answer is NO, the MANUAL PAPER SELECT subroutine is executed (s225) as in the majority size select mode. If the answer of the step S224 is YES, a step S226 is executed to determine whether or not three or more different document sizes are present, by referencing the original size list. If the answer of the step S226 is NO, e.g., if only two document sizes are present, a MAJOR SIZE SELECT subroutine is effected (S267) for selecting the major size, and the program returns to the main routine; if the answer of the step S226 is YES, whether the number of document sizes is odd or even is determined (S268). If the number of document sizes is even, a [DOCUMENT SIZE NUMBER÷2] SIZE SELECT subroutine is executed (S269) for selecting a document size which corresponds to the medium size, the program then returning to the main routine. Specifically, assuming that documents of formats A4, B4, A5 and B5 are present as written in the original list, the second-largest size which is B4 is selected, i.e. 4÷2=2. If the number of document sizes is odd as decided in the step S268, a MEDIUM SIZE SELECT subroutine is executed (S270), a medium size is selected out of the original list, and the program returns to the main routine. Specifically, assuming that document sizes of A3, B4 and A4 are listed in the original list, paper sheets of format A4 are selected automatically.

In the PAPER SELECT (I) subroutine of the step S209, which of the major size select mode and medium size select mode should be adopted when automatic selection is selected on the key 44 is determined by the CPU 230 of the main controller 210 which is loaded with the modes. If desired, an exclusive switch may be provided in the copier body 20 to allow either one of the major size select modes and or medium size select modes to be selected.

Figure 34:
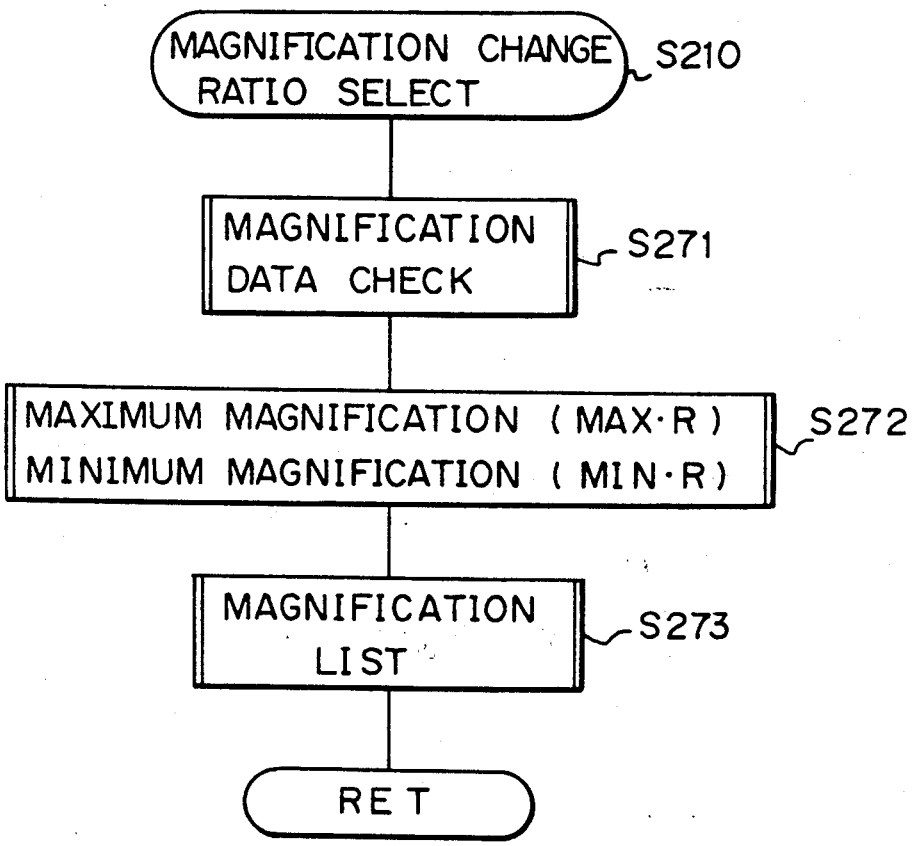
FIG. 34 is a flowchart showing a MAGNIFICATION CHANGE RATIO SELECT subroutine.

When a particular paper size is selected in the step S209, a MAGNIFICATION CHANGE RATIO SELECT subroutine is executed (S210) to select a particular magnification change ratio which matches the selected paper size. As shown in FIG. 34, the step S210 begins with a step S271 for executing a MAGNIFICATION DATA CHECK subroutine. Specifically, magnifications matching the individual documents D are determined on the basis of the paper size selected by the step S209, the original size data prepared by the step S204, and a magnification data table which is stored in the ROM 213 of the main controller 210. An example of the magnification data table is shown in FIG. 36. Subsequently, a MAX MAGNIFICATION (MAX. R) and MIN MAGNIFICATION (MIN. R) SELECT subroutine is executed (S272) for selecting the largest and smallest magnifications out of the magnifications which have been determined by the step S271. This is followed by a MAGNIFICATION LIST subroutine (S273). In this step S273, the minimum magnification is assigned to the documents the size of which is larger than the selected paper size while the maximum magnification is assigned to the documents whose size is equal to or smaller than the paper size, and a magnification list storing magnification data associated with the individual documents are prepared, as shown in FIG. 37.

After the magnification list has been prepared in the step S210, an AMS PROCESS SELECT subroutine (S211) is executed for determining whether to execute the copy process in the LM mode or to execute it in the BT mode is determined. The LM mode is such that, when the AMS mode is selected with a stack of documents of different sizes, the copy process is executed with the two different magnifications determined by the step S210 being selectively applied to the individual documents. On the other hand, the BT mode is such that an AMS process needing a shorter period of time is executed based on the combination of an operation for feeding a document D from the tray 1 of the RDH 10, an operation for temporarily stacking documents on the intermediate tray of the two-side unit, an operation for refeeding documents from the intermediate tray, etc.

Figure 38:
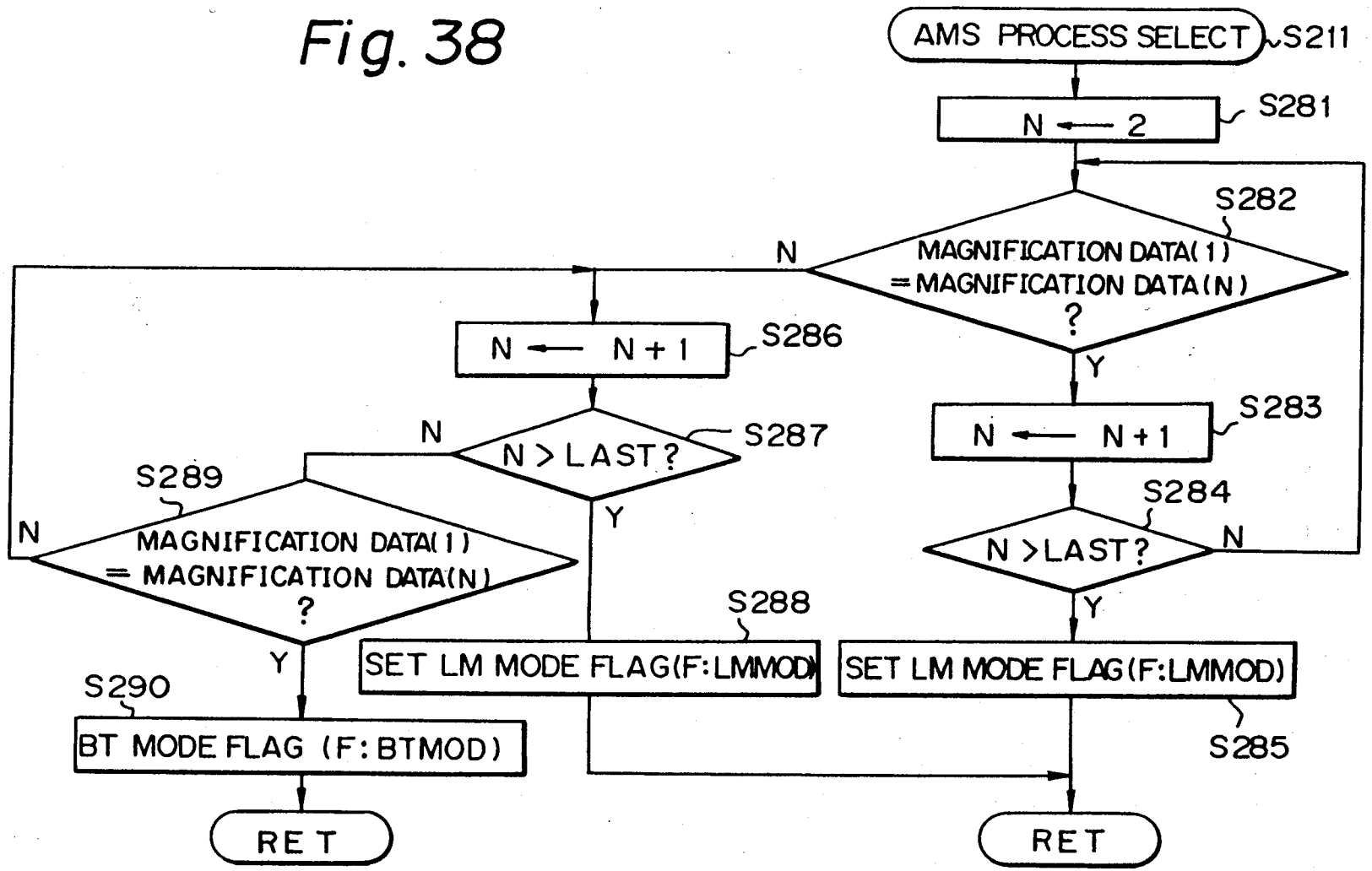
FIG. 38 is af lowchart demonstrating an AMS PROCESS SELECT subroutine.

Subroutines included in the step S211 will be described with reference to FIG. 38. The AMS PROCESS SELECT step begins with a step S281 for selecting a numerical value "2" as a control variable N. Then, in a step S282, whether magnification data (1) assigned to the first document as shown in the magnification list of FIG. 37 and magnification data (N) assigned to the N-th document are coincident is determined. If they compare equal, the variable N is incremented by 1 and, in a step S284, whether or not the variable N is greater than the document number of the last document on the magnification list, i.e., N>LAST is determined. If the answer of step S284 is NO, the step S282 is repeated while, if it is YES, a step S285 is executed for setting an LM mode flag (F: LMMOD) which decides the execution of the LM mode and the program returns to the main flow. If the magnification data (l) and (N) do not compare equal in the step S282, a step S286 is executed to increment the variable N by 1 and, in the next step S287, N>LAST is checked. If the answer of the step S287 is YES, the LM mode flag is set (S288) and the program returns to the main flow while, if it is NO, whether or not the magnification data (l) and (N) are coincident is determined (S289). If the answer of the step S289 is NO, the step S286 is repeated while, if it is YES, a step S290 is executed to set a BT mode flag (F: BTMOD) which decides the execution of the BT mode is set and the program returns to the main flow. In this manner, when the magnification data associated with the individual documents are the same or when the two magnifications selected by the step S210 are present in the form of two blocks in each of which at least more than one magnifications continue, the LM mode flag is set in the step S285 or S288; if otherwise, the BT mode flag is set in the step S290.

Figure 39:
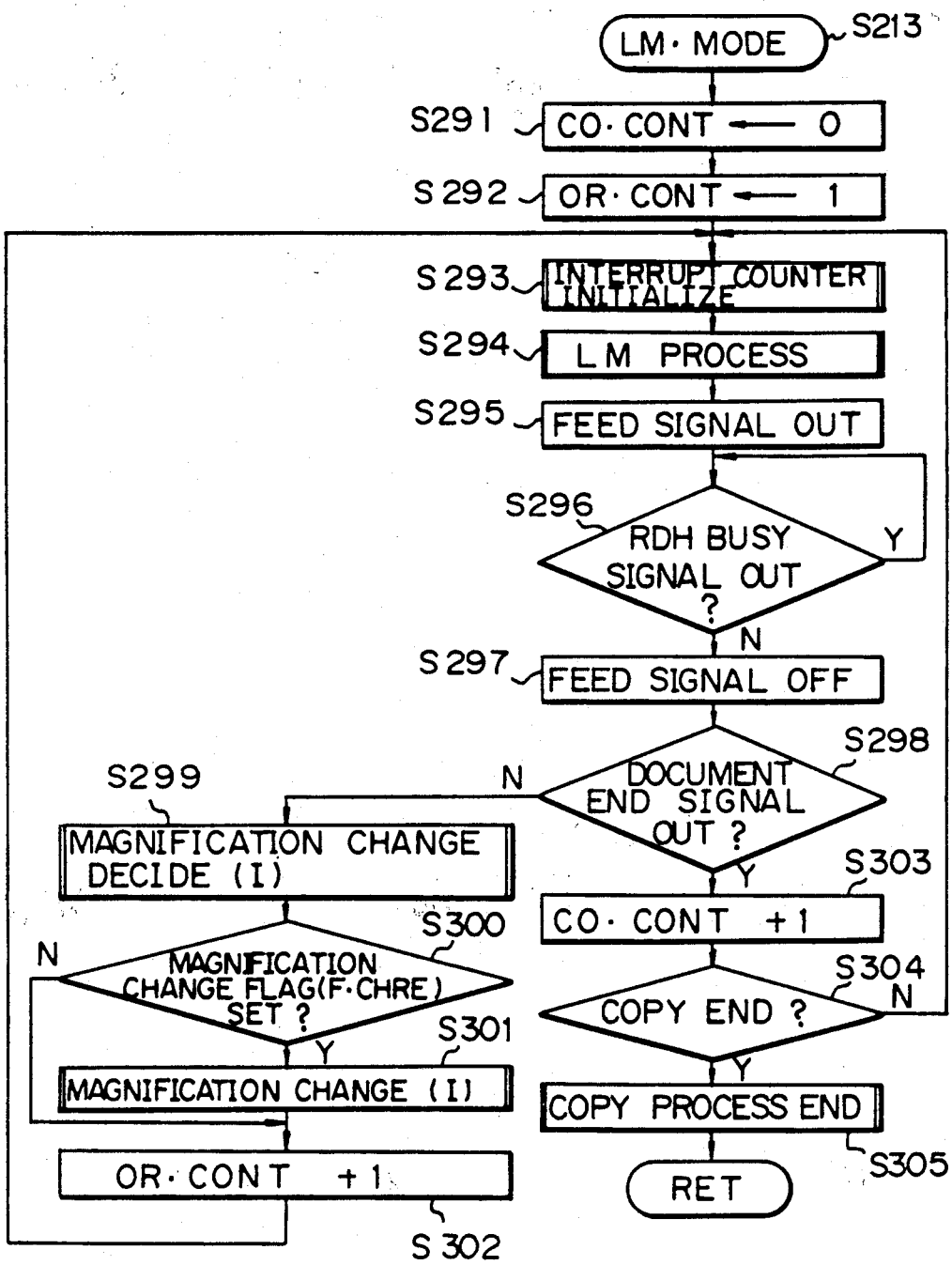
FIG. 39 is a flowchart demonstrating an LM MODE subroutine.

When the LM mode is to be executed as determined in the step S212, an LM MODE PROCESS subroutine is executed (S213). As shown in FIG. 39, this subroutine begins with a step S291 to clear a copy number counter (CO.CONT) to zero. Then, in a step S292, an original counter (OR.CONT) is incremented to one. Subsequently, an interrupt counter adapted for control is initialized by an INTERRUPT COUNTER INITIALIZE subroutine (S293), and the copy process in the LM mode is performed (S294). In the next step S295, a feed signal is applied to the RDH 10. Whether or not the RDH 10 is producing a BUSY signal is determined (S296). If the answer of the step S296 is YES, the step S296 is repeated while, if it is NO, the feed signal is turned off (S298). In a step S298, whether or not a document end signal has been outputted, i.e., whether or not the feeler 45a of the RDH has sensed the last document to cause the photointerrupter 45c to produce an OFF signal is determined. If the answer of the step S298 is NO, a MAGNIFICATION CHANGE (I) subroutine is executed (S299). In this step S299, whether or not the magnification data associated with the document number of the list shown in FIG. 37 which is indicated by the original counter is coincident with the currently set magnification is determined and, if the answer is NO, a magnification change flag (F.CHRE) is set.

Subsequently, in a step S300, whether or not the magnification change flag (F.CHRE) has been set is determined and, if it has been set, a MAGNIFICATION CHANGE (I) subroutine (S301) is executed to move the lens to a particular position associated with the magnification on the list, thereby changing the magnification change ratio. This is followed by a step S302 for incrementing the original counter by 1, the program then returning to the sep S293. If the answer of the step S300 is NO, the operation is transferred to a step S302 by skipping the step S301. When the answer of the step S298 is YES, the copy counter (CO.CONT) is incremented by 1 (step S303) and, then, whether the copy counter is coincident with the preset copy number data is determined (S304) to see if the copying operation has ended. If the answer of the step S304 is NO, the sep S293 is repeated while, if it is YES, a COPY PROCESS END subroutine (S305) is executed to perform the final processing of the copy process, the program then returning to the main flow.

Figure 40:
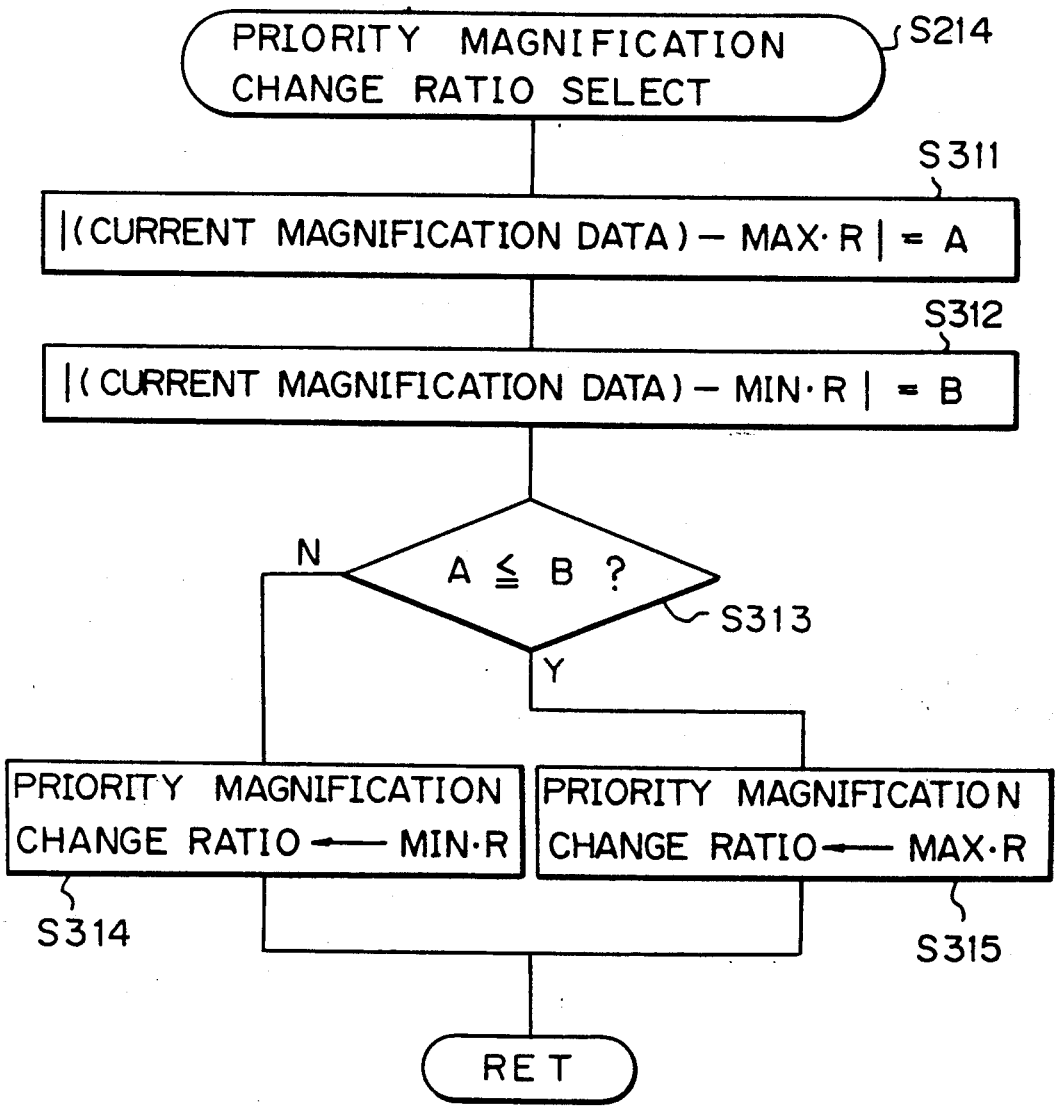
FIG. 40 is a flowchart demonstrating a PRIORITY MAGNIFICATION SELECT subroutine.

If the mode is determined to be the BT mode in the step S212, a PRIORITY MAGNIFICATION SELECT subroutine (S214) is executed. FIG. 40 indicates this subroutine in detail. The subroutine begins with a step S311 for determining a difference between the currently set magnification and the largest magnification MAX.R, the result being produced as A. This is followed by a step S312 for calculating a difference between the currently set magnification and the smallest magnification MIN.R, the result being produced as B. In a step S313, the differences A and B are compared. If A is smaller than B, the smallest magnification MIN.R is set as a priority magnification change ratio (S314) while, if A is smaller than B, the largest magnification MAX.R is set as a priority magnification change ratio (S315). As a result, a magnification closer to the currently set magnification is selected as a priority magnification change ratio.

Figure 41:
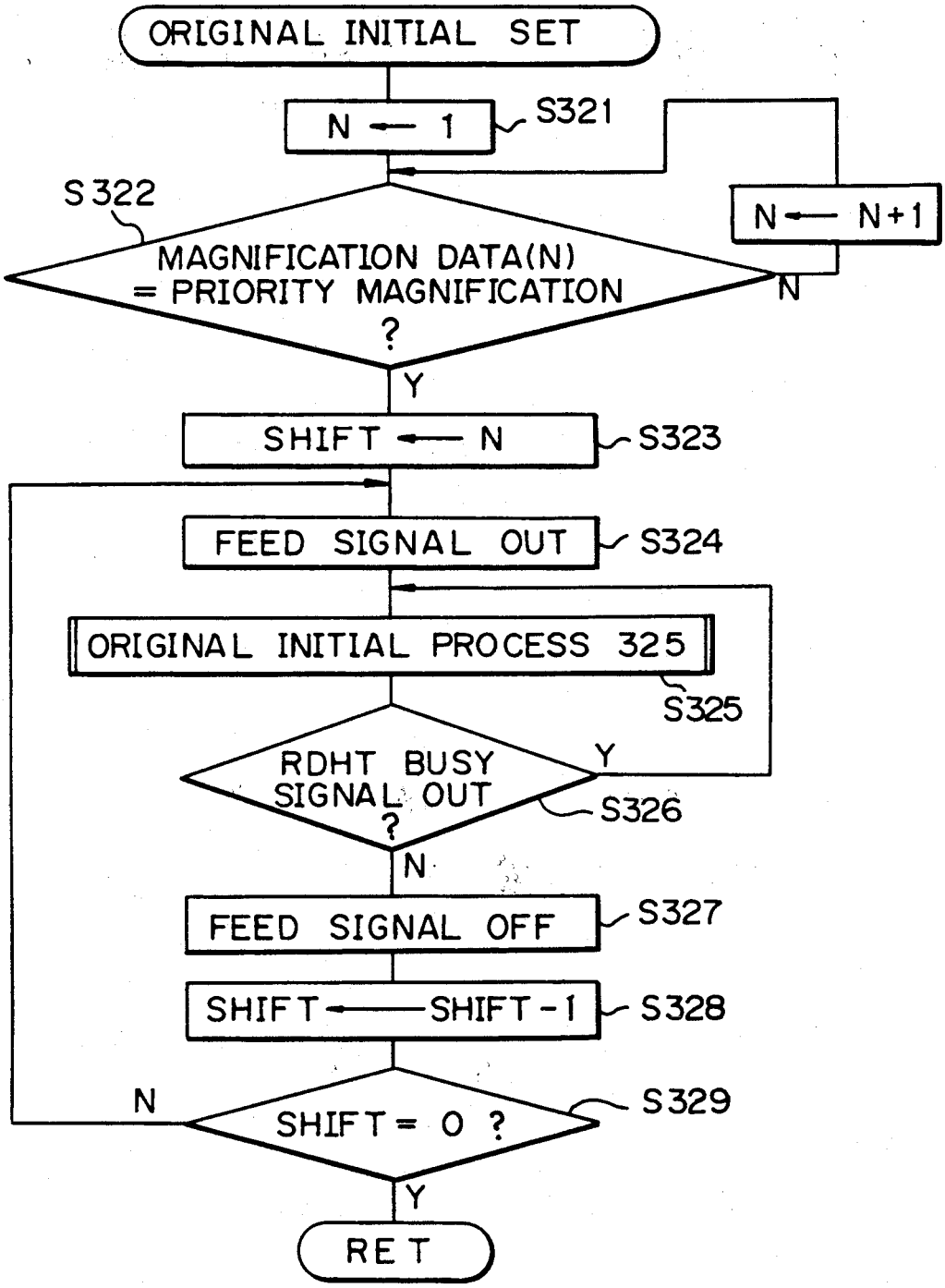
FIG. 41 is a flowchart demonstrating an ORIGINAL INITIAL SET subroutine.

After a priority magnification has been selected as stated above, an ORIGINAL INITIAL SET subroutine is executed, as shown in FIG. 41. This subroutine begins with a step S321 for selecting numerical value "1" for the control variable N. Whether the magnification data (N) associated with the N-th document and the priority magnification determined by the step S214 are coincident is determined (S322) and, if the answer is NO, the variable N is incremented by 1 to repeat the decision with (N + 1). This is repeated until the magnification data and the priority magnification change ratio coincide with each other. When coincidence is reached, the value N of that instant is set in a control register SHIFT (S323). The control register SHIFT is adapted to determine the number of times that the feed from the RDH 10 is repeated. Then, a feed signal is fed to the RDH 10 (S324), AND an ORIGINAL INITIAL PROCESS SUBROUTINE is executed (S325) for controlling the waiting condition of the copier body 20 during original initial setting. Subsequently, whether or not the RDH 10 is producing a BUSY signal, i.e., whether or not one document replacing operation has ended is determined (S326). If the answer of the step S326 is YES, meaning that the replacement is under way, the steps S325 and S326 are repeated in sequence. If the answer of the step S326 is NO, meaning that the replacement has ended, the feed signal to the RDH 20 is interrupted (S327) while the control register SHIFT is decremented by 1 (S328). In the following step S329, whether or not the control register SHIFT has reached zero is determined and, if the answer is NO, the steps S324 and successive steps are repeated until the answer turns from NO to YES. By such a procedure, documents D conforming to the priority magnification ratio are laid on the glass platen 3 one at a time.

The step S215 is followed by a step S216 or BT MODE PROCESS subroutine. This subroutine is shown in detail in FIG. 42. In the figure, the BT MODE PROCESS subroutine begins with a step S331 for clearing the copy counter (CO.CONT) to zero. This is followed by an INTERMEDIATE STACK MODE SET subroutine (S332). In this routine, to temporarily stack the copied paper sheets PD on the intermediate tray of the two-side unit 23, the solenoid 95 is energized to prepare for the arrival of the paper sheet PD at the intermediate tray. In the next step S333, an INTERRUPT COUNTER INITIALIZE subroutine is executed to intialize the interrupt counter. The initialization is followed by a BT PROCESS (I) subroutine (S334) for delivering a feed signal to the RDH 10 (S335). Then, whether the RDH 10 is producing a BUSY signal is determined (S336). While the RDH 10 is producing the BUSY signal, the program returns to the step S335; only when it stops producing the BUSY signal, the next step S337 is executed to turn off the feed signal and, in a step S338, whether a document end signal has appeared is determined. If the answer of the step S338 is NO, a MAGNIFICATION CHANGE DECIDE (II) subroutine is executed (S339). In this subroutine, magnification data associated with the document D being laid on the glass platen 3 is determined on the basis of the list of FIG. 37 and then compared with the currently set magnification. If the former is not coincident with the latter, the magnification change flag (F.CHRE) is set.

Subsequently, whether or not the magnification change flag (F.CHRE) has been set is determined (S340). If the answer of the step S340 is NO, the program returns to the step S333 for repeating the INTERRUPT COUNTER INTIALIZE subroutine and successive subroutines while, if it is YES, a feed signal is sent to the RDH 10 (S341) and whether or not the RDH 10 is producing a BUSY signal is determined (S342). If the answer of the step S342 is NO, the feed signal is turned off (S343) and the program returns to the step S339. if the answer of the step S342 is YES, a BT IDLE PROCESS (S344) subroutine is executed for effecting the copier body wait copy process in the BT mode which occurs while the RDH 10 idles, followed by the sep S342.

On the other hand, if the answer of the step S338 is YES, a MAGNIFICATION CHANGE (II) subroutine (S345) is executed for setting to replace the currently set magnification with the other of the two magnifications selected by the step S210. This subroutine is followed by a step S346, i.e. an INTERMEDIATE STACK MODE RESET subroutine. This subroutine is adapted to cancel the condition in which the copied paper sheets PD are received by the intermediate tray and set by the step S332. Thereafter, in a step S347, the MAGNIFICATION CHANGE DECIDE (II) routine is executed (S347). If it is necessary to change the magnification, the magnification change flag (F.CHRE) is set and, in the next step S348, whether or not the flag (F.CHRE) has been set is determined. If the answer of the step S348 is NO, the INERRUPT COUNTER INITIALIZE subroutine is executed as in the step S332 (S349). Further, the BT PROCESS (II) subroutine is executed (S350) so that paper sheets are sequentially fed from the paper cassette which has been selected by the PAPER SELECT (I) subroutine of the step S209, whereby the ordinary copy process is performed. This is followed by a step S351 shown in FIG. 3. In the step S351, a feed signal is sent to the RDH 10. In the subsequent step M352, whether or not the RDH 10 is producing the BUSY signal is determined. Such a procedure is repeated until the BUSY appears. When the BUSY signal disappears, the next step S353 is executed to turn off the feed signal. Thereupon, whether a document signal has been produced is determined (S354) and, if the answer of the step S354 is NO, the program returns to the step S347 to repeat the MAGNIFICATION CHANGE DECIDE 9 (II) subroutine and successive steps. If the answer of the step S354 is YES, the copy counter (CO.-CONT) is incremented by 1 and the next step S356 is executed. In the step S356, whether or not the content of the copy counter (CO.CONT) is coincident with the copy number data which has been set by the KEY INPUT CHECK subroutine of the step S183, i.e., whether or not the copying operation has been ended is determined. If the answer of the step S356 is NO, the program returns to the step S332 so that the INTERMEDIATE STACK MODE SET and successive steps are repeated. When the answer of the step S356 is YES, a COPY END PROCESS subroutine (S357) is executed and the program returns to the main flow.

Figure 42:
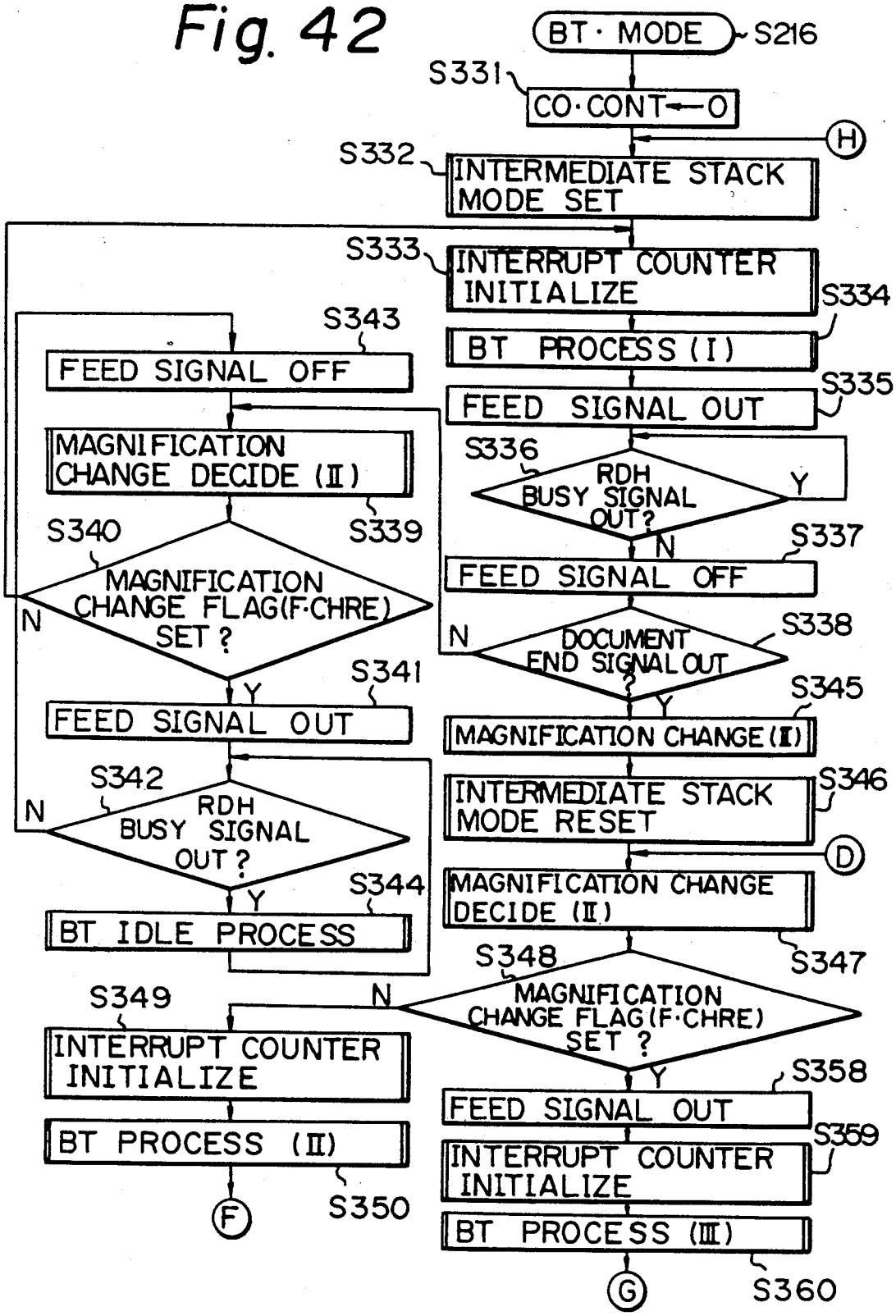
FIGS. 42 and 43 are flowcharts showing a BT MODE subroutine.
Figure 43:
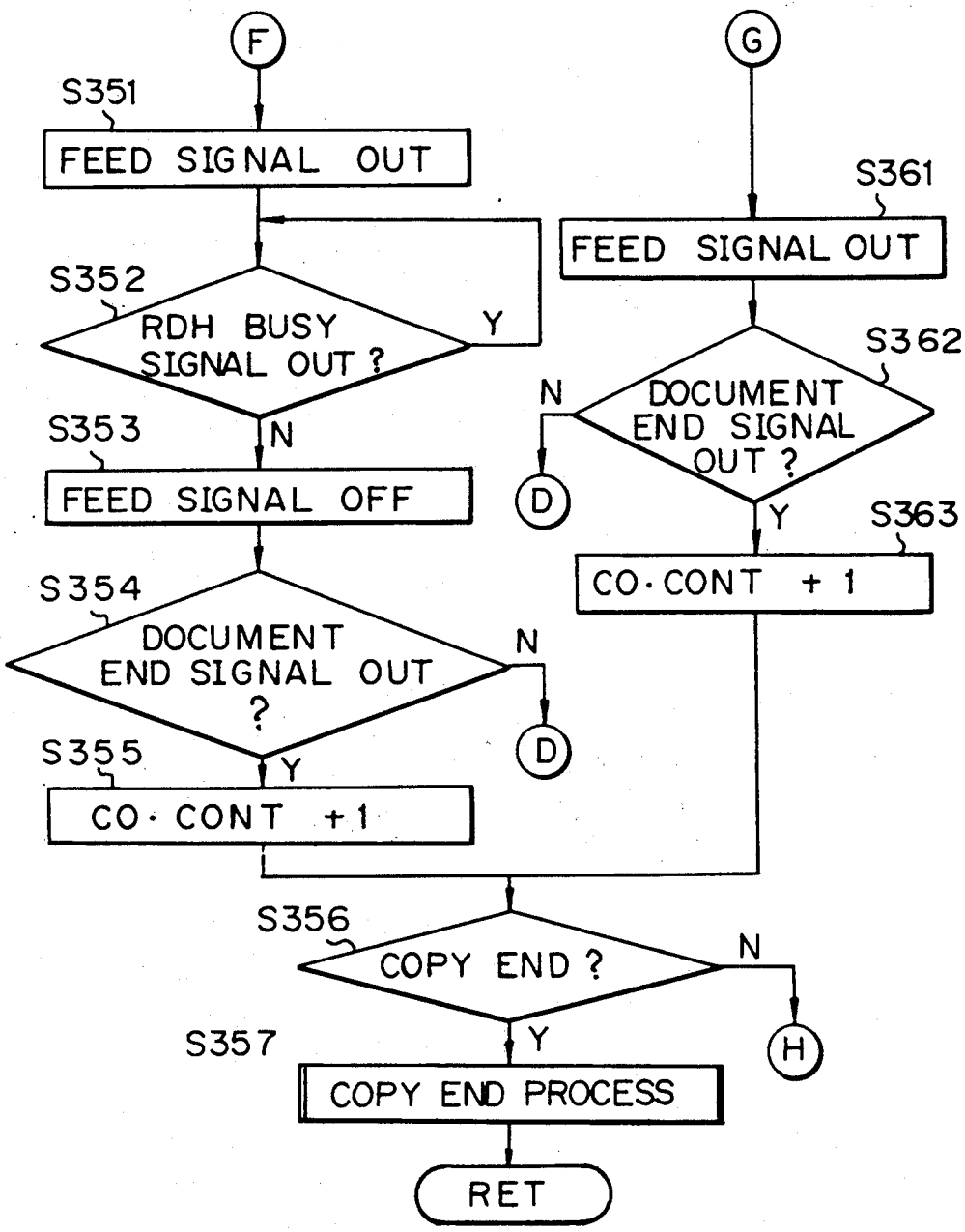

If the answer of the step S348 of FIG. 42 is YES, a feed signal is applied to the RDH 10 (S358), the INTERRUPT COUNTER INITIALIZE subroutine is executed in a step S359, and a BT PROCESS (III) suroutine is effected in a step S360. In the step S360, a single copied paper sheet is fed out from the intermediate tray and discharged without, among various copying steps, the exposing, developing and transferring steps being effected. After the step S360, the next step S361 shown in FIG. 43 is executed to turn off the feed signal and, in a step S362, whether or not a document end signal has appeared is determined. If the answer of the step S362 is NO, the step S347 and successive steps are repeated while, if it is YES, the copy counter (CO.-CONT) is incremented by 1 (S363) and the steps S356 and S357 are executed.

The BT mode involves the following procedures. In the AMS mode effected with a stack of documents of different sizes, the documents D of the size matching the priority magnification change ratio which has been determined by PRIORITY MAGNIFICATION CHANGE RATIO SELECT of step S214 are copied, and the resulting copies PE are temporarily stacked on the intermediate tray. The other documents D which do not match the above-mentioned magnification change ratio are ciculated by the RDH 10 without being copied. After all the documents of the matching size have been copied, the magnification is changed. Then, the documents whose size matches the new magnification are copied while the other documents are not copied and, at the same time, the copies having been stacked on the intermediate tray are fed out for the purpose of arranging the copies in the order of page. Such procedures are repeated to implement an efficient AMS process.

In the illustrative embodiment, the RDH control is essentially the same as in the first embodiment shown in FIGS. 23 to 25. Also, the control over the finisher 30 and shift roller are similar to that of the first embodiment as shown in FIGS. 26 to 29. Further, the free-run recycle mode and copy recycle mode are effected in the same manner as in the first embodiment, and redundant description will be avoided for simplicity.

Figure 44A:
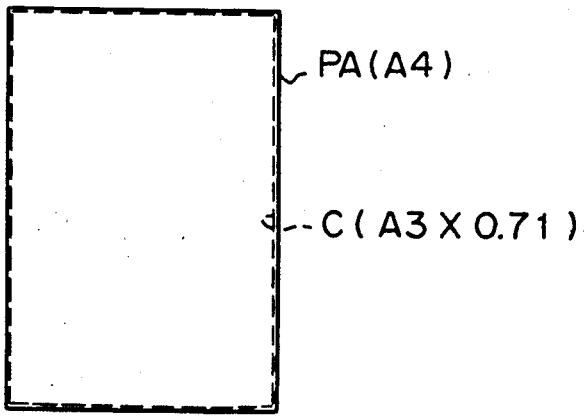
FIGS. 44A to 44C each plots a specific relationship between a paper sheet and an image of a document reproduced thereon.
Figure 44B:
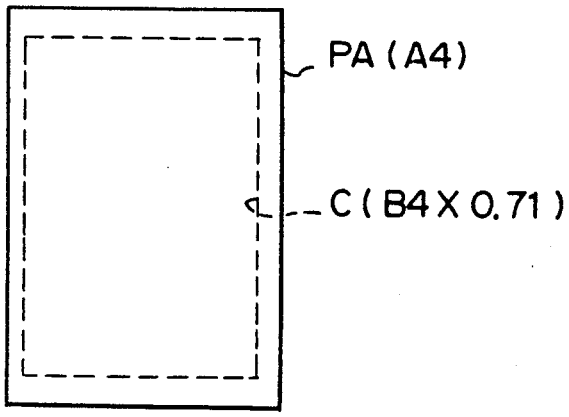
Figure 44C:
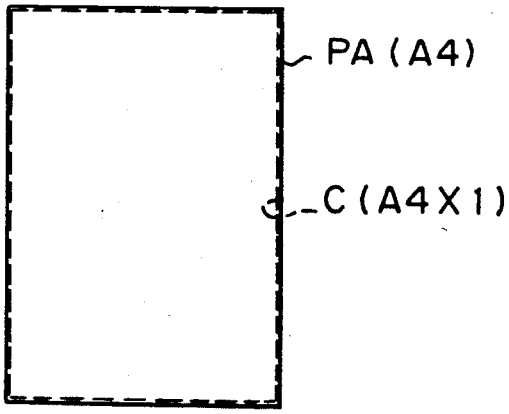

The control operations of the second embodiment described above will be summarized. Assume that a stack of documents D of formats A3, B4 and A4 are laid on the document tray 1, that the paper size key 44 provided on the operation panel 40 is manipulated to effect automatic selection of paper sheets from the paper cassettes 2A, 2B and 2C in place of manual selection, and that the automatic magnification key 48*a* included in the special function key group 48 is pressed to set up an automatic magnification mode. In this condition, the copier is ready to effect copying processes according to, for example, the major size select mode which is set in the main controller 210 of the copier body 20 beforehand. When the print key 41 is pressed, the RDH 10 feeds the documents one by one while memorizing their sizes in their order of stacking. Based on the stored document sizes, paper sheets of the same size as the size of documents which are predominant in the stack are selected. Hence, paper sheets of the same size as the documents of the major size are fed from a particular paper cassette. In this manner, once the document size and paper size are determined, optimum magnifications for the individual documents are determined by referencing a magnification data table being stored in the ROM 213 and, among them, the maximum and minimum magnifications are selected. In this condition, as shown in FIGS. 44A to 44C, documents of formats A3 and B4 are copied by the minimum magnification of 71%, and documents of format A4 by the maximum magnification of 100%, for example. After different magnifications have been set in association with the individual documents, the RDH 10 is operated to copy only the documents to which the magnification of 100%, for example, is assigned while the resulting copies PD are stacked on the intermediate tray for a moment. Then, the optics is actuated to change the magnification change ratio to 71%. While the RDH 10 is operated to circulate all of the documents, the A3 and B3 documents are copied with the A4 documents being skipped. Simutaneously, the copies being stacked on the intermediate tray and associated with the skipped documents are discharged. Consequently, the copies are sequentially discharged to the finisher 30 in the same order as the stacking order, so that a bound set of copies of the same size, i.e., format A4 and arranged in the same order as the documents is obtained. More specifically, as shown in FIGS. 44A to 44C, an A3 document is reproduced on an A4 paper sheet PA in the form of a copy C(A3×0.71) by being reduced to A3×0.71, a B4 document is reproduced on an A4 paper sheet PA in the form of a copy C(B4×0.71) by being reduced to B4×0.71, and an A4 document is reproduced on an A4 paper sheet PA in the form of a copy C(A4×1) in the same size.

In the major size select mode, even when the major size is different from the above-mentioned size or when documents of many different sizes are stacked together, optimum processing is performed automatically according to the previously described flows. In the medium side select mode, processing will be performed according to the previously stated flows by using the medium size as a reference. While the illustrative embodiment has been shown and described in relation to three document sizes and three paper sizes, it is of course practicable with four or more document sizes or with only two document sizes by the same principle.

The second embodiment described above has various advantages as enumerated below.

(1) In response to an operator's command, one of a plurality of paper sizes which is expected to promote highly efficient copying operations in relation to document sizes is selected automatically. The operator, therefore, does not have to select a particular paper size by checking documents as to the size and number, i.e., documents of different sizes can be efficiently reproduced on paper sheets of the same size.

(2) Document sizes may be divided into two groups on the basis of all document size data being memorized, so as to copy documents by two different magnifications including the same size as the documents. Hence, documents of different sizes can be reproduced efficiently on paper sheets of the same size.

(3) While a stack of documents of different sizes are fed one by one, only the documents belonging to a certain size group are copied first and the resulting copies are stacked on an intermediate tray and, thereafter, documents belonging to another size group are copied by a different magnification. The resulting copies are discharged in the same order as the stacking order of the documents of different sizes. This eliminates the need for the rearrangement of pages even when the documents are copied in different modes, thereby enhancing efficient copying operations.

(4) Documents of different sizes can be reproduced efficiently and in a desirable balance by selecting a medium document size for a reference and assigning two different magnifications to paper sheets of the same size.

(5) Efficient copying operations are achievable by using major one of different sizes of documents as a reference, selecting paper sheets of a particular size which is the same as the major document size, and using two different magnifications.

Various modifications will become possible for those skilled in the art after receiving the teachings of the present disclosure without departing from the scope thereof.

What is claimed is:

1. A copier in which documents are recycled, comprising:

a plurality of paper feeding means each for feeding paper sheets of a different size;

copying means for copying documents on paper sheets which individually match said documents in size;

a recycling automatic document feeding device loaded with a recycling stack of documents having a plurality of sizes for sequentially transporting said documents one by one to an image expsosing station of said copying means;

a finisher for automatically binding copied paper sheets discharged from said copying means while regulating a stacking condition of said copied paper sheets;

document size sensing means for sensing the sizes of the documents being transported to the exposing station by said automatic document feeding device;

main control means for controlling said copying means and said automatic document feeding device such that a plurality of control operations are selectively performed;

finisher control means for controlling said finisher such that the copied paper sheets produced by the control operations of said main control means are bound and discharged, wherein said plurality of control operations comprises a control operation in which said automatic document feeding device circulates all of the documents once while causing said document size sensing means to sense the sizes of all of said documents;

only the documents of a same size are copied while said automatic document feeding device circulates all of the documents once, the documents of the largest size or the smallest size sensed by said document sensing means being first; and the copying of the documents of a same size is repeated a number of times associated with a number of sizes of documents sensed by said document size sensing means.

2. A copier as claimed in claim 1, wherein said finisher control means controls said finisher such that every time the copying of the documents of a same size completes, said finisher binds and discharges the copied paper sheets which said finisher has received during said copying.

3. A copier in which documents are recycled, comprising:

a plurality of paper feeding means each for feeding paper sheets of a different size;

copying means for copying documents on paper sheets which individually match said documents in size;

a recycling automatic document feeding device loaded with a recycling stack of documents having a plurality of sizes for sequentially transporting said documents one by one to an image expsosing station of said copying means;

a finisher for automatically binding copied paper sheets discharged from said copying means while regulating a stacking condition of said copied paper sheets;

document size sensing means for sensing the sizes of the documents being transported to the exposing station by said automatic document feeding device;

main control means for controlling said copying means and said automatic document feeding device such that a plurality of control operations are selectively performed;

finisher control means for controlling said finisher such that the copied paper sheets produced by the control operations of said main control means are bound and discharged, wherein said copying means discharges the copied paper sheets either immediately or after temporarily stacking said copied paper sheets in said copying means.

4. A copier as claimed in claim 3, wherein the plurality of control operations comprise a control operation in which when documents of two sizes are used, the documents being sequentially transported by said automatic document feeding device to the imagewise exposing station are copied on the paper sheets of sizes which individually match the sizes of said documents sensed by said document sensing means;

the copied paper sheets of a first size are immediately discharged while the copy sheets of a second size are stacked in said copying means; and said copied paper sheets of the second size are discharged when all of said documents have been copied.

5. A copier as claimed in claim 4, wherein said finisher control means controls said finisher such that when said copying means ends copying, said finisher binds and discharges the copied paper sheets of the first size which said finisher has received till then and, subsequently, receives the copied paper sheets of the second size to bind and discharge said copied paper sheets of the second size.

6. A copier as claimed in claim 3, wherein said plurality of control operations comprise a control operation in which said automatic document feeding device circulates all of the documents once while causing said document size sensing means to sense the sizes of all of said documents;

said automatic document feeding device sequentially circulates, when two document sizes are sensed, all of the documents again by way of the imagewise exposing station to copy said documents on the paper sheets of sizes which individually match the individual document sizes;

the copied paper sheets of a first size are immediately discharged while the copied paper sheets of a second size smaller than the first size are stacked in said copying means; and said copied paper sheets of the second size are discharged after all of the documents have been copied.

7. A copier as claimed in claim 6, wherein said finisher control means controls said finisher such that when said copying means ends copying, said finisher binds and discharges the copied paper sheets of the first size which said finisher has received till then and, subsequently, receives the copied paper sheets of the second size to bind and discharge said paper sheets of the second size.

8. A copier as claimed in claim 3, wherein the plurality of control operations comprises a fifth control operation in which when said automatic document feeding device circulates all of the documents to the exposing station for the first time, only the documents of a first size sensed by said document size sensing means first and the documents of a second sized sensed immediately after the first size are copied on the paper sheets which individually match with said documents in size;

the copied paper sheets of the first size are immediately discharged while the copied paper sheets of the second size are stacked in said copying means and, after all of the documents have been circulated, discharged;

during the second circulation of all of the documents, only the documents of a third size and the documents of a fourth size sensed by said document sensing in sequence after the first and second sizes are copied on the paper sheets which individually match said documents in size;

the copied paper sheets of the third size are immediately discharged while the copied paper sheets of the fourth size are stacked in said copying means and, after all of the documents have been circulated, discharged; and the copying of the documents of each two sizes per circulation of all of the documents is repeated.

9. A copier as claimed in claim 8, wherein said finisher control means controls said finisher such that every time said automatic document feeding device ends a circulation of all of the documents, said finisher binds and discharges the copied paper sheets which said finisher has received till then and, subsequently, receives the copied paper sheets having been stacked in said copying means to bind and discharge said copied paper sheets.

10. A copier in which documents are recycled, comprising:

a plurality of paper feeding means each for feeding paper sheets of a different size;

copying means for copying documents on paper sheets which individually match said documents in size;

a recycling automatic document feeding device loaded with a recycling stack of documents having a plurality of sizes for sequentially transporting said documents one by one to an image expsosing station of said copying means;

a finisher for automatically binding copied paper sheets discharged from said copying means while regulating a stacking condition of said copied paper sheets;

document size sensing means for sensing the sizes of the documents being transported to the exposing station by said automatic document feeding device;

main control means for controlling said copying means and said automatic document feeding device such that a plurality of control operations are selectively performed;

finisher control means for controlling said finisher such that the copied paper sheets produced by the control operations of said main control means are bound and discharged, wherein said plurality of control operations comprise a control operation wherein said automatic document feeding device ciculates all of the documents once while causing said documents size sensing means to sense the sizes of all of said documents, while said automatic document feeding means circulates all of the documents once afterwards, the documents of each two sizes are copied on the paper sheets of sizes which are individually associated with said document sizes, the documents of the largest size being first;

the copied paper sheets of a first size are immediately discharged while the copied paper sheets of a second size smaller than the first size are stacked in said copying means and, after all of the documents have been circulated, discharged; and the above procedure is repeated until the all of the documents having the sensed sizes have been copied.

11. A copier as claimed in claim 10, wherein said finisher control means controls said finisher such that a circulation of all of the documents caused by said automatic document feeding device completes, said finisher binds and discharges the copied paper sheets which said finisher has received during said circulation and, subsequently, receives the copied paper sheets having been stacked in said copying means to bind and discharge said copied paper sheets.

12. A copier in which documents are recycled, comprising:

a pluality of feeding means each for feeding paper sheets of a different size;

copying means supplied with paper sheets which individually match documents in size for copying documents on said paper sheets;

a recycling automatic document feeding device loaded with a stack of documents of a plurality of sizes for sequentially transporting said documents one by one to an imagewise exposing station of said copying means while returning said documents to a predetermined position of said automatic document feeding device;

document size sensing means for sensing sizes of the documents;

document size storing means for storing the sensed sizes of the documents;

magnification changing means for changing a size in which the documents are to be copied on the paper sheets; and means for causing said automatic document feeding device to circulate the individual documents once while causing said document size sensing means to sense the sizes of said documents, storing the sensed sizes of all of the documents in said document size storing means, and automatically selecting, on the basis of the stored document sizes, paper sheets associated with the documents of a medium size or paper sheets associated with the documents of a major size which a majority of the documents shares.

13. A copier in which documents are recycled, comprising:

a pluality of feeding means each for feeding paper sheets of a different size;

copying means for copying documents on paper sheets which individually match the documents in size;

a recycling automatic document feeding device loaded with a stack of documents of a plurality of sizes for sequentially transporting said documents one by one to an imagewise exposing station of said copying means while returning said documents to a predetermined position of said automatic document feeding device;

document size sensing means for sensing sizes of the documents;

document size storing means for storing the sensed sizes of the documents;

magnification changing means for changing a size in which the documents are to be copied on the paper sheets; and control means for causing said automatic document feeding device to circulate the individual documents once while causing said document size sensing means to sense the sizes of the documents, storing all of the sensed sizes of the documents in said storing means, and setting, by dividing the documents of a plurality of sizes into two size groups on the basis of the stored document sizes, a copy mode in which the documents are copied on the paper sheets of a single size by two kinds of magnifications which include the same magnification as the documents.

14. A copier as claimed in claim 13, further comprising an intermediate tray for temporarily stacking the copied paper sheets;

said control means setting a copy mode in which while the individual documents are sequentially fed, the documents belonging to one size group are copied first and the copied papers sheets associated with said documents are stacked on said intermediate tray, and then the documents belonging to the other size group are copied, the copied paper sheets being sequentially discharged in the same order as an order in which the documents are stacked.

15. A copier as claimed in claim 13, wherein the two magnifications are selected by using the documents of a medium size as a reference.

16. A copier as claimed in claim 13, wherein the two magnifications are selected by using the documents of a major size which a majority of the documents shares as a reference.

* * * * *